US006746834B2

(12) United States Patent
Kuramitsu et al.

(10) Patent No.: US 6,746,834 B2
(45) Date of Patent: Jun. 8, 2004

(54) SILVER HALIDE COLOR REVERSAL PHOTOGRAPHIC MATERIAL

(75) Inventors: Masayuki Kuramitsu, Minami-Ashigara (JP); Minoru Sato, Tokyo (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 220 days.

(21) Appl. No.: 10/098,357

(22) Filed: Mar. 18, 2002

(65) Prior Publication Data

US 2003/0087209 A1 May 8, 2003

(30) Foreign Application Priority Data

Mar. 19, 2001 (JP) ..... 2001-079388
Jul. 19, 2001 (JP) ..... 2001-220266
Feb. 13, 2002 (JP) ..... 2002-035714

(51) Int. Cl.[7] ..... G03C 1/46

(52) U.S. Cl. ..... 430/504; 430/502; 430/503; 430/505; 430/506; 430/558

(58) Field of Search ..... 430/502, 503, 430/504, 505, 506, 558

(56) References Cited

U.S. PATENT DOCUMENTS 4,663,271 A * 5/1987 Nozawa et al. ..... 430/503
5,262,287 A * 11/1993 Deguchi et al. ..... 430/504
5,436,121 A * 7/1995 Suga et al. ..... 430/504
6,645,680 B2 * 11/2003 Abe et al. ..... 430/379
6,656,670 B2 * 12/2003 Sato et al. ..... 430/504

FOREIGN PATENT DOCUMENTS

JP 2-124566 5/1990
JP 2-272540 11/1990

* cited by examiner

*Primary Examiner*—Geraldine Letscher
(74) *Attorney, Agent, or Firm*—Sughrue Mion, PLLC

(57) ABSTRACT

A silver halide color reversal photographic material comprises, on a transparent support, at least one each of blue-, green-, and red-sensitive emulsion layer units. The lightsensitive material further has means for regulating an interimage effect. The red-sensitive unit satisfies the relation:

$$620\ \text{nm} \leqq \lambda r\max \leqq 660\ \text{nm}$$

λrmax is the wavelength at which the maximum sensitivity of the spectral sensitivity distribution of the red-sensitive unit is given. The red- and green-sensitive units satisfy the relations:

$$Sr(\lambda rmax) - Sr(580) \leqq 1.0 \text{ and}$$

$$-0.5 \leqq Sr(580) - Sg(580) \leqq 0.5$$

Sr(λrmax) is the maximum sensitivity of the red-sensitive unit, Sr(580) and Sg(580) are the sensitivity at 580 nm of the red- and green-sensitive unit, respectively. Magnitude of the interimage effect satisfies the relations:

$$\text{IIEgr} \geqq 0.15 \text{ and IIErg} \geqq 0.0$$

IIEgr is the magnitude of the interimage effect from the green- to red-sensitive units, and IIErg is that from the red- to green-sensitive units.

8 Claims, 1 Drawing Sheet

SILVER HALIDE COLOR REVERSAL PHOTOGRAPHIC MATERIAL

This application is based upon and claims the benefit of priority from the prior Japanese Patent Applications No. 2001-079388, filed Mar. 19, 2001; No. 2001-220266, filed Jul. 19, 2001; and No. 2002-035714, filed Feb. 13, 2002 the entire contents of three of which are incorporated herein by reference.

BACKGROUND OF THE INVENTION

1. Field of the Invention

The present invention relates to a color reversal photographic material, and particularly, to a color reversal photographic material exhibiting improved color reproduction. More particularly, the present invention relates to a color reversal photographic material superior in faithful color reproduction and capable of realizing high saturation.

2. Description of the Related Art

Various attempts were heretofore made to improve color reproduction in color reversal photographic materials.

In order to attain higher saturation and higher faithfulness in color reproduction, as for color negative films, correction of side absorption of coloring materials are generally made by masking in which so-called colored couplers are used. On the other hand, in the case of color reversal photographic materials, the above-mentioned correction of side absorption of coloring materials by means of masking using colored couplers cannot be carried out. Accordingly, attempts to improve color reproduction mainly by use of an interimage effect were made, as well as improvements in spectral sensitivity and spectral absorption characteristics of coloring materials.

For example, "The Theory of The Photographic Process, Fourth Edition", T. H. James, page 568 discloses that attaching much importance to faithful color reproduction will increase overlap in spectral sensitivities, especially, of GL and RL and will reduce saturation and, therefore, emphasis of a larger interimage effect is required for combining the faithful color reproduction and the saturation.

The interimage effect is described by W. T. Hanson Jr. et al. in Journal of the Optical Society of America, Vol. 42, pp. 663–669.

Examples of disclosed methods of enhancing the interimage effect in color reversal films are as follows: U.S. Pat. No. 4,082,553 discloses a reversal image-forming photographic element with a layer arrangement of a plurality of silver halide emulsion layers positioned to permit iodide ion migration among the emulsion layers upon development, in which a surface-fogged silver halide emulsion is added in a lightsensitive emulsion layer.

Jpn. Pat. KOKOKU Publication No. (hereinafter referred to as JP-B-) 1-60135 discloses a color reversal photographic material comprising a blue-, green- and red-sensitive layers, in which each of these layers has sub-layers differing in speed, in which the ratio of the coating silver amount of a high-speed layer, or both a high-speed layer and a medium-speed layer, to the amount of a low-speed layer, is regulated, and in which the silver iodide content of a high-speed layer, or both a high-speed layer and a medium-speed layer, to the content of a low-speed layer, is regulated, thereby to improve the interimage effect. Further, U.S. Pat. No. 5,262,287 discloses a color reversal photographic material, wherein the total silver halide lightsensitive grains have an average iodide content of 5.5 mol % or less, wherein the color reversal photographic material comprises means for expressing an interimage effect, and wherein the degrees of the interimage effect at color densities of 0.5 and 1.5 are regulated.

Such means for enhancing the interimage effect is fundamentally based on changing in the silver iodide content of a lightsensitive silver halide emulsion contained in an image-forming layer, and it, therefore, is accompanied by adverse effects such as deterioration of sensitivity of the silver halide emulsion contained in the image-forming layer and deterioration of preservative properties. Accordingly, there is a limit of enhancement achieved by such means.

Japanese Patent Nos. 2547587, and 2549102, EP 0898200A1 and so on provide a technology to enhance the interimage effect without causing the aforementioned adverse effects by forming a substantially no-dye-forming interimage effect-donating layer. According to this approach, the interimage effect can be enhanced with a few adverse effects. However, no description is made to a method for improving the faithful color reproduction and also in the above-mentioned problems.

With respect to lightsensitive emulsion layers and interimage effect-donating layers, preferable spectral sensitivity distributions for realizing faithful color reproduction are disclosed in Jpn. Pat. Appln. KOKAI Publication No. (hereinafter referred to as JP-A-) 02-272540 and JP-A's-03-122636, 03-264935, 02-124566 and so on.

Although both faithful color reproduction and saturation can be compatible to some extent if these approaches are employed, the degree of improvement is insufficient and some additional improvement is desired.

BRIEF SUMMARY OF THE INVENTION

An object of the present invention is to realize a color reversal photographic material that is superior in faithful color reproduction and exhibits high saturation.

The object of the invention was attained by the following approaches.

(1) A silver halide color reversal photographic material comprising, on a transparent support, at least one blue-sensitive emulsion layer unit containing a color coupler that forms yellow color, at least one green-sensitive emulsion layer unit containing a color coupler that forms magenta color and at least one red-sensitive emulsion layer unit containing a color coupler that forms cyan color, wherein the photographic material having means for regulating an interimage effect;

spectral sensitivity distribution of the red-sensitive emulsion layer unit satisfying the following relation:

$$620\ \text{nm} \leqq \lambda r\max \leqq 660\ \text{nm},$$

wherein λrmax is the wavelength at which the maximum sensitivity of the spectral sensitivity distribution of the red-sensitive emulsion layer unit is given;

sensitivities of the red-sensitive emulsion layer unit and the green-sensitive emulsion layer unit satisfying the following relations:

$$Sr(\lambda rmax) - Sr(580) \leqq 1.0 \text{ and}$$

$$-0.5 \leqq Sr(580) - Sg(580) \leqq 0.5$$

wherein Sr(λrmax) is the maximum sensitivity of the red-sensitive emulsion layer unit and Sr(580) is the sensitivity of the red-sensitive emulsion layer unit at 580 nm, and Sg(580) is the sensitivity of the green-sensitive emulsion layer unit at 580 nm; and magnitude of the interimage effect between the red-sensitive emulsion layer unit and the green-sensitive emulsion layer unit satisfying the following relations:

$$IIEgr \geqq 0.15 \text{ and}$$

$$IIErg \geqq 0.0$$

wherein IIEgr is the magnitude of the interimage effect from the green-sensitive emulsion layer unit to the red-sensitive emulsion layer unit, and IIErg is the magnitude of the interimage effect from the red-sensitive emulsion layer unit to the green-sensitive emulsion layer unit (2) The silver halide color reversal photographic material recited in item (1) above, wherein spectral sensitivity distribution of the green-sensitive emulsion layer unit satisfying the following relation:

$$520 \text{ nm} \leqq \lambda gmax \leqq 570 \text{ nm}$$

wherein λgmax is the wavelength at which the maximum sensitivity of the spectral sensitivity distribution of the green-sensitive emulsion layer unit is given;

sensitivities of the green-sensitive emulsion layer unit satisfying the following relations:

$$Sg(500) > Sg(580) \text{ and}$$

$$0 < Sg(\lambda gmax) - Sg(500) \leqq 1.0$$

wherein Sg(500) is the sensitivity of the green-sensitive emulsion layer unit at 500 nm, Sg(580) is the sensitivity of the green-sensitive emulsion layer unit at 580 nm, and Sg(λgmax) is the maximum sensitivity of the green-sensitive emulsion layer unit; and magnitude of the interimage effect between the green-sensitive emulsion layer unit and the blue-sensitive emulsion layer unit satisfying the following relations:

$$IIEbg \geqq 0.15 \text{ and}$$

$$IIEgb \geqq 0.0$$

wherein IIEbg is the magnitude of the interimage effect from the blue-sensitive emulsion layer unit to the green-sensitive emulsion layer unit, and IIEgb is the magnitude of the interimage effect from the green-sensitive emulsion layer unit to the blue-sensitive emulsion layer unit (3) The silver halide color reversal photographic material recited in item (1) or (2) above, wherein the means for regulating an interimage effect is at least one interimage effect-donating layer that contains a lightsensitive emulsion and that does not substantially form a color image.

(4) The silver halide color reversal photographic material recited in any one of items (1) to (3) above, wherein at least one green-sensitive emulsion layer of the green-sensitive emulsion layer unit containing at least one magenta coupler represented by the following general formula (MC-I) and/or at least one red-sensitive emulsion layer of the red-sensitive emulsion layer unit containing at least one cyan coupler represented by the following general formula (CC-I), and each of the amounts of the magenta coupler and the cyan coupler is 30 mol % or more and 100 mol % or less with respect to a image-forming coupler contained in the green-sensitive emulsion layer and the red-sensitive emulsion layer, respectively.

(MC-I)

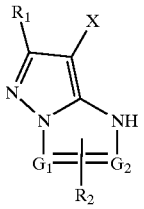

In formula (MC-I), $R_1$ represents a hydrogen atom or substituent; one of $G_1$ and $G_2$ represents a carbon atom, and the other represents a nitrogen atom; and $R_2$ represents a substituent that substitutes one of $G_1$ and $G_2$ which is a carbon atom. $R_1$ and $R_2$ may further have a substituent. X represents a hydrogen atom or a group that is capable of splitting off by a coupling reaction with an aromatic primary amine color developing agent in an oxidized form.

(CC-I)

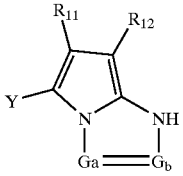

In formula (CC-I), $G_a$ represents —C($R_{13}$)═ or —N═. When $G_a$ represents —N═, $G_b$ represents —C($R_{13}$)═, and when $G_a$ represents —C($R_{13}$)═, $G_b$ represents —N═.

Each of $R_{11}$ and $R_{12}$ represents an electron-withdrawing group having a Hammett substituent constant σp value of 0.20 to 1.0. $R_{13}$ represents a substituent. Y represents a hydrogen atom or a group that is capable of splitting off by a coupling reaction with an aromatic primary amine color developing agent in an oxidized form.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DETAILED DESCRIPTION OF THE INVENTION

Figure 1:
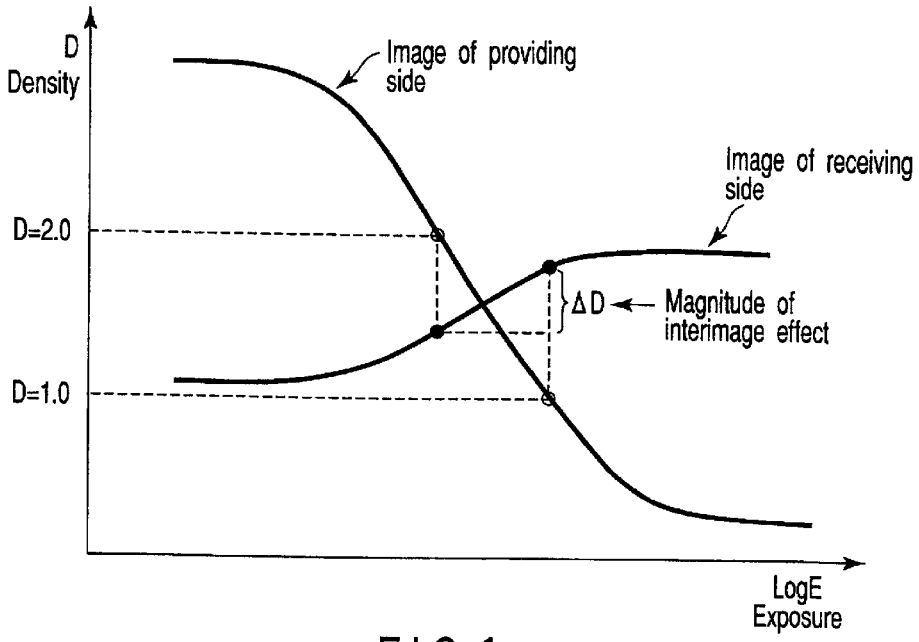
FIG. 1 is a graph for explaining the magnitude of an interimage effect defined in the invention.
Figure 2:
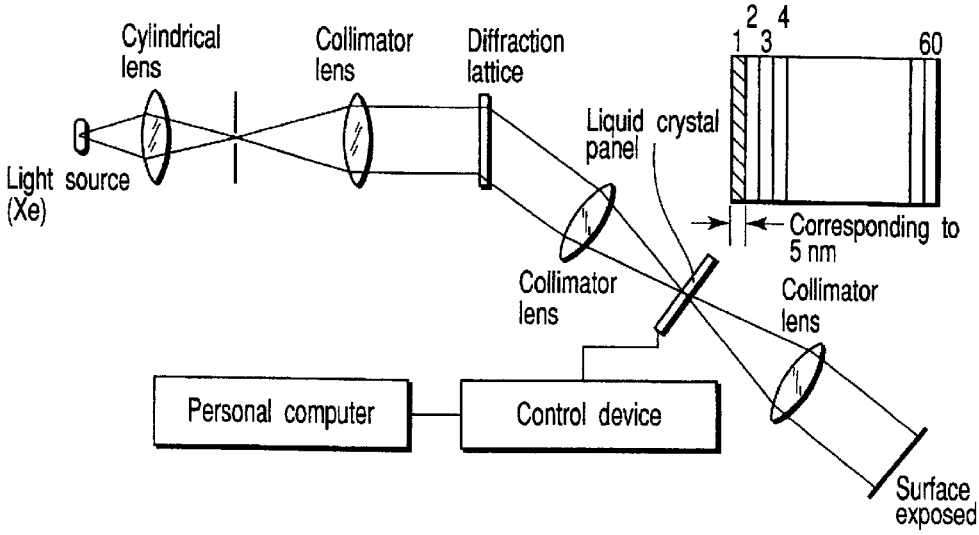
FIG. 2 is a schematic diagram of one example of a spectrosensitometer device.

The term "spectral sensitivity distribution" referred to in the present invention is that in a wavelength region of 380 nm to 780 nm.

In the invention, the sensitivity used to show a spectral sensitivity distribution is indicated by the logarithm of the reciprocal of an exposure amount required for each of the color-sensitive layers to have a density of 1.0.

In order for the silver halide color reversal photographic material of the invention to combine faithful color reproduction with high saturation, both the spectral sensitivity distribution and the magnitude of an interimage effect must satisfy the preferred ranges that will be described below.

In the invention, a preferred range of the wavelength represented by λrmax that gives the maximum sensitivity of the spectral sensitivity distribution of the red-sensitive emulsion unit containing a color coupler that forms a cyan color, is 620 nm≦λrmax≦660 nm. Further improvement in faithful color reproduction can be attained but by setting the range to 630 nm≦λrmax≦650 nm.

Further in the invention, the relation among Sr(580), Sr(λrmax) and Sg(580), which are the sensitivity of the red-sensitive emulsion layer unit at 580 nm, the maximum sensitivity of the red-sensitive emulsion layer unit, and the sensitivity of the green-sensitive emulsion layer unit at 580 nm, respectively, is Sr(λrmax)−Sr(580)≦1.0 and −0.5≦Sr(580)−Sg(580)≦0.5. Further improvement in faithful color reproduction can be attained but by setting the range to Sr(λmax)−Sr(580)≦0.5. In addition, much further improvement in faithful color reproduction can be attained but by setting the range to −0.3≦Sr(580)−Sg(580)≦0.3, and still further improvement in faithful color reproduction can be attained by setting the range to −0.15≦Sr(580)−Sg(580)≦0.15.

In the invention, the magnitude of the interimage effect from the red-sensitive emulsion layer unit to the green-sensitive emulsion layer unit, represented by IIErg, and the magnitude of the interimage effect from the green-sensitive emulsion layer unit to the red-sensitive emulsion layer unit, represented by IIEgr, are IIEgr≧0.15 and IIErg≧0.0. With regard to IIEgr, much higher saturation can be attained by setting IIEgr≧0.20. However, too large IIEgr impairs the faithful color reproduction, and thus IIEgr preferably meets the range of 2.0≧IIEgr≧0.20. With regard to IIErg, much higher saturation can also be attained by setting IIErg≧0.05. However, too large IIErg impairs the faithful color reproduction, and thus IIErg preferably meets the range of 1.5≧IIErg≧0.05. In order to attain improvement in the saturation while maintaining the faithful color reproduction at a preferable level, setting the magnitude to IIEgr>IIErg is preferable.

In addition to the above, in order to attain the excellent faithfulness in reproduction of hue, λgmax, which is the wavelength at which the maximum sensitivity of the spectral sensitivity distribution of the green-sensitive emulsion unit of the invention, is preferably in a range of 520 nm≦λgmax≦570 nm, more preferably 530 nm≦λgmax≦560 nm.

In this case, Sg(580), Sg(λgmax) and Sg(500), which are the sensitivity of the green-sensitive emulsion layer unit at 580 nm, the maximum sensitivity of the green-sensitive emulsion layer unit, and the sensitivity of the green-sensitive emulsion layer unit at 500 nm, respectively, are Sg(500)>Sg(580) and 0<Sg(λgmax)−Sg(500)≦1.0. Further improvement in faithful color reproduction can be realized by setting the ranges to 1.0≧Sg(500)−Sg(580)>0 and/or 0<Sg(λgmax)−Sg(500)≦0.5.

Further, in the invention, the magnitude of the interimage effect from the green-sensitive emulsion layer unit to the blue-sensitive emulsion layer unit, represented by IIEgb, and the magnitude of the interimage effect from the blue-sensitive emulsion layer unit to the green-sensitive emulsion layer unit, represented by IIEbg, are preferably IIEbg≧0.15 and IIEgb≧0.0. Preferably higher saturation can be realized by setting IIEbg≧0.2. In addition, in order not to largely impair the faithful color reproduction, IIEbg is more preferably set to a range of 2.0≧IIEbg≧0.2. Further, more preferably higher saturation can be attained by setting IIEgb≧0.05. However, in order not to largely impair the faithful color reproduction, 1.5≧IIEgb≧0.05 is more preferable. Further, in order to improve saturation while maintaining the preferable faithfulness in reproduction of hue, setting the magnitude to IIEbg>IIEgb is more preferable.

To set the spectral sensitivity distribution of the red-sensitive emulsion unit and/or that of the green-sensitive emulsion unit to the preferable ranges improves the faithful color reproduction, but, at the same time, accompanies decrease in the saturation. Therefore, in the case where the spectral sensitivity distribution is set at the preferable ranges, it is preferable that the magnitude of the interimage effect, IIErg and IIEgr, and the magnitude of the interimage effect, IIEbg and IIEgb, are also set at the preferable ranges at the same time.

In the invention, there are no particular limitations with respect to the density dependency in the spectral sensitivity distribution, but it is preferable that the relation between a wavelength λrmax1.0, at which the maximum sensitivity of the spectral sensitivity distribution of the red-sensitive layer at D=1.0 is given, and a wavelength λrmax2.0, at which the maximum sensitivity of the spectral sensitivity distribution of the red-sensitive layer at D=2.0 is given, is 0 nm≦λrmax2.0−λrmax1.0≦60 nm, and more preferably is 10 nm≦λrmax2.0−λrmax1.0≦40 nm.

The method of evaluating the magnitude of the interimage effect in the invention followed the description in "Journal of the Optical Society of America", Vol. 42, pp. 663–669, written by W. T. Hanson Jr. et al, previously mentioned. Specifically, a continuous exposure was conducted for the layer that was to provide the interimage effect and a stepwise exposure was applied for the layer that was to receive the interimage effect. Thereafter, the processing described below was conducted and the measurement according to the document cited above was conducted. The change of the density in the layer that was to receive the interimage effect at an integrated density of 1.5 obtained when the integrated density in the layer that was to provide the interimage effect was reduced from 2.0 to 1.0, was used as a measure of the magnitude of the interimage effect.

(Processing for Evaluating the Interimage Effect)

| Processing Step | Time | Temperature | Tank volume | Replenishment rate |
|---|---|---|---|---|
| 1st development | 6 min | 38° C. | 37 L | 2,200 mL/m$^2$ |
| 1st washing | 2 min | 38° C. | 16 L | 4,000 mL/m$^2$ |
| Reversal | 2 min | 38° C. | 17 L | 1,100 mL/m$^2$ |
| Color development | 6 min | 38° C. | 30 L | 2,200 mL/m$^2$ |
| Pre-bleaching | 2 min | 38° C. | 19 L | 1,100 mL/m$^2$ |
| Bleaching | 6 min | 38° C. | 30 L | 220 mL/m$^2$ |
| Fixing | 4 min | 38° C. | 29 L | 1,100 mL/m$^2$ |
| 2nd washing | 4 min | 38° C. | 35 L | 4,000 mL/m$^2$ |
| Final rinsing | 1 min | 25° C. | 19 L | 1,100 mL/m$^2$ |

L = liter,
mL = milliliter

The compositions of the respective solution are as follows:

| <1st developer> | <Tank solution> | <Replenisher> |
|---|---|---|
| Nitrilo-N,N,N-trimethylene phosphonic acid · pentasodium salt | 1.5 g | 1.5 g |
| Diethylenetriamine pentaacetic acid · pentasodium salt | 2.0 g | 2.0 g |
| Sodium sulfite | 30 g | 30 g |
| Hydroquinone · potassium monosulfonate | 20 g | 20 g |
| Potassium carbonate | 15 g | 20 g |
| Sodium bicarbonate | 12 g | 15 g |
| 1-phenyl-4-methyl-4-hydroxymethyl-3-pyrazolidone | 2.5 g | 3.0 g |
| Potassium bromide | 2.5 g | 1.4 g |
| Potassium thiocyanate | 1.2 g | 1.2 g |
| Potassium iodide | 2.0 mg | — |
| Diethyleneglycol | 13 g | 15 g |
| Water to make | 1,000 mL | 1,000 mL |
| pH | 9.60 | 9.60 |

The pH was adjusted by sulfuric acid or potassium hydroxide.

| <Reversal solution> | <Tank solution> | <Replenisher> |
|---|---|---|
| Nitrilo-N,N,N-trimethylene phosphonic acid · pentasodium salt | 3.0 g | the same as tank solution |
| Stannous chloride · dihydrate | 1.0 g | |
| p-aminophenol | 0.1 g | |
| Sodium hydroxide | 8 g | |
| Glacial acetic acid | 15 mL | |
| Water to make | 1,000 mL | |
| pH | 6.00 | |

The pH was adjusted by acetic acid or sodium hydroxide.

| <Color developer> | <Tank solution> | <Replenisher> |
|---|---|---|
| Nitrilo-N,N,N-trimethylene phosphonic acid · pentasodium salt | 2.0 g | 2.0 g |
| Sodium sulfite | 7.0 g | 7.0 g |
| Trisodium phosphate · dodecahydrate | 36 g | 36 g |
| Potassium bromide | 1.0 g | — |
| Potassium iodide | 90 mg | — |
| Sodium hydroxide | 12.0 g | 12.0 g |
| Citrazinic acid | 0.5 g | 0.5 g |
| N-ethyl-N-(β-methanesulfon amidoethyl)-3-methyl-4 aminoaniline · ½ sulfuric acid · monohydrate | 10 g | 10 g |
| 3,6-dithiaoctane-1,8-diol | 1.0 g | 1.0 g |
| Water to make | 1,000 mL | 1,000 mL |
| pH | 11.80 | 12.00 |

The pH was adjusted by sulfuric acid or potassium hydroxide.

| <Pre-bleaching solution> | <Tank solution> | <Replenisher> |
|---|---|---|
| Ethylenediaminetetraacetic acid · disodium salt · dihydrate | 8.0 g | 8.0 g |
| Sodium sulfite | 6.0 g | 8.0 g |
| 1-thioglycerol | 0.4 g | 0.4 g |
| Formaldehyde sodium bisulfite adduct | 30 g | 35 g |
| Water to make | 1,000 mL | 1,000 mL |
| pH | 6.30 | 6.10 |

The pH was adjusted by acetic acid or sodium hydroxide.

| <Bleaching solution> | <Tank solution> | <Replenisher> |
|---|---|---|
| Ethylenediaminetetraacetic acid · disodium salt · dihydrate | 2.0 g | 4.0 g |
| Ethylenediaminetetraacetic acid · Fe(III) · ammonium · dihydrate | 120 g | 240 g |
| Potassium bromide | 100 g | 200 g |
| Ammonium nitrate | 10 g | 20 g |
| Water to make | 1,000 mL | 1,000 mL |
| pH | 5.70 | 5.50 |

The pH was adjusted by nitric acid or sodium hydroxide.

| <Fixing solution> | <Tank solution> | <Replenisher> |
|---|---|---|
| Ammonium thiosulfate | 80 g | the same as tank solution |
| Sodium sulfite | 5.0 g | |
| Sodium bisulfite | 5.0 g | |
| Water to make | 1,000 mL | |
| pH | 6.60 | |

The pH was adjusted by acetic acid or ammonia water.

| <Stabilizer> | <Tank solution> | <Replenisher> |
|---|---|---|
| 1,2-benzoisothiazoline-3-one | 0.02 g | 0.03 g |
| Polyoxyethylene-p-monononyl phenylether (average polymerization degree = 10) | 0.3 g | 0.3 g |
| Polymaleic acid (average molecular weight = 2,000) | 0.1 g | 0.15 g |
| Water to make | 1,000 mL | 1,000 mL |
| pH | 7.0 | 7.0 |

The photographic material of the invention preferably has at lest one interimage effect-donating layer that contains a lightsensitive emulsion and that does not substantially form a color image, i.e., that does not exhibit color by color developing processing. Although any lightsensitive emulsion can be used in the interimage effect-donating layer of the invention, the silver iodide content in the silver halide grains contained in the emulsion is preferably 6 mol % or more and 40 mol % or less, and more preferably 9 mol % or more and 20 mol % or less. There are no particular limitations with respect to the halogen composition other than silver iodide, but it is preferable that the silver chloride content is 2 mol % or less (including 0 mol %). Further, it is also preferable to use a lightsensitive emulsion and a non-lightsensitive emulsion together for the interimage effect-donating layer. The weight ratio of the non-lightsensitive emulsion and the lightsensitive emulsion used for the interimage effect-donating layer is preferably within the range of from 10:1 to 1:10. The non-lightsensitive emulsion may be added to the same layer to which the lightsensitive emulsion is added, or to the adjacent layers of the layer to which the lightsensitive emulsion is added. The location where the interimage effect-donating layer is arranged is not limited, but the donating layer is preferably formed next to or near a main lightsensitive layer. In such a situation, the silver iodide content in the silver halide grains contained in the non-lightsensitive layer is not limited, but is preferably 3 mol % or more. Silver iodide fine grains are preferably employed.

In the invention, the non-lightsensitive emulsion is an emulsion having substantially no photographic sensitivity. As used herein, the phrase "having substantially no photographic sensitivity" indicates an emulsion that does not form any latent image on the silver halide grains contained therein even if an exposure at 2,000,000 CMS or less is applied. Specific examples of such an emulsion include emulsions containing silver halide grains to which no chemical sensitization is performed and emulsions containing silver halide fine grains with an equivalent-sphere diameter of 0.1 $\mu$m or less.

There is no limitation with respect to the spectral sensitivity characteristics of the interimage effect-donating layer. The layer that provides the interlayer effect may be blue-sensitive, green-sensitive or red-sensitive. In view of the color reproduction, however, it is preferable to provide a lightsensitive emulsion layer spectrally sensitized in a cyan light region, and donating the interimage effect to the red-sensitive emulsion layer. It is also preferable to form a donating layer having an interimage effect whose spectral sensitivity distribution is different from that of a main lightsensitive layer such as BL, GL and RL, next to or near the main lightsensitive layer as described in U.S. Pat. Nos. 4,663,271, 4,705,744 and 4,707,436 and JP-A's-62-160448 and 63-89850, all the disclosures of which are incorporated herein by reference.

In the interimage effect-donating layer of the invention, lightsensitive emulsions differing in speed may be used in combination. The difference in speed between the lightsensitive emulsions is not limited, but it is preferable that there is a difference by 0.1 LogE or more and 1.0 LogE or less with respect to the midpoint speeds thereof. The number of the lightsensitive emulsions is not limited, but two or more and four or less emulsions are preferable. Further, it is also preferable that it is also preferable that two or more interimage effect-donating layers constitute a unit. In this case, the interimage effect-donating layers preferably differ in speed to each other, and it is preferable that there is a difference by 0.1 LogE or more and 1.0 LogE or less with respect to the midpoint speeds thereof. There is no limitation with respect to the number of the interimage effect-donating layers, but it is preferably from 2 to 4.

The compounds represented by the general formula (MC-I) will be explained in detail below.

In the formula, $R_1$ represents a hydrogen atom or substituent. The substituent represented by $R_1$ is preferably selected from a group consisting of an alkyl group (including a cycloalkyl and bicycloalkyl, hereinafter this applies to other groups including an alkyl group, such as an alkoxy group and alkylthio group), aralkyl group, aryl group, alkoxy group, aryloxy group, amino group, acylamino group, arylthio group, alkylthio group, ureido group, alkoxycarbonylamino group, carbamoyloxy group, and heterocyclic thio group. These groups represented by $R_1$ may further have a substituent.

More specifically, examples of the substituent represented by $R_1$ can be an alkyl group (e.g., isopropyl, t-butyl, t-amyl, adamantly, 1-methylcyclopropyl, n-octyl, cyclohexyl, 2-methanesulfonylethyl, 3-(3-pentadecylphenoxy)propyl, 3-{4-{2[-4-(4-hydroxyphenylsulfonyl)phenoxy] dodecanamide}phenyl}propyl, 2-ethoxytridecyl, trifluoromethyl, cyclopentyl, and 3-(2,4-di-t-amylphenoxy) propyl); aralkyl group (e.g., benzyl, 4-methoxybenzyl, and 2-methoxybenzyl); aryl group (e.g., phenyl, 4-t-butylphenyl, 2,4-di-t-amylphenyl, and 4-tetradecanamidophenyl); alkoxy group (e.g., methoxy, ethoxy, 2-methoxyethoxy, 2-dodecylethoxy, 2-methanesulfonylethoxy, and 2-phenoxyethoxy); aryloxy group (e.g., phenoxy, 2-methylphenoxy, 4-t-butylphenoxy, 3-nitrophenoxy, 3-t-butyloxycarbamoylphenoxy, and 3-methoxycarbamoylphenoxy); amino group (including an anilino group, e.g., methylamino, ethylamino, anilino, dimethylamino, diethylamino, t-butylamino, 2-methoxyanilino, 3-acetylaminoanilino, and cyclohexylamino); acylamino group (e.g., acetamide, benzamide, tetradecanamide, 2-(2,4-di-t-amylphenoxy) butanamide, 4-(3-t-butyl-4-hydroxyphenoxy)butanamide, and 2-{4-(4-hydroxyphenylsulfonyl)phenoxy}decanamide); aminocarbonylamino group (e.g., carbamoylamino, N,N-dimethylaminocarbonylamino, morpholinocarbonylamino, phenylaminocarbonylamino, methylaminocarbonylamino, and N,N-dibutylaminocarbonylamino); alkylthio group (e.g., methylthio, octylthio, tetradecylthio, 2-phenoxyethylthio, 3-phenoxypropylthio, and 3-(4-t-butylphenoxy)propylthio); arylthio group (e.g., phenylthio, 2-butoxy-5-t-octylphenylthio, 3-pentadecylphenylthio, 2-carboxyphenylthio and 4-tetradecanamidephenylthio); alkoxycarbonyamino group (e.g., methoxycarbonylamino, and tetradecyloxycarbonyamino); carbamoyloxy group (e.g., N-methylcarbamoyloxy, and N-phenylcarbamoyloxy); heterocyclic thio group (e.g., 2-benzothiazolyl thio, 2,4-diphenoxy-1,3,5-triazole-6-thio, and 2-pyridylthio).

Among the above-mentioned groups, alkyl, aryl, alkoxy, aryloxy, and amino groups are preferable. More preferably, secondary alkyl and tertiary alkyl groups each having a total of 3- to 15-carbon, and most preferably a 4- to 10-carbon tertiary alkyl group.

X represents a hydrogen atom or a split-off group capable of leaving upon a coupling reaction with an aromatic primary amine color developing agent in an oxidized form. Specifically, the split-off group includes a halogen atom, alkoxy group, aryloxy group, acyloxy group, alkylsulfonyloxy group, arylsulfonyloxy group, acylamino group, alkylsulfonylamide group, arylsulfonylamide group, alkoxycarbonyloxy group, aryloxycarbonyloxy group, alkylthio group, arylthio group, heterocyclic thio group, carbamoylamino group, carbamoyloxy group, 5- or 6-memebered nitrogen-containing heterocyclic group, imide group, and arylazo group. These groups may be further substituted with the substituents represented by $R_2$ which will be described later.

More specifically, examples of X are a halogen atom (e.g., a fluorine atom, chlorine atom, and bromine atom); alkoxy group (e.g., ethoxy, dodecyloxy, methoxyethylcarbamoylmethoxy, carboxypropyloxy, methylsulfonylethoxy, and ethoxycarbonylmethoxy); aryloxy group (e.g., 4-methylphenoxy, 4-chlorophenoxy, 4-methoxyphenoxy, 4-carboxyphenoxy, 4-methoxycarboxyphenoxy, 4-carbamoylphenoxy, 3-ethoxycarboxyphenoxy, 3-acetylaminophenoxy, and 2-carboxyphenoxy); acyloxy group (e.g., acetoxy, tetradecanoyloxy, and benzoyloxy); alkylsulfonyloxy or arylsulfonyloxy group (e.g., methanesulfonyloxy and toluenesulfonyloxy); acylamino group (e.g., dichloroacetylamino and heptafluorobutylylamino), alkylsulfonamide or arylsulfonamide group (e.g., methanesulfonamino, trifluoromethanesulfonamino, and p-toluenesulfonylamino); alkoxycarbonyloxy group (e.g., ethoxycarbonyloxy and benzyloxycarbonyloxy); aryloxycarbonyloxy group (e.g., phenoxycarbonyloxy); alkylthio, arylthio, or heterocyclic thio group (e.g., dodecylthio, 1-carboxydodecylthio, phenylthio, 2-butoxy-5-t-octylphenylthio, and tetrazolylthio); carbamoylamino group (e.g., N-methylcarbamoylamino and N-phenylcarbamoylamino); carbamoyloxy group (e.g., N,N-dimethylcarbamoyloxy, N-phenylcarbamoyloxy, morpholinylcarbamoyloxy, and pyrrolidinylcarbamoyloxy); 5- or 6-membered nitrogen-containing heterocyclic group (e.g., imidazolyl, pyrazolyl, triazolyl, tetrazolyl, and 1,2-dihydro-2-oxo-1-pyridyl); imide group (e.g., succinimide and hydantoinyl); and arylazo group (e.g., phenylazo and 4-methoxyphenylazo). X can also take the form of a bis coupler obtained by condensing a 4-equivalent coupler by aldehydes or ketones, as a split-off group bonded via a carbon atom.

X is preferably a hydrogen atom, halogen atom, alkoxy group, aryloxy group, alkylthio or arylthio group, or 5- or 6-membered nitrogen-containing heterocyclic group that is bonded to the coupling active position via the nitrogen atom, and particularly preferably, a hydrogen atom, chlorine atom, or phenoxy group that may be substituted.

One of $G_1$ and $G_2$ is a nitrogen atom, and the other is a carbon atom. $R_2$ in the formula (MC-I) is bonded to one of $G_1$ and $G_2$ which is a carbon atom.

$R_2$ represents a substituent. Examples are a halogen atom, alkyl group, aryl group, heterocyclic group, cyano group, hydroxyl group, nitro group, carboxyl group, amino group, alkoxy group, aryloxy group, acylamino group, alkylamino group, anilino group, ureido group, sulfamoylamino group, alkylthio group, arylthio group, alkoxycarbonylamino group, sulfonamide group, carbamoyl group, sulfamoyl group, sulfonyl group, alkoxycarbonyl group, heterocyclic oxy group, azo group, acyloxy group, carbamoyloxy group, silyloxy group, aryloxycarbonylamino group, imide group, heterocyclic thio group, sulfinyl group, phosphonyl group, aryloxycarbonyl group, acyl group, and azolyl group. These substituents may have a substituent.

More specifically, examples of a substituent represented by $R_2$ are a halogen atom (e.g., a chlorine atom and bromine atom); alkyl group (e.g., a 1- to 32-carbon, straight-chain or branched-chain alkyl group and cycloalkyl group; more specifically, methyl, ethyl, propyl, isopropyl, t-butyl, tridecyl, 2-methanesulfonylethyl, 3-(3-pentadecylphenoxy) propyl, 3-{4-{2-[4-(4-hydroxyphenylsulfonyl)phenoxy] dodecanamid o}phenyl}propyl, 2-ethoxytridecyl, trifluoromethyl, cyclopentyl, and 3-(2,4-di-t-amylphenoxy) propyl); aryl group (e.g., phenyl, 4-t-butylphenyl, 2,4-di-t-amylphenyl, and 4-tetradecanamidophenyl); heterocyclic group (e.g., 2-furyl, 2-thienyl, 2-pyrimidinyl, and 2-benzothiazolyl); cyano group; hydroxyl group; nitro group; carboxyl group; amino group; alkoxy group (e.g., methoxy, ethoxy, 2-methoxyethoxy, 2-dodecylethoxy, and 2-methanesulfonylethoxy); aryloxy group (e.g., phenoxy, 2-methylphenoxy, 4-t-butylphenoxy, 3-nitrophenoxy, 3-t-butyloxycarbamoylphenoxy, and 3-methoxycarbamoylphenoxy); acylamino group (e.g., acetamide, benzamide, tetradecanamide, 2-(2,4-di-t-amylphenoxy)butanamide, 4-(3-t-butyl-4-hydroxyphenoxy) butanamide, 2-{4-(4-hydroxyphenylsulfonyl) phenoxy}decanamide); alkylamino group (e.g., methylamino, butylamino, dodecylamino, diethylamino, and methylbutylamino); anilino group (e.g., phenylamino, 2-chloroanilino, 2-chloro-5-tetradecanaminoanilino, 2-chloro-5-dodecyloxycarbonylanilino, N-acetylanilino, and 2-chloro-5-{α-(3-t-butyl-4-hydroxyphenoxy) dodecanamido}anilino); ureido group (e.g., phenylureido, methylureido, and N,N-dibutylureido); sulfamoylamino group (e.g., N,N-dipropylsulfamoylamino and N-methyl-N-decylsulfamoylamino); alkylthio group (e.g., methylthio, octylthio, tetradecylthio, 2-phenoxyethylthio, 3-phenoxypropylthio, and 3-(4-t-butylphenoxy)propylthio); arylthio group (e.g., phenylthio, 2-butoxy-5-t-octylphenylthio, 3-pentadecylphenylthio, 2-carboxyphenylthio, and 4-tetradecanamidophenylthio); alkoxycarbonylamino group (e.g., methoxycarbonylamino and tetradecyloxycarbonylamino); sulfonamide group (e.g., methanesulfonamide, hexadecanesulfonamide, benzenesulfonamide, p-toluenesulfonamide, octadecanesulfonamide, and 2-methyloxy-5-t-butylbenzenesulfonamide); carbamoyl group (e.g., N-ethylcarbamoyl, N,N-dibutylcarbamoyl, N-(2-dodecyloxyethyl)carbamoyl, N-methyl-N-dodecylcarbamoyl, and N-(3-(2,4-di-t-amylphenoxy) propyl)carbamoyl); sulfamoyl group (e.g., N-ethylsulfamoyl, N,N-dipropylsulfamoyl, N-(2-dodecyloxyethyl)sulfamoyl, N-ethyl-N-dodecylsulfamoyl, and N,N-diethylsulfamoyl); sulfonyl group (e.g., methanesulfonyl, octanesulfonyl, benzenesulfonyl, and toluenesulfonyl); alkoxycarbonyl group (e.g., methoxycarbonyl, butyloxycarbonyl, dodecyloxycarbonyl, and octadecyloxycarbonyl); heterocyclic oxy group (e.g., 1-phenyltetrazole-5-oxy and 2-tetrahydropyranyloxy); azo group (e.g., phenylazo, 4-methoxphenylazo, 4-pyvaloylaminophenylazo, and 2-hydroxy-4-propanoylphenylazo); acyloxy group (e.g., acetoxy); carbamoyloxy group (e.g., N-methylcarbamoyloxy and N-phenylcarbamoyloxy); silyloxy group (e.g., trimethylsilyloxy and dibutylmethylsilyloxy); aryloxycarbonylamino group (e.g., phenoxycarbonylamino); imide group (e.g., N-succinimide, N-phthalimide, and 3-octadecenylsuccinimide); heterocyclic thio group (e.g., 2-benzothiazolylthio, 2,4-di-phenoxy-1,3,5-trizole-6-thio, and 2-pyridylthio); sulfinyl group (e.g., dodecanesulfinyl, 3-pentadecylphenylsulfinyl, and 3-phenoxypropylsulfinyl); phosphonyl group (e.g., phenoxyphosphonyl, octyloxyphosphonyl, and phenylphosphonyl); aryloxycarbonyl group (e.g., phenoxycarbonyl); acyl group (e.g., acetyl, 3-phenylpropanoyl, benzoyl, and 4-dodecyloxybenzoyl); and azolyl group (e.g., imidazolyl, pyrazolyl, 3-chloro-pyrazole-1-yl, and triazole).

In a case where a group represented by $R_2$ can further have a substituent, such further substituent may be an organic substituent that is bonded to $R_2$ with the carbon atom, oxygen atom, nitrogen atom, or sulfur atom thereof, or a halogen atom.

Preferable examples of $R_2$ are an alkyl group, aryl group, alkoxy group, aryloxy group, alkylthio group, ureido group, alkoxycarbonylamino group, and acylamino group. More preferably, $R_2$ is a total of 6- to 70-carbon group having a 6- to 70-carbon alkyl group or aryl group as a partial structure, and gives immobility to a coupler represented by the formula (MC-I). Herein, "a group having an alkyl group as a partial structure" includes a case in which such a group itself is an alkyl group and a case in which such a group is a group to which an alky group is bonded directly or via a divalent group. The same can be applied to "a group having an aryl group as a partial structure."

The couplers represented by the formula (MC-I) are more preferably those where $R_2$ is a group represented by the general formula (BL-1) or (BL-2) below:

(BL-1)

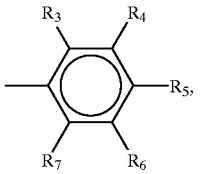

(BL-2)

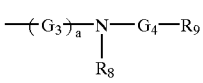

In the formula (BL-1), each of $R_3$, $R_4$, $R_5$, $R_6$, and $R_7$ independently represents a hydrogen atom or substituent, and at least one of them represents a total of 4- to 70-carbon substituent having a substituted or unsubstituted alkyl group as a partial structure, i.e., a substituted or unsubstituted alkyl group or a group to which a substituted or unsubstituted alkyl group is boned directly or via a divalent group, or a total of 6- to 70-carbon substituent having a substituted or unsubstituted aryl group as a partial structure, i.e., a substituted or unsubstituted aryl group or a group to which a substituted or unsubstituted aryl group is boned directly or via a divalent group.

A group represented by the formula (BL-1) will be described below. Each of $R_3$, $R_4$, $R_5$, $R_6$, and $R_7$ independently represents a hydrogen atom or substituent. Examples of this substituent are those mentioned above for $R_2$. At least one of $R_3$, $R_4$, $R_5$, $R_6$, and $R_7$ is a total of 4- to 70-carbon substituent having a substituted or unsubstituted alkyl group as a partial structure, i.e., a substituted or unsubstituted alkyl group or a group to which a substituted or unsubstituted alkyl group is boned directly or via a divalent group, or a total of 6- to 70-carbon substituent having a substituted or unsubstituted aryl group as a partial structure, i.e., a substituted or unsubstituted aryl group or a group to which a substituted or unsubstituted aryl group is boned directly or via a divalent group. Preferable examples are a total of 4 or more carbon (when an aryl group is contained a total of 6 or more carbon), substituted or unsubstituted alkyl group or aryl group; or a total of 4 or more carbon (when an aryl group is contained a total of 6 or more carbon) alkoxy group, aryloxy group, acylamino group, ureido group, carbamoyl group, alkoxycarbonylamino group, sulfonyl group, sulfonamide group, sulfamoyl group, sulfamoylamino group, alkoxycarbonyl group, alkyl group, and aryl group each having the substituted or unsubstituted alkyl or aryl group as a partial structure. Of these substituents, a 4- to 70-carbon alkyl group and a total of 4- to 70-carbon alkoxy group, acylamino group, and sulfonamide group each having an alkyl group as a partial structure are preferred.

In particular, $R_3$ or both of $R_4$ and $R_6$ are preferably a total of 4 or more carbon (when an aryl group is contained a total of 6 or more carbon) substituent having a substituted or unsubstituted alkyl group or aryl group as an partial structure, i.e., a substituted or unsubstituted alkyl group, a substituent to which the alkyl group is bonded directly or via a divalent group, a substituted or unsubstituted aryl group, or a substituent to which the aryl group is bonded directly or via a divalent group.

In the formula (BL-2), $G_3$ represents a substituted or unsubstituted methylene group, a represents an integer from 1 to 3, $R_8$ represents a hydrogen atom, alkyl group, or aryl group, $G_4$ represents —CO— or —$SO_2$—, and $R_9$ represents a total of 6- to 70-carbon substituent having a substituted or unsubstituted alkyl or aryl group as a partial structure, i.e., a substituted or unsubstituted alkyl group, a substituent to which the alkyl group is bonded directly or via a divalent group, a substituted or unsubstituted aryl group, or a substituent to which the aryl group is bonded directly or via a divalent group. If $R_9$ has a substituent, examples of this substituent are those mentioned above for $R_2$. If a is 2 or more, a plurality of $G_3$'s may be the same or different. Preferably, a group represented by $(G_3)_a$ is —$CH_2$—, —$C_2H_4$—, —$C(CH_3)H$—$CH_2$—, —$C(CH_3)_2$—$CH_2$—, —$C(CH_3)_2$—$C(CH_3)H$—, —$C(CH_3)H$—$C(CH_3)H$—, —$C(CH_3)_2$—$C(CH_3)_2$—, —$C(CH_3)H$—, or —$C(CH_3)_2$—; $R_8$ is a hydrogen atom; $G_4$ is —CO— or —$SO_2$—; and $R_9$ is a total of 10- to 70-carbon substituted or unsubstituted alkyl or aryl group.

Among the compounds represented by the formula (MC-I), when $G_1$ is a nitrogen atom, $G_2$ is a carbon atom, and X is a hydrogen atom, it is preferable that $R_1$ be a tertiary alkyl group, $R_2$ be a group represented by the formula (BL-1), and each of $R_4$ and $R_6$ be a group selected from an acylamino group, sulfonamide group, ureido group, alkoxycarbonylamino group, sulfonyl group, carbamoyl group, sulfamoyl group, sulfamoylamino group, and alkoxycarbonyl group, each of which is substituted by a total of 4 or more substituted or unsubstituted alkyl group or by a 6 or more carbon substituted or unsubstituted aryl group.

In a compound represented by formula (MC-I), when $G_1$ is a carbon atom, $G_2$ is a nitrogen atom, and X is a hydrogen atom, it is preferable that $R_1$ be a tertiary alkyl group, and $R_2$ be a group represented by the formula (Bl-1) or (BL-2), and particularly preferably, $R_2$ be a group represented by the formula (BL-2).

In a compound represented by formula (MC-I), when $G_1$ is a nitrogen atom, $G_2$ is a carbon atom, and X is not a hydrogen atom but a split-off group, it is favorable that $R_1$ be a tertiary alkyl group, $R_2$ be a group represented by formula (BL-1), $R_3$ be a group selected from an acylamino group, sulfonamide group, ureido group, alkoxycarbonylamino group, sulfonyl group, carbamoyl group, sulfamoyl group, sulfamoylamino group, and alkoxycarbonyl group, each of which is substituted by a total of 4 or more carbon substituted or unsubstituted alkyl group or by a 6 or more carbon substituted or unsubstituted aryl group, and X is a chlorine atom.

In a compound represented by formula (MC-I), when $G_1$ is a carbon atom, $G_2$ is a nitrogen atom, and X is not a hydrogen atom, but a substituent, it is preferable that $R_1$ be a tertiary alkyl group, and $R_2$ is preferably a group represented by the formula (Bl-1) or (BL-2), and particularly preferably, a group represented by the formula (BL-2).

In the invention, it is desirable that $G_1$ be a carbon atom, $G_2$ be a nitrogen atom, $R_1$ be a tertiary alkyl group, and $R_2$ be represented by the formula (BL-2) in which $G_4$ is —$SO_2$—, $R_9$ is a 6- to 50 carbon phenyl group having at least one substituent having an alkyl group as a partial structure, i.e., a phenyl group having at least one alkyl group as its substituent or a phenyl group having at least one substituent to which an alkyl group is bonded directly or via a divalent group, and a is 1 or 2, and it is particularly preferabl that X be a hydrogen atom, chlorine atom, or substituted phenyloxy group.

The coupler represented by the formula (MC-I) may form a dimer or higher polymer, via at least one of $R_1$ and $R_2$.

Further, the coupler represented by the formula (MC-I) may be bonded to a polymer chain via $R_1$ or $R_2$. Although the molecular weight of the polymer chain is not particularly limited, it is preferably about 8,000 to about 100,000. The number of the coupler unit that is bonded to the polymer chain is not particularly limited, but preferably, the molecular weight of the polymer chain per molecular of the coupler is 500 to 1,000.

Practical compound examples of formula (MC-I) will be presented below. However, the invention is not limited to these examples.

MC-1

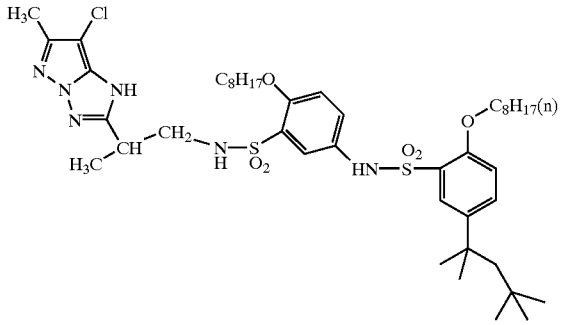

MC-2

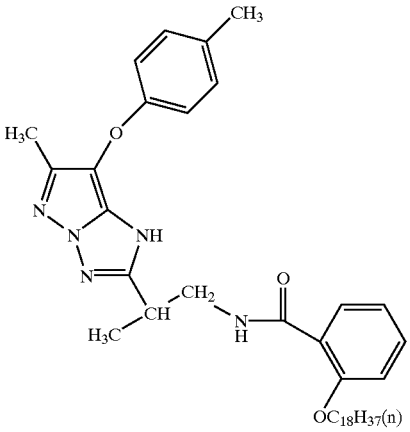

MC-5

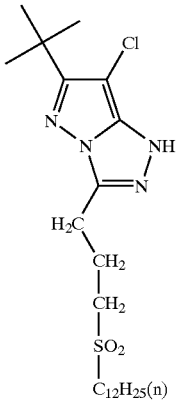

-continued

MC-3

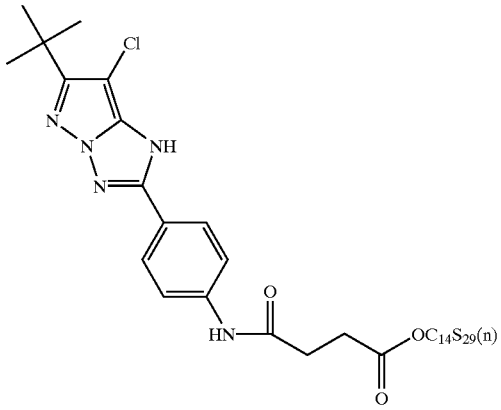

MC-4

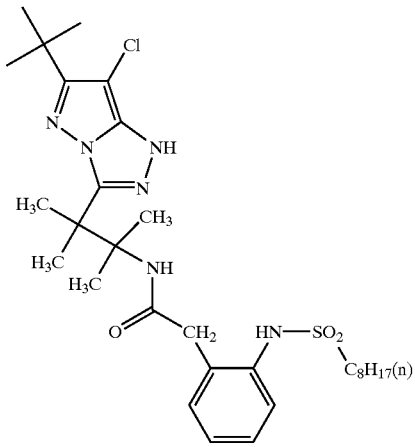

MC-6

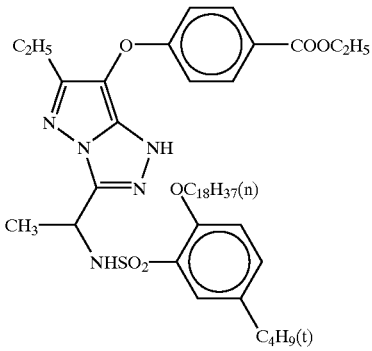

MC-7

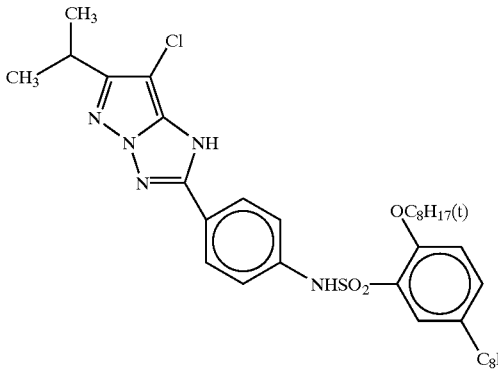

-continued
MC-8
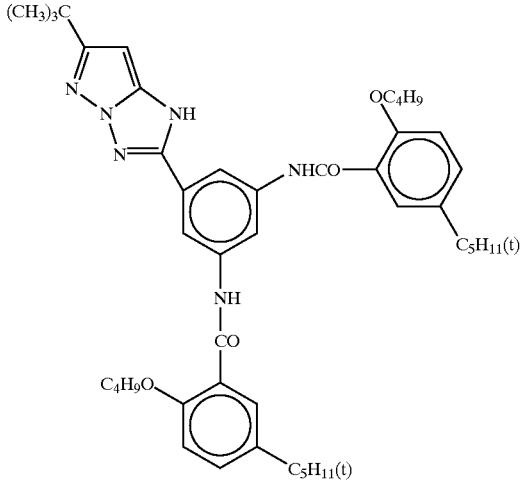
MC-9
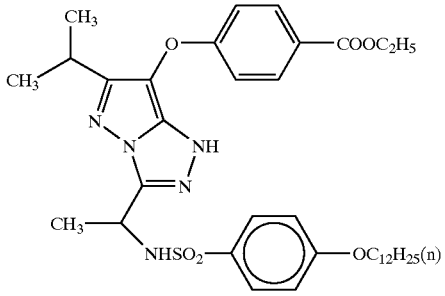
MC-10
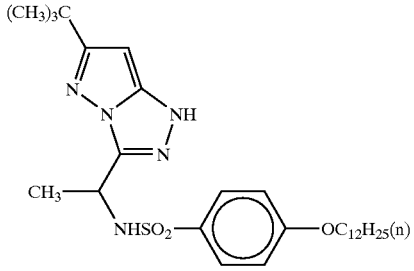
MC-11
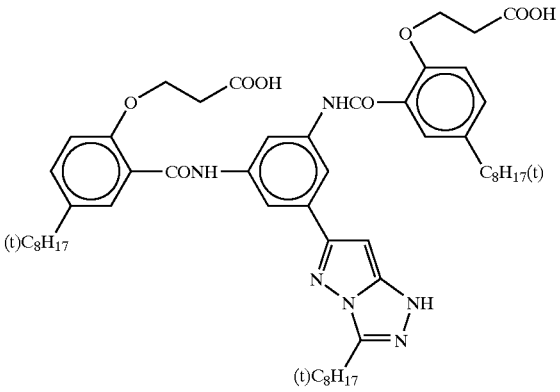
-continued
MC-12
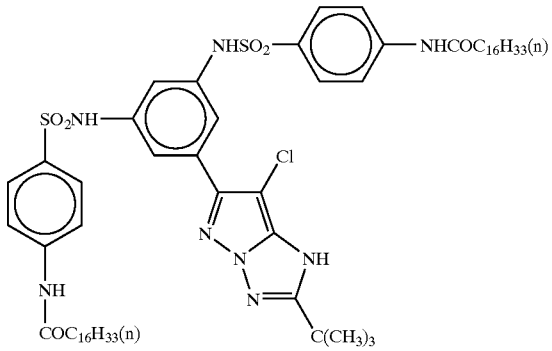
MC-13
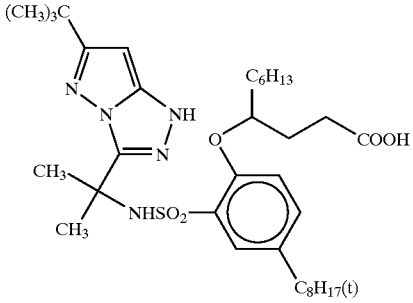
MC-14
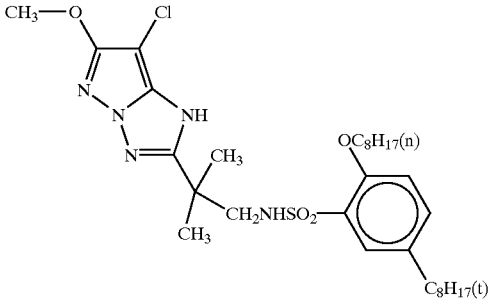
MC-15
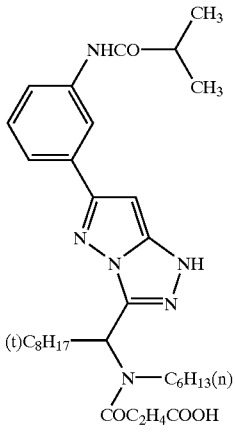

-continued
MC-16
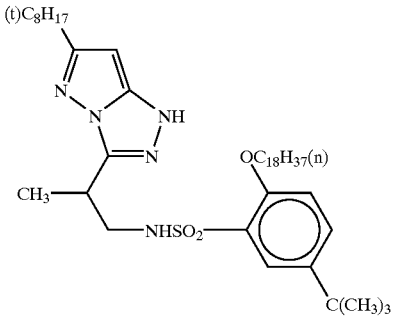
MC-17
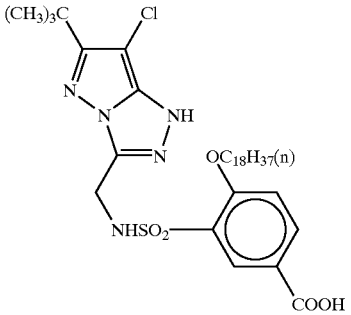
MC18
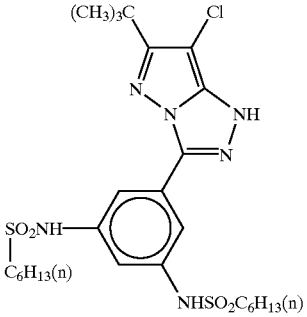
MC-19
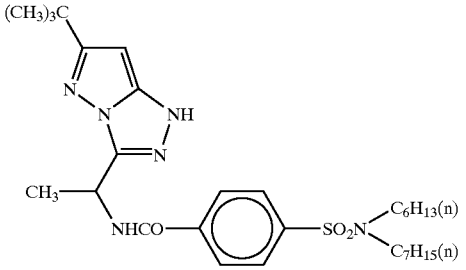
-continued
MC-20
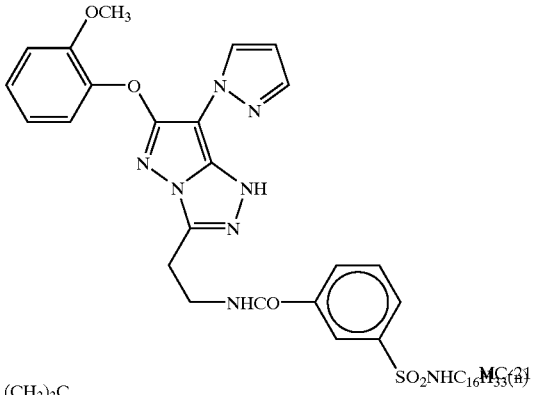
MC-21
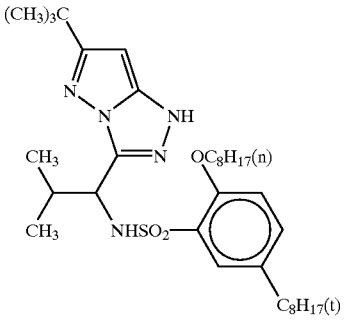
MC-22
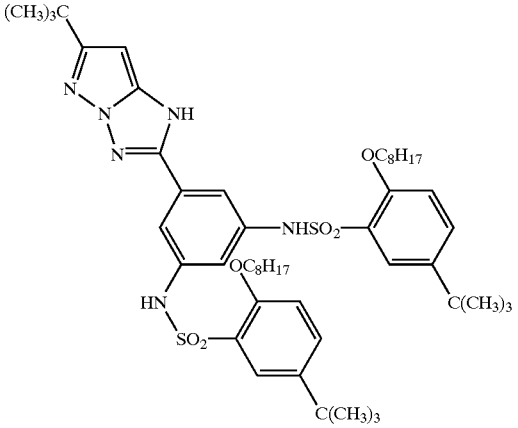
MC-23
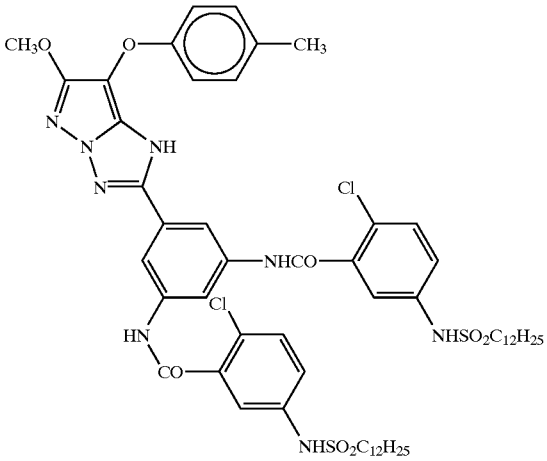

-continued
MC-24
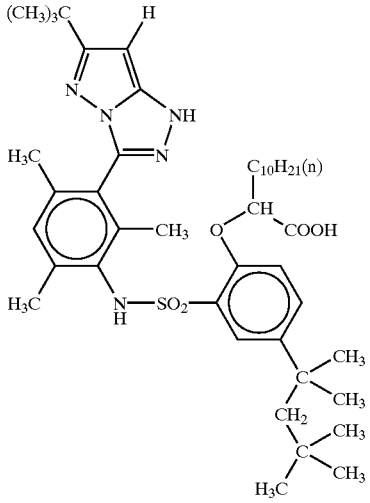
MC-25
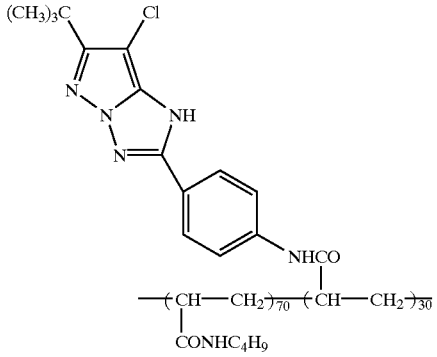
MC-26
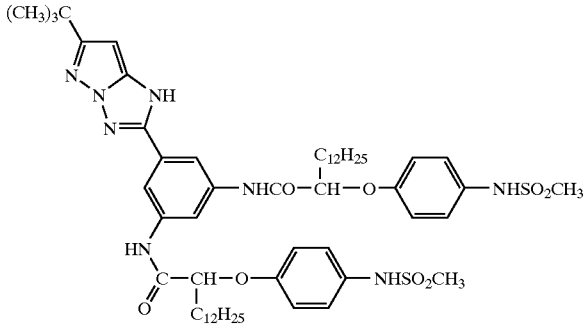
MC-27
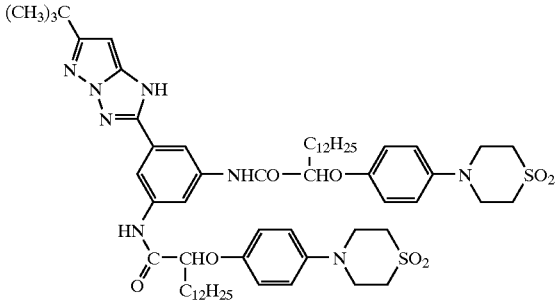
-continued
MC-28
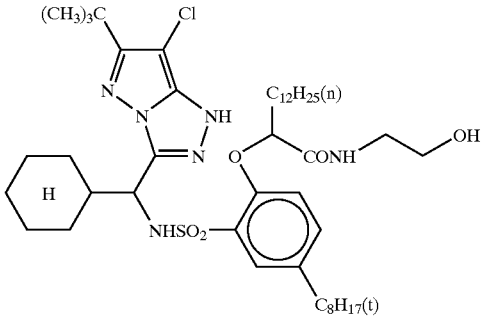
MC-29
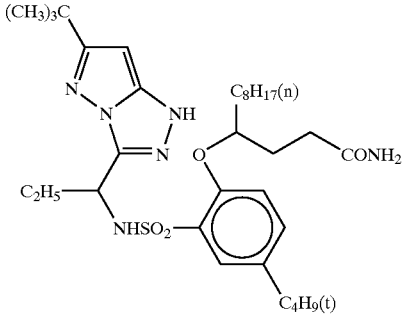
MC-30
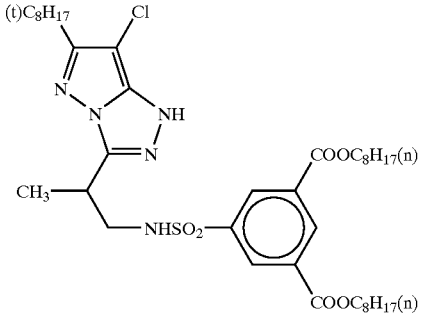
MC-31
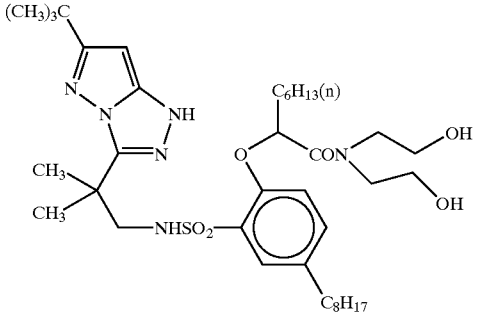
MC-32
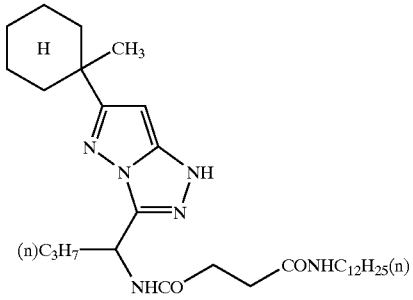

-continued
MC-33
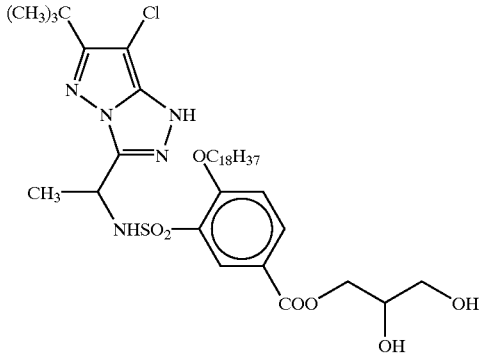
MC-34
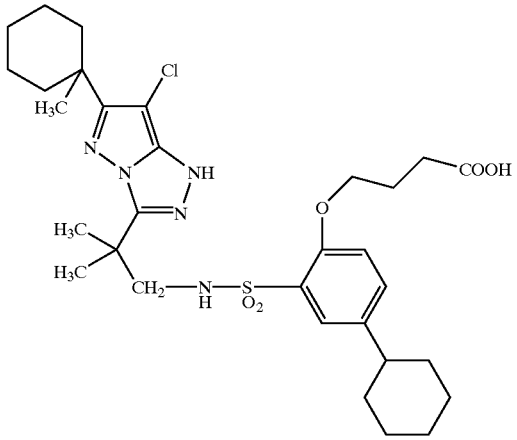
MC-35
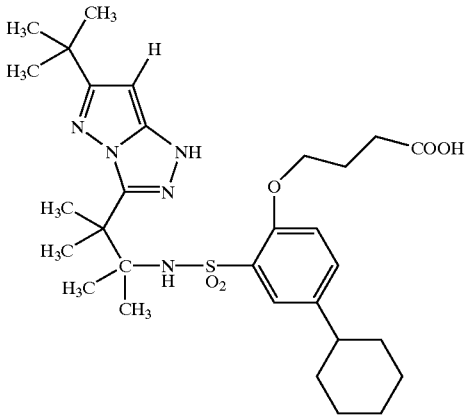
-continued
MC-36
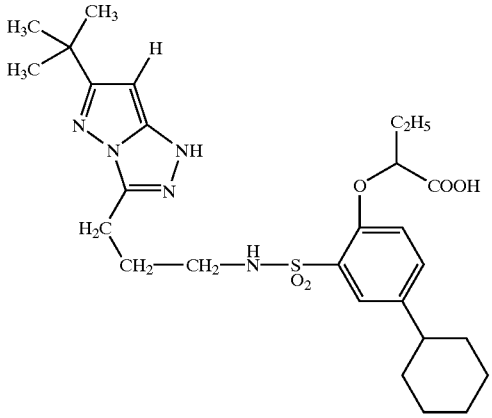
MC-37
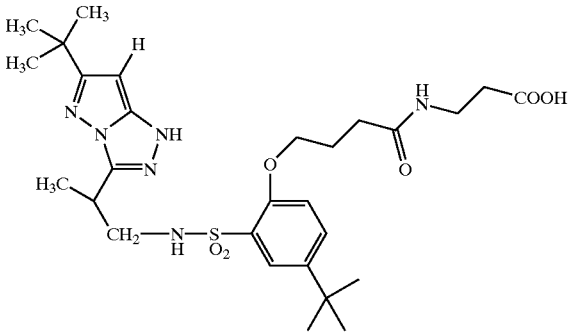
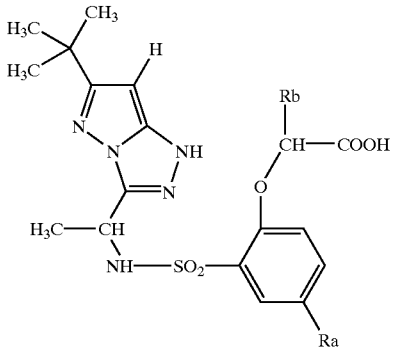
| Compound No. | Ra | Rb* |
|---|---|---|
| MC-38 | 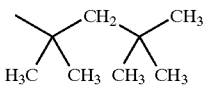 | $—C_{10}H_{21}$ |
| MC-39 | 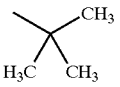 | $—C_8H_{17}$ |

-continued
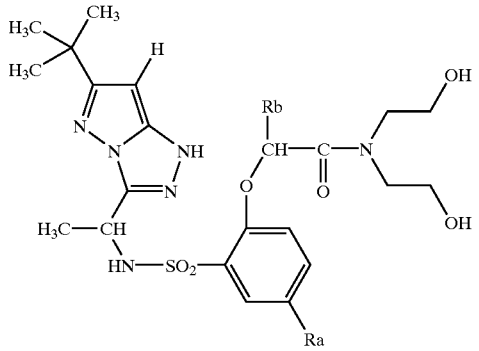
| Compound No. | Ra | Rb |
|---|---|---|
| MC-40 | 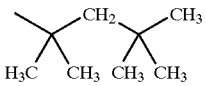 | $—C_8H_{17}$ |
| MC-41 | 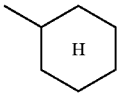 | $—C_8H_{17}$ |
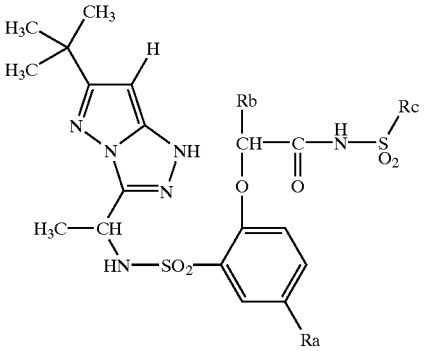
| Compound No. | Ra | Rb | Rc |
|---|---|---|---|
| MC-42 | 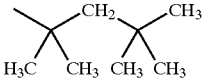 | $—C_{10}H_{21}$ | $—CH_3$ |
| MC-43 | 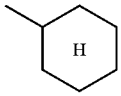 | $—C_8H_{17}$ | $—CH_3$ |
| MC-44 | 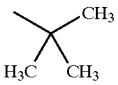 | $—C_{10}H_{21}$ | 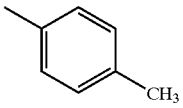 |

-continued
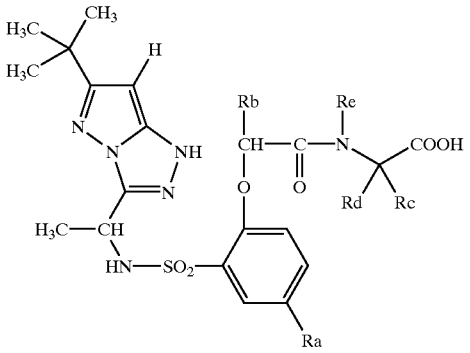
| Compound No. | Ra | Rb | Rc | Rd | Re |
|---|---|---|---|---|---|
| MC-45 | 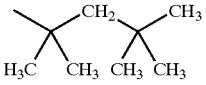 | $-C_{12}H_{25}$ | $-CH_3$ | —H | —H |
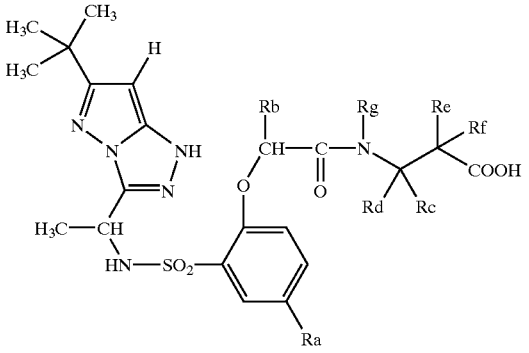
| Compound No. | Ra | Rb | Rc | Rd | Re | Rf | Rg |
|---|---|---|---|---|---|---|---|
| MC-46 | 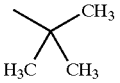 | $-C_{10}H_{21}$ | —H | —H | —H | —H | —H |
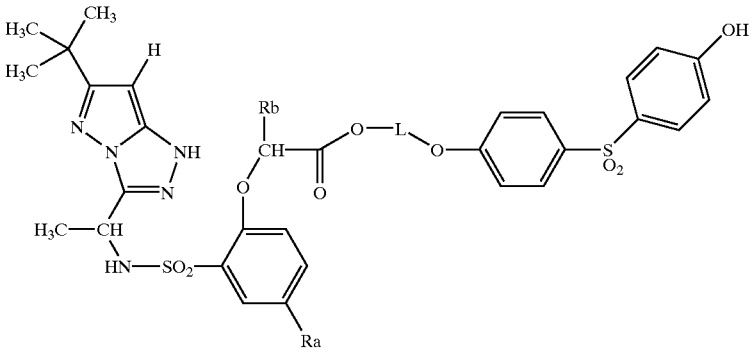
| Compoud No. | Ra | Rb | L |
|---|---|---|---|
| MC-47 | 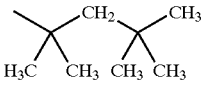 | $-C_{10}H_{21}$ | 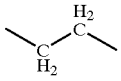 |
*The groups are normal alkyl groups, except otherwise indicated.

A coupler represented by formula (MC-I) of the invention can be synthesized by known methods. Examples are described in U.S. Pat. Nos. 4,540,654, 4,705,863, and 5,451,501, JP-A's-61-65245, 62-209457, 62-249155, and 63-41851, JP-B's-7-122744, 5-105682, 7-13309, and 7-82252, U.S. Pat. Nos. 3,725,067 and 4,777,121, JP-A's-2-201442, 2-101077, 3-125143, and 4-242249.

A coupler represented by formula (CC-I) will be described below.

In formula (CC-I), $G_a$ represents —C($R_{13}$)═ or —N═. When $G_a$ represents —N═, $G_b$ represents —C($R_{13}$)═. When $G_a$ represents —C($R_{13}$)═, $G_b$ represents —N═.

Each of $R_{11}$ and $R_{12}$ represents an electron-withdrawing group having a Hammett substituent constant σp value of 0.20 to 1.0. The sum of the σp values of $R_{11}$ and $R_{12}$ is desirably 0.65 or more. The coupler of the invention is given superior performance as a cyan coupler by introducing this strong electron-withdrawing group. The sum of the σp values of $R_{11}$ and $R_{12}$ is preferably 0.70 or more, and its upper limit is about 1.8.

In the invention, each of $R_{11}$ and $R_{12}$ is an electron-withdrawing group with a Hammett substituent constant σp value (to be simply referred to as a σp value hereinafter) of 0.20 to 1.0, preferably an electron-withdrawing group having a σp value of 0.30 to 0.8. The Hammett's rule is an empirical rule proposed by L. P. Hammett in 1935 in order to quantitatively argue the effects of substituents on reaction or equilibrium of benzene derivatives. The rule is widely regarded as appropriate in these days. The substituent constants obtained by the Hammett rule include a σp value and a σm value, and these values are described in a large number of general literature. For example, the values are described in detail in J. A. Dean ed., "Lange's Hand Book of Chemistry," the 12th edition, 1979 (McGraw-Hill), "The Extra Number of The Domain of Chemistry," Vol. 122, pages 96 to 103, 1979 (Nanko Do) and Chemical Reviews, vol. 91, pp.165–195 (1991), the disclosure of which is incorporated herein by reference. In the invention, each of $R_{11}$ and $R_{12}$ is defined by the Hammett substituent constant σp value. However, this does not mean that $R_{11}$ and $R_{12}$ are limited to substituents having the already known values described in these literature. That is, the invention includes, of course, substituents having values that fall within the above range when measured on the basis of the Hammett's rule even if they are unknown in literature.

Practical examples of $R_{11}$ and $R_{12}$, as the electron-withdrawing group with a up value of 0.20 to 1.0, are an acyl group, acyloxy group, carbamoyl group, aliphatic oxycarbonyl group, aryloxycarbonyl group, cyano group, nitro group, dialkylphosphono group, diarylphosphono group, diarylphosphinyl group, alkylsulfinyl group, arylsulfinyl group, alkylsulfonyl group, arylsulfonyl group, sulfonyloxy group, acylthio group, sulfamoyl group, thiocyanate group, thiocarbonyl group, alkyl group substituted by at least two halogen atoms, alkoxy group substituted by at least two halogen atoms, aryloxy group substituted by at least two halogen atoms, alkylamino group substituted by at least two halogen atoms, alkylthio group substituted by at least two halogen atoms, aryl group substituted by another electron-withdrawing group with a σp value of 0.20 or more, heterocyclic group, chlorine atom, bromine atom azo group, and selenocyanate group. Of these substituents, those capable of further having substituents can further have substitutes to be mentioned later for $R_{13}$.

The aliphatic portion of an aliphatic oxycarbonyl group can be straight-chain, branched-chain, or cyclic and can be saturated or can contain an unsaturated bond. This aliphatic oxycarbonyl group includes, e.g., alkoxycarbonyl, cycloalkoxycarbonyl, alkenyloxycarbonyl, alkinyloxycarbonyl, and cycloalkenyloxycarbonyl.

The σp values of representative electron-withdrawing groups having a σp value of 0.2 to 1.0 are a bromine atom (0.23), chlorine atom (0.23), cyano group (0.66), nitro group (0.78), trifluoromethyl group (0.54), tribromomethyl group (0.29), trichloromethyl group (0.33), carboxyl group (0.45), acetyl group (0.50), benzoyl group (0.43), acetyloxy group (0.31), trifluoromethanesulfonyl group (0.92), methanesulfonyl group (0.72), benzenesulfonyl group (0.70), methanesulfinyl group (0.49), carbamoyl group (0.36), methoxycarbonyl group (0.45), ethoxycarbonyl group (0.45), phenoxycarbonyl group (0.44), pyrazolyl group (0.37), methanesulfonyloxy group (0.36), dimethoxyphosphoryl group (0.60), and sulfamoyl group (0.57). Each of the numbers in parenthesis is σp value.

$R_{11}$ preferably represents a cyano group, aliphatic oxycarbonyl group (a 2- to 36-carbon, straight-chain or branched-chain alkoxycarbonyl group, aralkyloxycarbonyl group, alkenyloxycarbonyl group, alkinyloxycarbonyl group, cycloalkoxycarbonyl group, or cycloalkenyloxycarbonyl group, e.g., methoxycarbonyl, ethoxycarbonyl, dodecyloxycarbonyl, octadecyloxycarbonyl, 2-ethylhexyloxycarbonyl, sec-butyloxycarbonyl, oleyloxycarbonyl, benzyloxycarbonyl, propargyloxycarbonyl, cyclopentyloxycarbonyl, cyclohexyloxycarbonyl, or 2,6-di-t-butyl-4-methylcylohexyloxycarbonyl); dialkylphosphono group (a 2- to 36-carbon dialkylphosphono group, e.g., diethylphosphono or dimethylphosphono); alkylsulfonyl or arylsulfonyl group (a 1- to 36-carbon alkylsulfonyl or 6- to 36-carbon arylsulfonyl group, e.g., a methanesulfonyl group, butanesulfonyl group, benzenesulfonyl group, or p-toluenesulfonyl group); or fluorinated alkyl group (a 1- to 36-carbon fluorinated alkyl group, e.g., trifluoromethyl). $R_{11}$ is particularly preferably a cyano group, aliphatic oxycarbonyl group, or fluorinated alkyl group, and most preferably, a cyano group.

$R_{12}$ preferably represents an aliphatic oxycarbonyl group as mentioned above for $R_{11}$; carbamoyl group (a 1- to 36-carbon carbamoyl group, e.g., diphenylcarbamoyl or dioctylcarbamoyl); sulfamoyl group (a 1- to 36-carbon sulfamoyl, e.g., dimethylsulfamoyl or dibutylsulfamoyl); dialkylphosphono group mentioned above for $R_{11}$; diarylphosphono group (a 12- to 50-carbon diarylphosphono group, e.g., diphenylphosphono or di(p-tolyl)phosphono). $R_{12}$ is particularly preferably a group represented by the following formula (1).

(1)

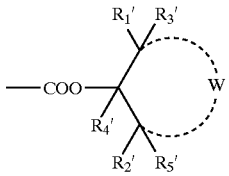

wherein each of $R_1'$ and $R_2'$ represents an aliphatic group, e.g., a 1- to 36-carbon, straight-chain or branched-chain alkyl group, aralkyl group, alkenyl group, alkinyl group, cycloalkyl group, or cycloalkenyl group, and more specifically, methyl, ethyl, propyl, isopropyl, t-butyl, t-amyl, t-octyl, tridecyl, cyclopentyl, cyclohexyl, vinyl or ethynyl. Each of $R_3'$, $R_4'$, and $R_5'$ represents a hydrogen atom or aliphatic group. Examples of the aliphatic group are those mentioned above for $R_1'$ and $R_2'$. Each of $R_3'$, $R_4'$, and $R_5'$ is preferably a hydrogen atom.

W represents a non-metallic atomic group required to form a 5- to 8-membered ring. This ring may be substituted, may be a saturated ring, or can have an unsaturated bond. A non-metallic atom is preferably a nitrogen atom, oxygen atom, sulfur atom, or carbon atom, and more preferably, a carbon atom.

Examples of a ring formed by W are a cyclopentane ring, cyclohexane ring, cycloheptane ring, cyclooctane ring, cyclohexene ring, piperazine ring, oxane ring, and thiane ring. These rings can be substituted by a substituents represented by $R_{13}$ to be described below.

A ring formed by W is preferably a cyclohexane ring which may be substituted, and most preferably, a cyclohexane ring whose 4-position is substituted by a 1- to 36-carbon alkyl group (which may be substituted by a substituent represented by $R_{13}$ to be described below).

$R_{13}$ represents a substituent. Examples are those mentioned above for $R_1$ in formula (MC-I). $R_{13}$ is preferably an alkoxy group, acylamino group, aliphatic group, or aryl group. These groups may be substituted by the substituents mentioned for $R_{13}$.

Y represents a hydrogen atom or a group that is capable of splitting off when the coupler reacts with an aromatic primary amine color developing agent in an oxidized form. When Y represents a split-off group, examples are those mentioned above in the explanation of X in formula (MC-I).

Y is preferably a hydrogen atom, halogen atom, aryloxy group, heterocyclic acyloxy group, dialkylphosphonooxy group, arylcarbonyloxy group, arylsulfonyloxy group, alkoxycarbonyloxy group, or carbamoyloxy group. Also, the split-off group or a compound released from the split-off group preferably has a property of further reacting with an aromatic primary amine color developing agent in an oxidized form. For example, the split-off group is a non-color-forming coupler, hydroquinone derivative, aminophenol derivative, sulfonamidophenol derivative.

Practical examples of a coupler represented by formula (CC-I) will be presented below. However, the invention is not restricted to these examples.

(CC-1)

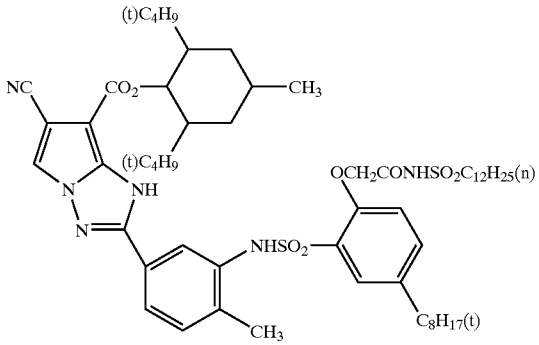

(CC-2)

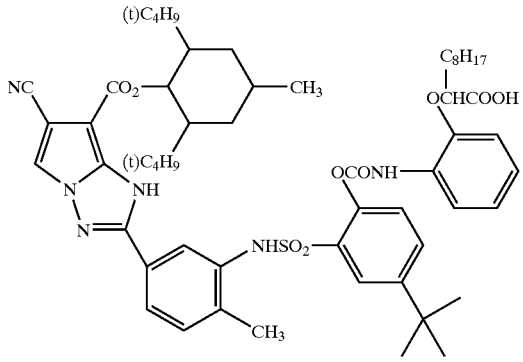

(CC-3)

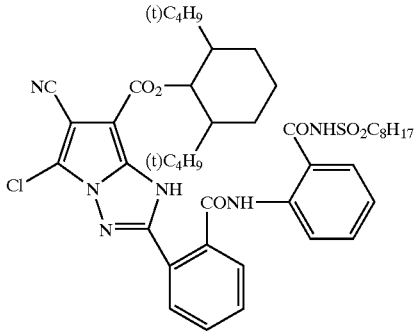

(CC-4)

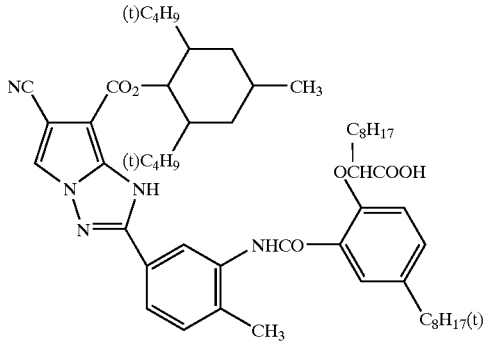

(CC-5)

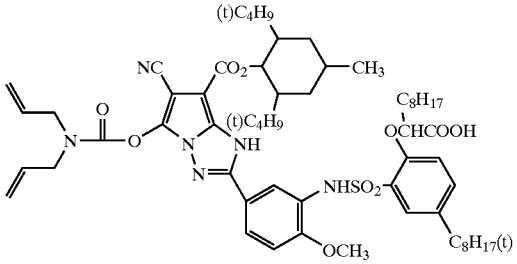

(CC-6)

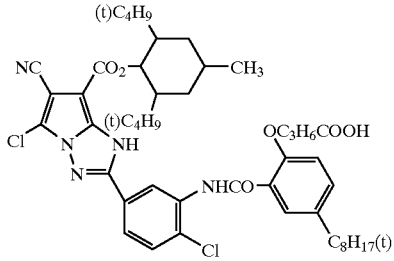

-continued
(CC-7)
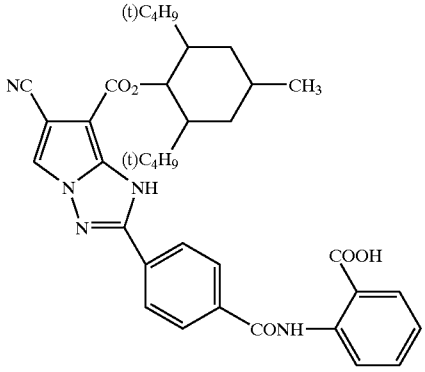
(CC-8)
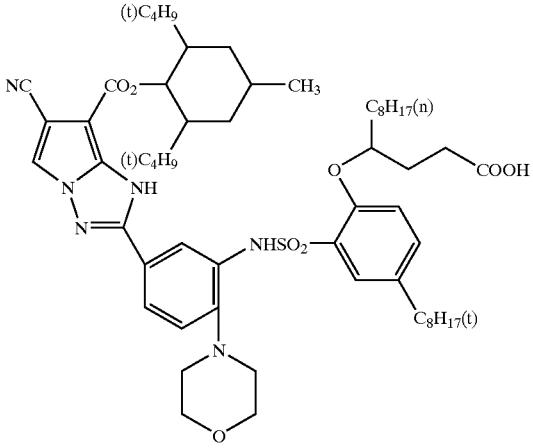
(CC-9)
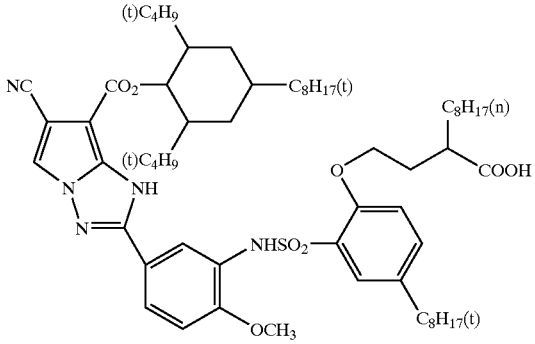
(CC-10)
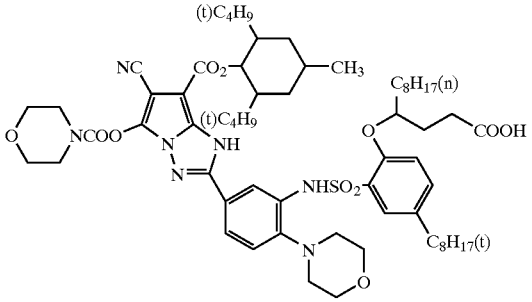
(CC-11)
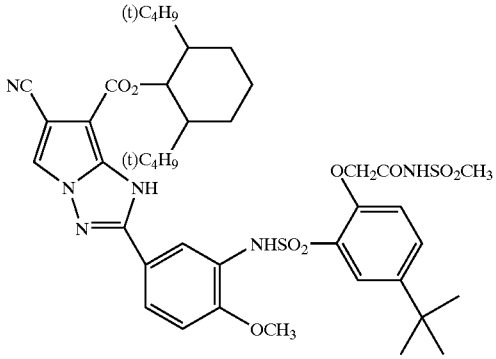
(CC-12)
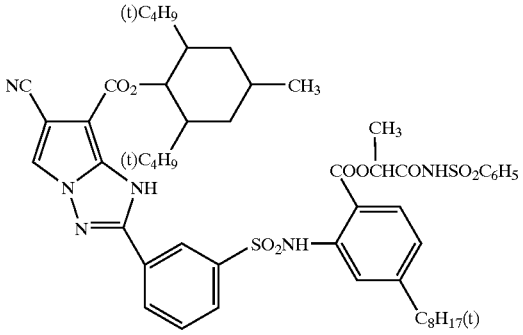
(CC-13)
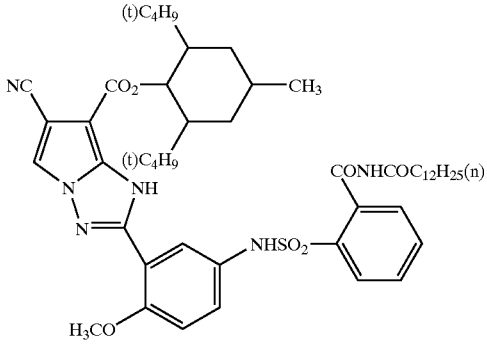
(CC-14)
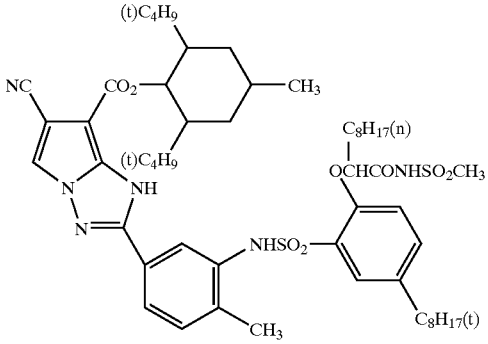

-continued
(CC-15)
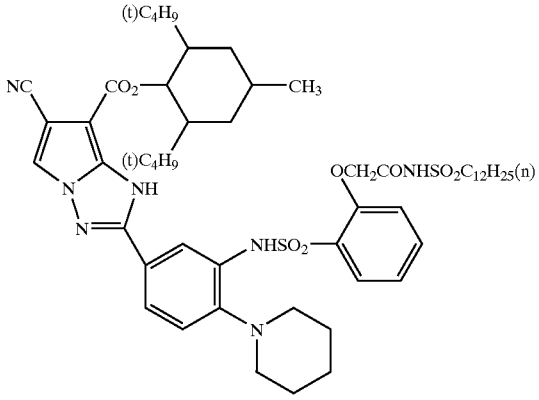
(CC-16)
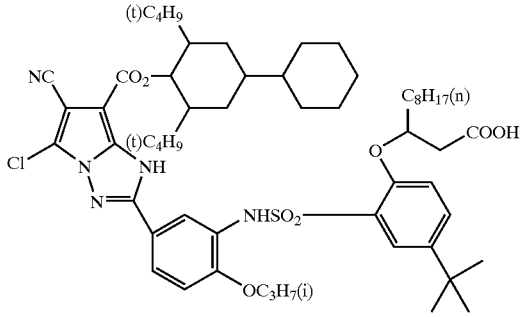
(CC-17)
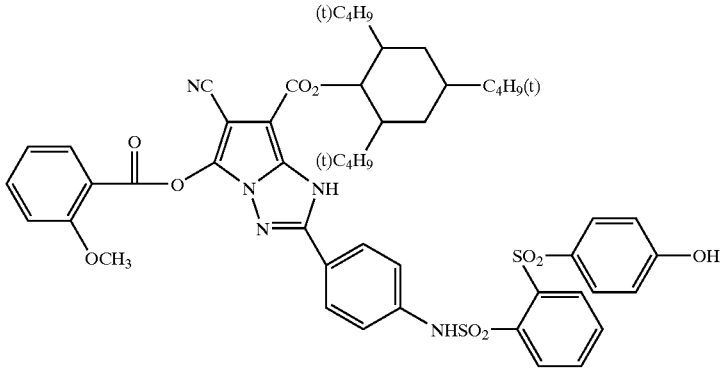
(CC-18)
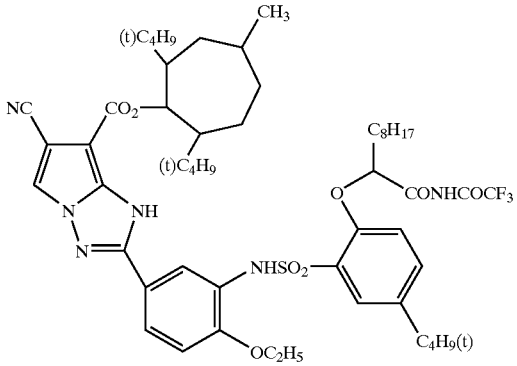
(CC19)
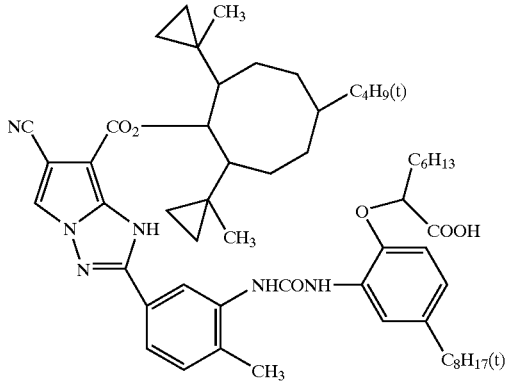
(CC-20)
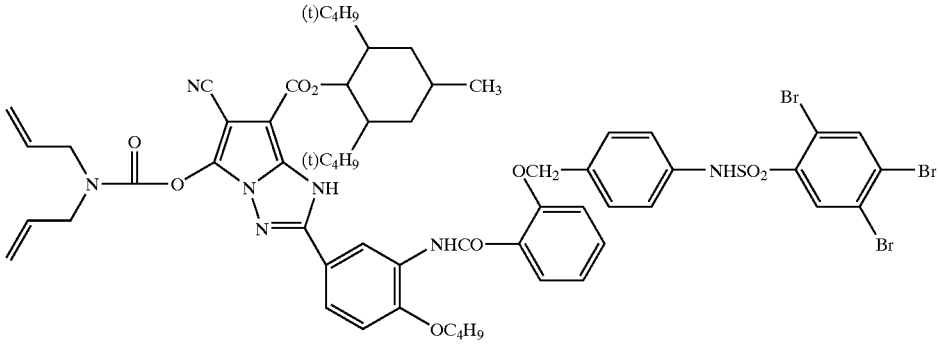

-continued
(CC-21)
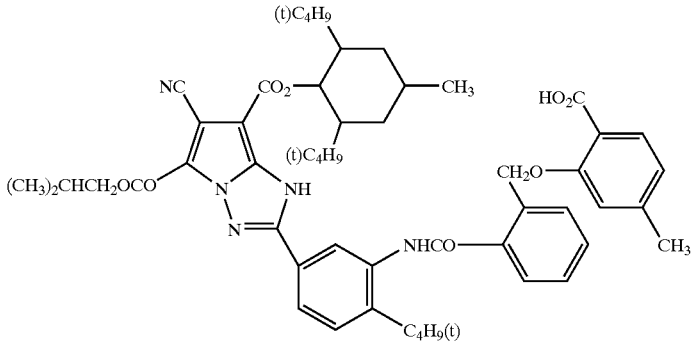
(CC-22)
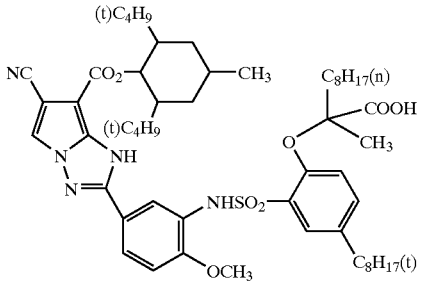
(CC-23)
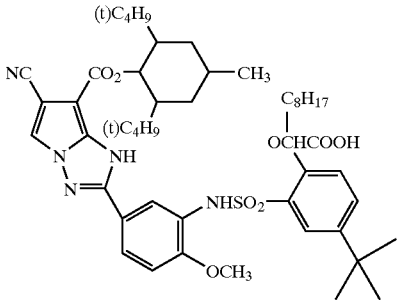
(CC-24)
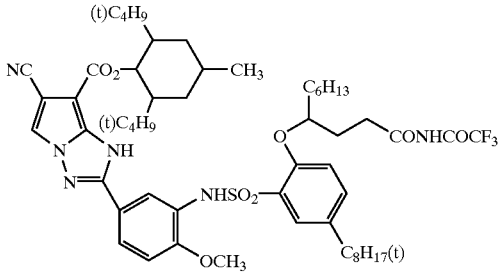
(CC-25)
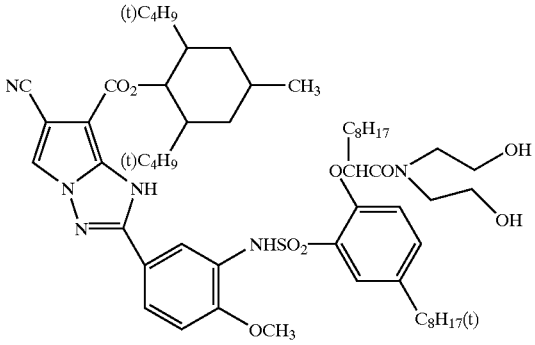
(CC-26)
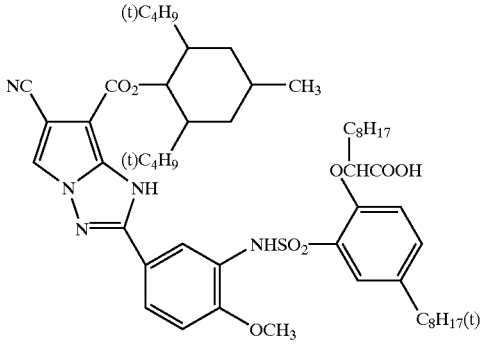
(CC-27)
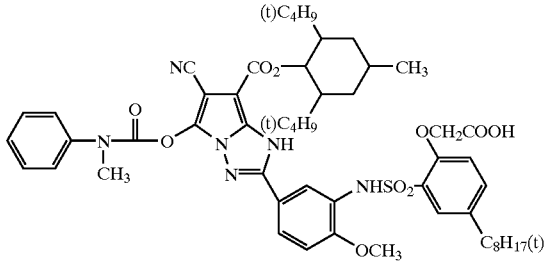

-continued
(CC-28)
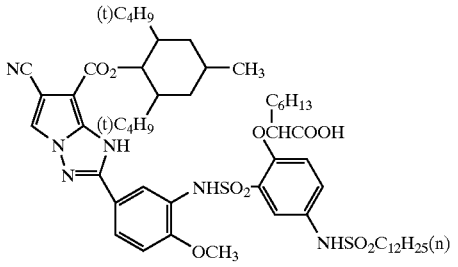
(CC-29)
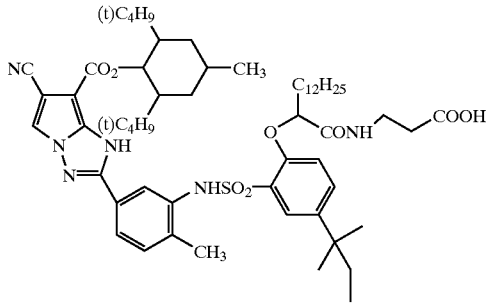
(CC-30)
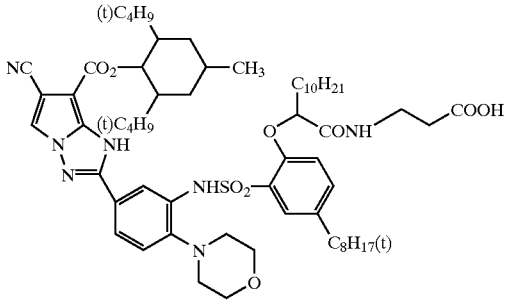
(CC-31)
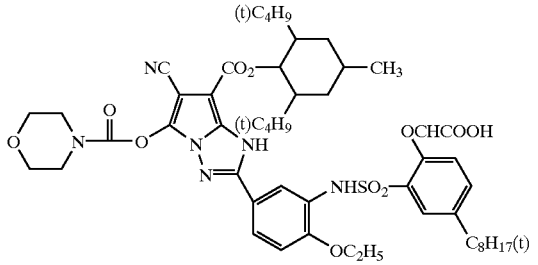
(CC-32)
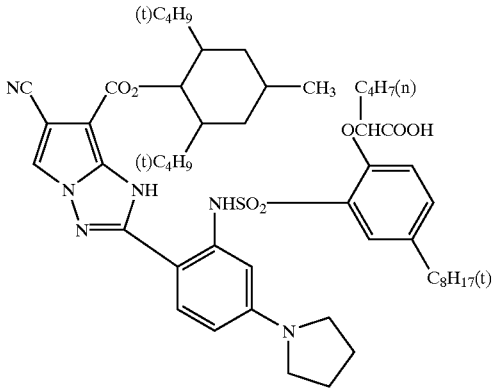
(CC-33)
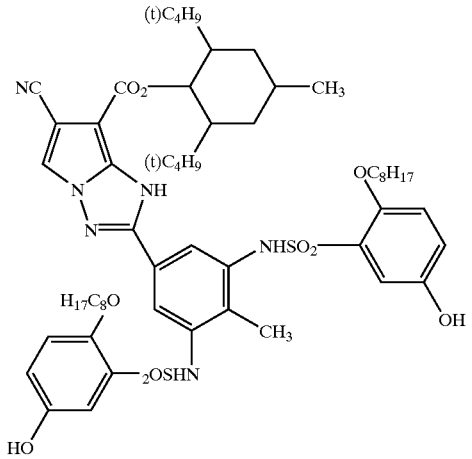
(CC-34)
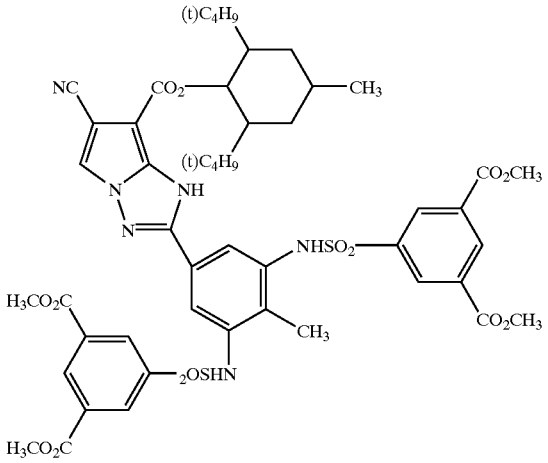
(CC-35)
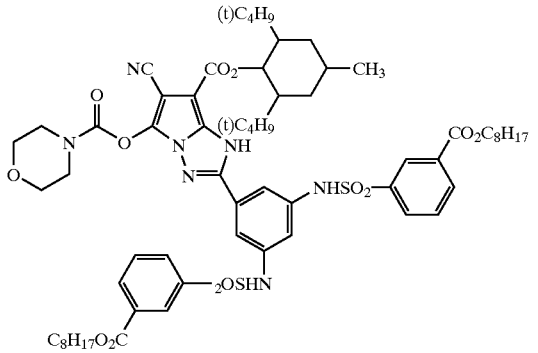

-continued
(CC-36)
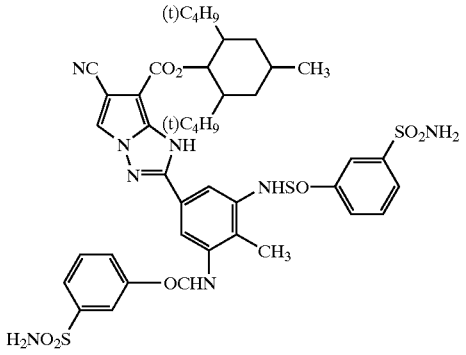
(CC-37)
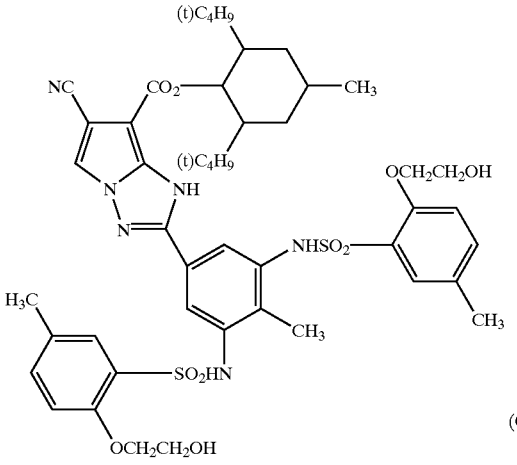
(CC-38)
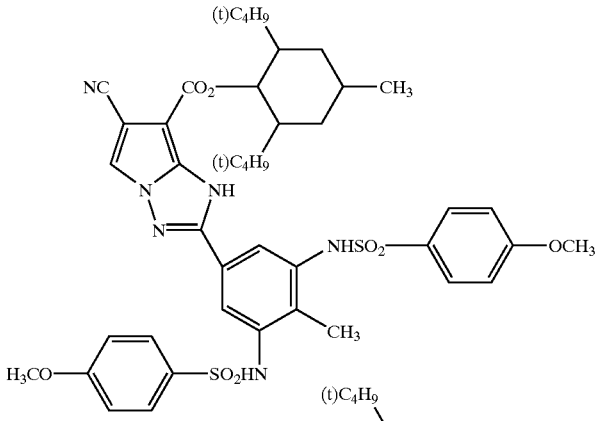
(CC-39)
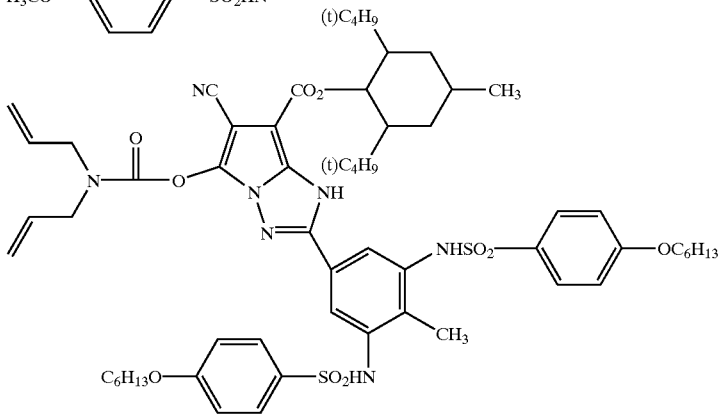
(CC-40)
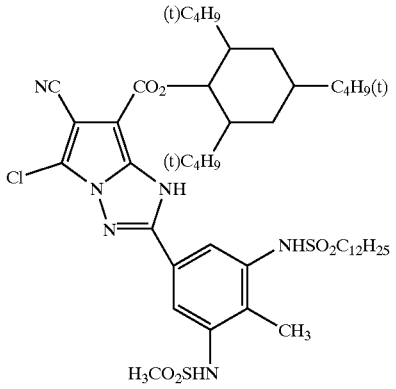
(CC-41)
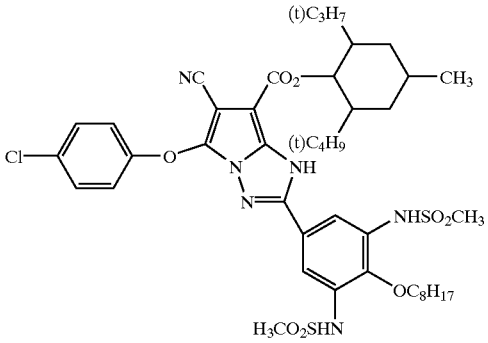

-continued
(CC-42)
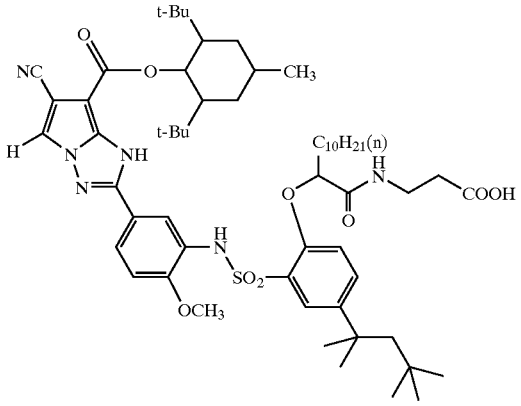
(CC-43)
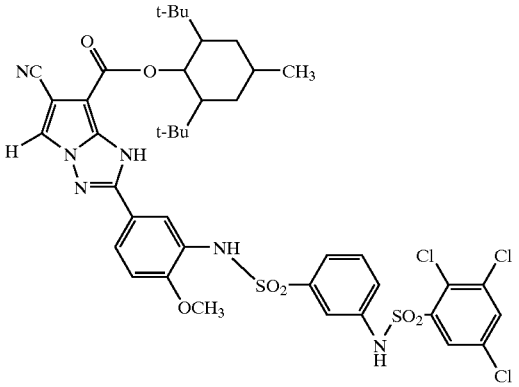
(CC-44)
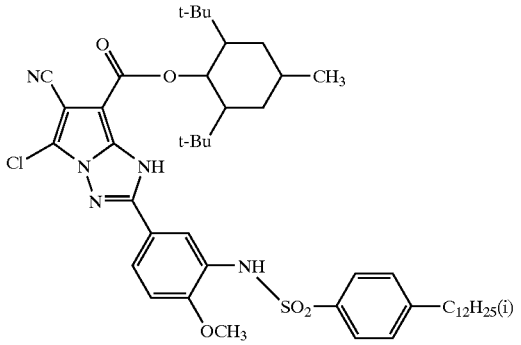
(CC-45)
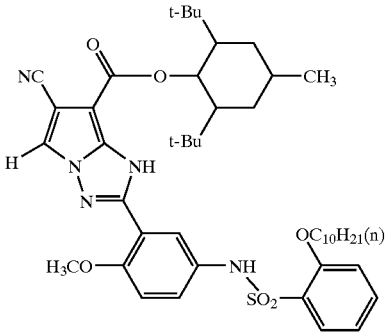
(CC-46)
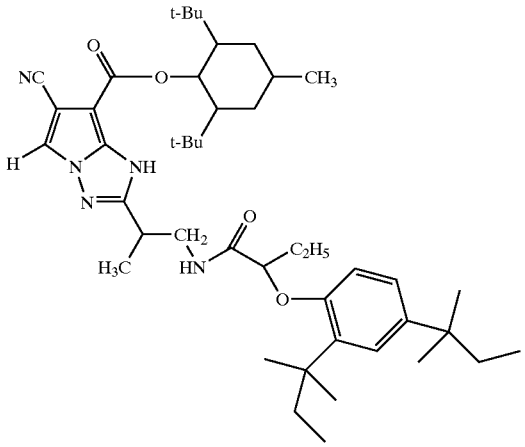
(CC-47)
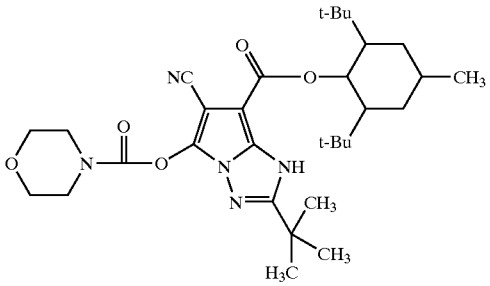

-continued (CC-48)

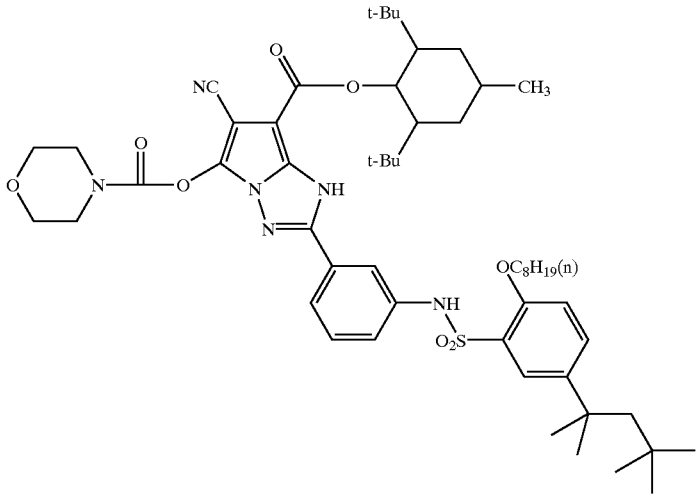

(CC-49)

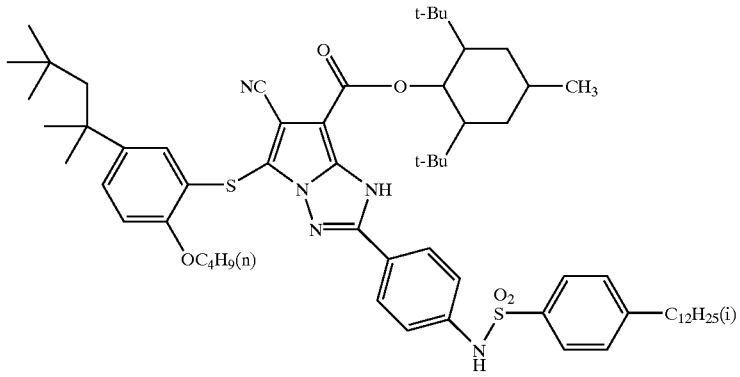

(CC-50)

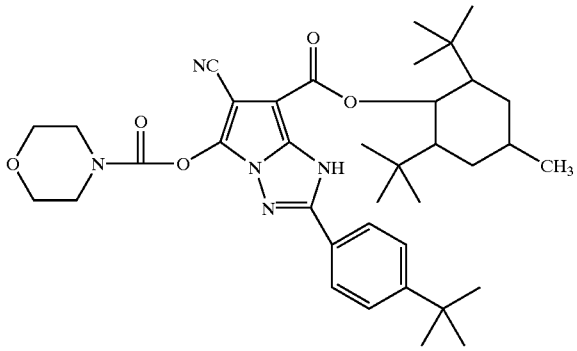

The compound represented by formula (CC-I) of the invention can be synthesized by known methods, e.g., methods described in J.C.S., 1961, page 518, J.C.S., 1962, page 5,149, Angew. Chem., Vol. 72, page 956 (1960), and Berichte, Vol. 97, page 3,436 (1964), and literature or similar methods cited in these literature.

Couplers represented by the formula (MC-I) and the formula (CC-I) of the invention can be introduced to a photosensitive material by various known dispersion methods. Of these methods, an oil-in-water dispersion method is preferable in which a coupler is dissolved in a high-boiling organic solvent (used in combination with a low-boiling solvent if necessary), the solution is dispersed by emulsification in an aqueous gelatin solution, and the dispersion is added to a silver halide emulsion.

Examples of the high-boiling solvent used in this oil-in-water dispersion method are described in, e.g., U.S. Pat. No. 2,322,027. Practical examples of steps, effects, and impregnating latexes of a latex dispersion method as one polymer dispersion method are described in, e.g., U.S. Pat. No. 4,199,363, West German Patent Application (OLS) Nos. 2,541,274 and 2,541,230, JP-B-53-41091, and EP029104, the disclosures of which are herein incorporated by reference. Dispersion using an organic solvent-soluble polymer is described in PCT International Publication WO88/00723, the disclosure of which is herein incorporated by reference.

Examples of the high-boiling solvent usable in the above-mentioned oil-in-water dispersion method are phthalic acid esters (e.g., dibutylphthalate, dioctylphthalate, dicyclohexylphthalate, di(2-ethylhexyl)phthalate, decylphthalate, bis(2,4-di-tert-amylphenyl)isophthalate, and bis(1,1-diethylpropyl)phthalate), esters of phosphoric acid and phosphonic acid (e.g., diphenylphosphate, triphenylphosphate, tricresylphosphate, 2-ethylhexyldiphenylphosphate, dioctylbutylphosphate, tricyclohexylphosphate, tri-2-ethylhexylphosphate, tridodecylphosphate, and di(2-ethylhexylphenylphosphate), benzoic acid esters (e.g., 2-ethylhexylbenzoate, 2,4-dichlorobenzoate, dodecylbenzoate, and 2-ethylhexyl-p-hydroxybenzoate), amides (e.g., N,N-diethyldodecaneamide, and N,N-diethyllaurylamide), alcohols and phenols (e.g., isostearylalcohol and 2,4-di-tert-amylphenol), aliphatic esters (e.g., dibutoxyethyl succinate, bis(2-ethylhexyl) succinate, 2-hexyldecyl tetradecanoate, tributyl citrate, diethyl azelate, isostearyl lactate, and trioctyl tosylate), aniline derivatives (e.g., N,N-dibutyl-2-butoxy-5-tert-octylaniline), chlorinated paraffins (paraffins containing 10% to 80% of chlorine), trimesic acid esters (e.g., tributyl trimesate), dodecylbenzene, diisopropylnaphthalene, phenols (e.g., 2,4-di-tert-amylphenol, 4-dodecyloxyphenol, 4-dodecyloxycarbonylphenol, and 4-(4-dodecyloxyphenylsulfonyl)phenol), carboxylic acids (e.g., 2-(2,4-di-tert-amylphenoxy butyric acid and 2-ethoxyoctanedecanoic acid), alkylphosphoric acids (e.g., di-(2-ethylhexyl)phosphoric acid and diphenylphosphoric acid). In addition to the above high-boiling solvents, compounds described in, e.g., JP-A-6-258803.

Of these high-boiling organic solvents, phosphates are preferable, and use of phosphates in combination with alcohols or phenols are also preferable.

The weight ratio of a high-boiling organic solvent to a coupler of the invention, is preferably 0 to 2.0, more preferably, 0 to 1.0, and most preferably, 0 to 0.5.

As a co-solvent, it is also possible to use an organic solvent (e.g., ethyl acetate, butyl acetate, ethyl propionate, methylethylketone, cyclohexanone, 2-ethoxyethylacetate, and dimethylformamide) having a boiling point of 30° C. to about 160° C.

The content in a lightsensitive material of the couplers of the invention is preferably 0.01 to 10 g, more preferably 0.1 to 2 g per $m^2$. A proper content of each of the couplers, per mol of silver halide contained in an emulsion layer is $1\times10^{-3}$ mol to 1 mol, and preferably $2\times10^{-3}$ mol to 3×10−1 mol.

When the lightsensitive layer is composed of a unit structure having two or more lightsensitive emulsion layers different in speed, the content, per mol of silver halide, of the coupler of the invention is preferably $2\times10^{-3}$ mol to $2\times10^{-1}$ mol in the lowest-speed layer, and $3\times10^{-2}$ mol to $3\times^{10-1}$ mol in the highest-speed layer. Such a configuration that the layer having higher speed contains larger amount of coupler, is preferable.

In the silver halide color reversal photographic material of the invention, it is preferable to contain the coupler of the formula (MC-I) and/or the coupler of the formula (CC-I), but the photographic material may contain another coupler in combination. However, the higher the contribution ratio of the color dye arising from the coupler of the invention to the total density of the dyes that exhibit substantially the same color, the better results are attained. Specifically, the use amount of the coupler of the invention is such that the contribution ratio to the total color density of the dye arising from the coupler of the invention is preferably 50% or more, and more preferably 70% or more.

In the silver halide color reversal photographic material of the invention, the coupler represented by the formula (MC-I) may be used in a layer other than a green-sensitive emulsion layer, and the coupler represented by the formula (CC-I) may be used in a layer other than a red-sensitive emulsion layer, as long as the amount thereof is such that the contribution ratio thereof to the color density is within 30% or less.

In the lightsensitive material of the invention, a competing compound, which reacts with an aromatic primary amine color developing agent in an oxidized form in competition with an image forming coupler, and does not form an dye image, may be used in combination. Examples of the competing compound include reducing compounds such as hydroquinones, catechols, hydrazines, and sulfonamidephenols, or compounds capable of coupling with an aromatic primary amine color developing agent in an oxidized form but does not substantially form color images (e.g., non-color-forming couplers disclosed in German Patent No. 1,155,675, British Patent 861,138, U.S. Pat. Nos. 3,876,428, and 3,912,513, or couplers whose dyes produced therefrom flow out during a processing step, such as those disclosed in JP-A-6-83002).

The addition amount of these competing compounds is preferably 0.01 g to 10 g per $m^2$, more preferably 0.10 g to 5.0 g. The use amount of the competing compound in relation to the coupler of the invention is preferably 1 to 1,000 mol %, and more preferably 20 to 500 mol %.

The lightsensitive material of the invention may have a non-color forming interlayer in an unit having the same color sensitivity. In the interlayer, a compound that can be selected as the competing compound mentioned above may be contained.

In order to prevent deterioration in photographic performance due to formaldehyde gas, the lightsensitive material of the invention preferably contains a compound capable of reacting with formaldehyde gas to fix it, such as those described in U.S. Pat. Nos. 4,411,987 and 4,435,503.

The lightsensitive material of the invention is only required to have at least one layer each of a blue-sensitive silver halide emulsion layer, a green-sensitive silver halide emulsion layer, and a red-sensitive silver halide emulsion layer, on a support. Although it is preferable to configure the lightsensitive material by coating the layers in this order from the farther side to the support, the order may be different. It is preferable, in the invention, that a red-sensitive emulsion layer, a green-sensitive emulsion layer and a blue-sensitive emulsion layer are coated in this order from a side closer to the support, and it is preferable that the respective color sensitive layers have a unit configuration in which two or more lightsensitive emulsion layers each having different speeds are contained. In particular, a configuration in which the respective color sensitive layers comprise three lightsensitive emulsion layers of a low-speed layer, a medium-speed layer, and a high-speed layer from a side closer to the support is preferable. These are described in JP-B-49-15495, JP-A-59-202464 and the like.

In one of the preferred embodiments of the invention, a lightsensitive element in which the following layers are coated on a support in this order, can be mentioned: an under coat layer/an anti-halation layer/a 1st interlayer/a red-sensitive emulsion layer unit (comprising, from the side closer to the support, three layers of a low-speed red-sensitive layer/a medium-speed red-sensitive layer/a high-speed red-sensitive layer)/a 2nd interlayer/a green-sensitive emulsion unit (comprising, from the side closer to the support, three layers of a low-speed green-sensitive layer/a medium-speed green-sensitive layer/a high-speed green-sensitive layer)/a 3rd interlayer/a yellow filter layer/a blue-sensitive emulsion unit (comprising, from the side closer to the support, three layers of a low-speed blue-sensitive layer/a medium-speed blue-sensitive layer/a high-speed blue-sensitive layer)/a 1st protective layer/a 2nd protective layer. The inter image-providing layer unit may be coated at the position where the interlayer and/or the protective layer are provided.

Each of the 1st, 2nd, and 3rd interlayers may be in a configuration of one layer or two or more layers. The 1st interlayer may be separated into two or more sub-layers. It is preferable that yellow colloidal silver may be contained in one of the sub-layers which is directly adjacent to the red-sensitive layer. Similarly, it is preferable that the 2nd interlayer is also in two or more sub-layers configuration, and yellow colloidal silver is contained in one of the sub-layers which is directly adjacent to the green-sensitive layer. It is also preferable that an additional 4th inter layer may be interposed between the yellow filter layer and the blue-sensitive emulsion layer unit.

The interlayer may contain a coupler and a DIR compound such as those described in the specifications of JP-A's-61-43748, 59-113438, 59-113440, 61-20037 and 61-20038. The interlayer may also contain a color-mixing-inhibiting agent, as usually do so.

It is also preferable that the lightsensitive material of the invention may have a three-layered protective layer structure comprising 1st to 3rd protective layers. When the number of the protective layers is two or three, the 2nd protective layer preferably contains fine grain silver halide having an equivalent-sphere average grain size of 0.10 $\mu$m or less. The silver halide is preferably silver bromide or silver iodobromide.

The lightsensitive material of the invention contains an image-forming coupler. The image-forming coupler referers to a coupler capable of forming an image-forming dye by coupling with an aromatic primary amine color developing agent in an oxidized form. Generally, a yellow coupler, magenta coupler and cyan couplers are used in combination to obtain color images.

The image forming coupler of the invention is preferably used by being added in a lightsensitive emulsion layer sensitive to light which is in the relation of complementary color to the color hue of the coupler. Namely, the yellow coupler is added to the blue-sensitive emulsion layer, the magenta coupler to the green-sensitive emulsion layer, and the cyan coupler to the red-sensitive emulsion layer. Further, it is preferable for purposes of improving the shadow description property and the like that the coupler that is not in relation of complementary color is used in combination, e.g., the cyan coupler or the yellow coupler is used together in the green-sensitive emulsion layer in accordance with the purpose, etc.

Preferable image-forming couplers used in the lightsensitive material of the invention are as follows.

Yellow couplers:

couplers represented by formulas (I) and (II) in EP502,424A;

couplers (particularly Y-28 on page 18) represented by formulas (1) and (2) in EP513,496A;

couplers represented by formula (I) in claim 1 of EP568,037A;

couplers represented by formula (I) in column 1, lines 45 to 55 of U.S. Pat. No. 5,066,576;

couplers represented by formula (I) in paragraph 0008 of JP-A-4-274425;

couplers (particularly D-35) described in claim 1 on page 40 of EP498 381A1;

couplers (particularly Y-1 and Y-54) represented by formula (Y) on page 4 of EP447,969A1;

couplers represented by formulas (II) to (IV) in column 7, lines 36 to 58 of U.S. Pat. No. 4,476,219; and so on Magenta couplers:

couplers described in JP-A-3-39737 (e.g., L-57, L-68, and L-77);

couplers described in EP456,257 (e.g., A-4-63, and A-4-73 and A-4-75;

couplers described in EP486,965 (e.g., M-4, M-6, and M -7;

couplers described in EP571,959A (e.g., M-45);

couplers described in JP-A-5-204106 (e.g., M-1);

couplers described in JP-A-4-362631 (e.g., M-22);

couplers represented by general formula (MC-I) described in JP-A-11-119393 (e.g., CA-4, CA-7, CA-12, CA-15, CA-16, and CA-18); and so on Cyan couplers:

couplers described in JP-A-4-204843 (e.g., CX-1, -3, -4, -5, -11, -12, -14, and -15);

couplers described in JP-A-4-43345 (e.g., C-7, -10, -34 and, -35, and (I-1) and (I-17);

couplers represented by formulas (I*a*) or (I*b*) in claim 1 of JP-A-6-67385;

couplers represented by general formula (PC-1) described in JP-A-11-119393 (e.g., CB-1, CB-4, CB-5, CB-9, CB-34, CB-44, CB-49 and CB-51);

couplers represented by general formula (NC-1) described in JP-A-11-119393 (e.g., CC-1 and CC-17); and so on The emulsion used in the silver halide photographic material of the invention preferably contains the tabular silver halide grains (hereinafter also referred to as "tabular grains") having an aspect ratio of 1.5 or more and less than 100. Herein, the tabular silver halide grains are the general name of silver halide grains having one twin plane or two or more of the parallel twin planes. The twin plane means a (111) face on the two sides of which ions at all lattice points have a mirror image relationship. The tabular grain is constituted by two opposing and parallel main planes and side faces linking these main planes. When the tabular grain is viewed in a direction perpendicular to the main plane, the main plane has any of triangular, hexagonal or round circular shapes of triangular or hexagonal, the triangular shape has the triangular opposing and parallel main plane, the hexagonal surface has the hexagonal one, and the circular shape has the circular one.

The aspect ratio of the tabular grain is a value obtained by dividing the grain diameter by the thickness. The measurement of thickness of the tabular grain can be easily carried out by depositing a metal from the oblique direction of the grain together with a latex for reference, measuring the length of its shadow on an electron microscope photograph and calculating referring to the length of shadow of the latex.

The grain diameter of the invention is the diameter of a circle having an area equal to the projected area of the parallel main planes of the grain.

The projected area of the grain is obtained by measuring an area on the electron microscope photograph and compensating a photographing magnification.

The diameter of the tabular grain is preferably 0.3 to 5.0 $\mu$m. The thickness of the tabular grain is preferably 0.05 to 0.5 $\mu$m.

The sum of the projected areas of the tabular grains used in the invention preferably occupies 50% or more, more preferably 80% or more, of the total projected area of all the silver halide grains in the emulsion. Further, the aspect ratios of the tabular grains which occupy these fixed areas are preferably 1.5 to less than 100, more preferably 2 to less than 20, and further preferably 2 to less than 8.

Further, when monodisperse tabular grains are used, further preferable effect happens to be obtained. The structure and preparation process of the monodisperse tabular grains are according to, for example, JP-A-63-151618 and the like, and when its shape is simply described, 70% or more of all the projected areas of silver halide grains is a hexagonal shape in which a ratio of the length of a side having the maximum length to that of a side having the minimum length in the main plane is 2 or less, and is occupied by the tabular silver halide grains having two parallel planes as outer planes. Further, it has the monodisperse property in which the variation coefficient of the grain diameter distribution of said hexagonal tabular silver halide grain, i.e., a value obtained by dividing the deviation (standard deviation) of grain diameters by the average grain diameter and then multiply with 100, is 20% or less.

In the invention, the tabular grains preferably have dislocation lines.

The dislocation in the tabular grains can be observed by the direct method using a transmission electron microscope at low temperatures as described in, for example, J. F. Hamilton, Phot. Sci. Eng., 11, 57 (1967) and T. Shiozawa, J. Soc. Phot. Sci. Tech. Japan, 35, 213 (1972). Illustratively, silver halide grains are harvested from the emulsion with the care that the grains are not pressurized with such a force that dislocation lines occur on the grains, are put on a mesh for electron microscope observation and, while cooling the specimen so as to prevent damaging (printout, etc.) by electron beams, are observed by the transmission method. The greater the thickness of the above grains, the more difficult the transmission of electron beams. Therefore, the use of an electron microscope of high voltage type (at least 200 kV on the grains of 0.25 $\mu$m in thickness) is preferred for ensuring clearer observation. The thus obtained photograph of grains enables determining the position and number of dislocation lines in each grain viewed in the direction perpendicular to the main planes.

The position of the dislocation of the tabular grains used in the invention arises from x% of the distance between the center and the side to the side, along the long axis of the tabular grain. The value x is preferably $10 \leqq x < 100$, more preferably $30 \leqq x < 98$, and much more preferably $50 \leqq x < 95$. In this instance, the figure created by binding the positions from which the dislocation lines start is nearly similar to the configuration of the grain. The created figure may be one that is not a complete similar figure but deviated. The direction of the dislocation lines is roughly in the direction from the center to the sides, but they often windle.

Regarding the number of dislocation lines in the tabular grains used in the invention, it is preferable that grains having 10 or more dislocation lines are present in an amount of 50% (by number of grains) or more. More preferably, grains having 10 or more dislocation lines are present in an amount of 80% (by number of grains) or more, and especially preferably those having 20 or more dislocation lines in an amount of 80% (by number of grains) or more.

The preparation process of the tabular grain used in the invention is described.

The tabular grain used in the invention can be prepared by improving methods described in "Cleave, Photography Theory and Practice (1930), page 13", "Gutuff, Photographic Science and Engineering Vol.14, pages 248–257 (1970)", U.S. Pat. Nos. 4,434,226, 4,414,310, 4,433,048 and 4,439,520, and BG 2,112,157 and the like.

Any of the silver halide compositions such as silver bromide, silver iodobromide, silver iodochlorobromide and silver chlorobromide may be used for the tabular silver halide grain used in the invention. The preferable silver halide composition is silver iodobromide or silver iodochlorobromide containing 30 mol or less of silver iodide.

The silver halide grains used in the invention may have a multiple structure of a double structure or more, for example, a quintuple structure, concerning the intra-grain silver halide composition. The structure refers to a structure concerning the intra-grain silver iodide distribution, and it is indicated that the difference in silver iodide content between each structure is of 1 mol % or more. This intra-grain silver iodide distribution structure can be basically obtained by calculations from the prescribed value in the grain preparation step. In the interface between layers of the structure, the silver iodide content can change either abruptly or moderately. The EPMA (Electron Probe Micro Analyzer) method is usually effective to confirm this structure, although the measurement accuracy of analysis must be taken into consideration. By forming a sample in which emulsion grains are dispersed so as not to contact each other and analyzing radiated X-rays by radiating an electron beam, elements in a micro region irradiated with the electron beam can be analyzed. The measurement is preferably performed under cooling at low temperatures in order to prevent damage to the sample by the electron beam. By this method, the intra-grain silver iodide distribution of a tabular grain can be analyzed when the grain is viewed in a direction perpendicular to its main planes. Additionally, when a specimen obtained by hardening a sample and cutting the sample into a very thin piece using microtome is used, the intra-grain silver iodide distribution in the section of a tabular grain can be analyzed.

In the nucleation of the grain formation, to use a gelatin having a small methionine content disclosed in U.S. Pat. Nos. 4,713,320 and 4,942,120; to perform the nucleation at a high pBr disclosed in U.S. Pat. No. 4,914,014; and to perform the nucleation in a short time disclosed in JP-A-2-222940 are very effective for the preparation of tabular grains. In the ripening step, to perform the ripening in the presence of a base of a low concentration disclosed in U.S. Pat. No. 5,254,453 and to perform the ripening at a high pH disclosed in U.S. Pat. No. 5,013,641 may be effective for the ripening step of the emulsions of the invention.

The method of forming tabular grains using the polyalkyleneoxide compounds described in U.S. Pat. Nos. 5,147,771, 5,147,772, 5,147,773, 5,171,659, 5,210,013, and 5,252,453, is preferably used in the core grain preparation used in the invention.

To obtain high-aspect-ratio monodisperse tabular grains, gelatin is sometimes additionally added during grain formation. The gelatin used at that time is preferably chemically modified gelatin described in JP-A's-10-148897 and 11-143002 or gelatin having a small methionine content described in U.S. Pat. Nos. 4,713,320 and 4,942,120. The former chemically modified gelatin is a gelatin characterized in that at least two carboxyl groups are newly introduced when an amino group in the gelatin is chemically modified. It is preferable to use succinated gelatin or trimellitated gelatin. This chemically modified gelatin is added preferably before the growth step, and more preferably immediately after nucleation. The addition amount thereof is 50% or more, preferably 70% or more of the weight of the total dispersing medium used during grain formation.

Examples of silver halide solvents which can be used in the invention include organic thioethers (a) described in U.S. Pat. Nos. 3,271,157, 3,531,286 and 3,574,628 and JP-A's-54-1019 and 54-158917; thiourea derivatives (b) described in JP-A's-53-82408, 55-77737 and 55-2982; silver halide solvents having a thiocarbonyl group interposed between an oxygen or sulfur atom and a nitrogen atom (c) described in JP-A-53-144319; imidazoles (d) described in JP-A-54-100717; sulfites (e); ammonia (f); and thiocyanates (g). Especially preferred solvents are thiocyanates, ammonia and tetramethylthiourea. Although the amount of added solvent depends on the type thereof, in the case of, for example, a thiocyanate, the preferred amount is in the range of $1\times10^{-4}$ to $1\times10^{-2}$ mol per mol of silver halides. Basically, when a washing step is provided after the first shell formation as described above, the solvent can be removed regardless of the kind of a solvent used.

The dislocation of the tabular grain used in the invention is introduced by providing a high iodide phase to the inside of the grain.

The high iodide phase is a silver halide solid solution containing iodine, and in this case, silver iodide, silver iodobromide and silver chloroiodobromide are preferable as the silver halide, silver iodide or silver iodobromide is preferable and silver iodide is preferable in particular.

The amount of silver halide which forms the high-iodide phase is 30 mol % or less of the silver amount of all the grains, and further preferably 10 mol % or less.

A phase grown at the outside of the high iodide phase is required to have a lower silver iodide contents than that in the high iodide phase, and the preferable silver iodide content is 0 to 12 mol %, further preferably 0 to 6 mol %, and most preferably 0 to 3 mol %.

As the preferable method of forming the high iodide phase, there is a method of forming the phase by adding an emulsion containing silver iodobromide or a silver iodide fine grains (hereinafter referred to as silver iodide fine grain emulsion). Fine grains preliminarily prepared can be used as these fine grains, and the fine grains immediately after preparation can be more preferably used.

A case of using the fine grains preliminarily prepared is firstly illustrated. In this case, there is a method of adding the fine grains preliminarily prepared, ripening and dissolving them. As the more preferable method, there is a method of adding the silver iodide fine grain emulsion, and then adding an aqueous silver nitrate solution, or an aqueous silver nitrate solution and an aqueous halogen solution. In this case, the dissolution of the fine grains is accelerated by the addition of the aqueous silver nitrate solution. It is preferred that the silver iodide fine grain emulsion be added abruptly.

The abrupt addition of the silver iodide fine grain emulsion means the addition of the silver iodide fine grain emulsion within preferably 10 minutes. It means the addition within 7 minutes more preferably. The condition can be changed according to the temperature, pBr and pH of a system added, the kind and concentration of protective colloid agents such as a gelatin and the like, the presence or absence, kind, and concentration of the silver halide solvent, and the like, but the shorter period is preferable as described above. It is preferable that the addition of an aqueous silver salt solution such as silver nitrate or the like is not substantially carried out at the addition. The temperature of the system at the addition is preferably 40° C. or more and 90° C. or less, and preferably 50° C. or more and 80° C. or less in particular.

The composition of fine grains contained in the silver iodide fine grain emulsion may be substantially silver iodide, and silver bromide and/or silver chloride may be contained so far as it can be a mix crystal. Preferable is 100% silver iodide. Silver iodide occasionally takes a β-form, a γ-form and an α-form or an a-form analogous structure as described in U.S. Pat. No. 4,672,026, in its crystal structure. In the invention, there is no limitation of the crystal structure in particular, a mixture of the β-form and the γ-form is used, and the β-form is further preferably used. The silver iodide fine grain emulsion after a usual washing step with water is preferably used. The silver iodide fine grain emulsion can be easily formed by a method described in U.S. Pat. No. 4,672,026. The grain formation is carried out by making the pI value at the grain formation constant. The double jet addition method of the aqueous silver salt solution and the aqueous iodide salt solution is preferable. Herein, pI is a logarithm of the reciprocal of $I^-$ ion concentration of the system. The temperature, pI, pH, the kind and concentration of protective colloid agents such as a gelatin and the like, the presence or absence, kind, and concentration of the silver halide solvent, and the like are not limited in particular, but it is suitable for the invention that the size of grains is 0.1 μm or less and more preferably 0.07 μm or less. Since the grains are fine grains, the grain shape is not perfectly specified, but the variation coefficient of the grain size distribution is preferably 25% or less. When it is 20 or less, the advantage of the invention is remarkable. Herein, the size and the size distribution of the fine grains are directly determined by putting the fine grains on a mesh for electron microscope observation, and observing by not a carbon replica method but a permeation method. Since the grain size is small, measurement error becomes great by observation according to the carbon replica method. The grain size is defined as the diameter of a circle having a projected area equal to the grain observed. The size distribution of grains is also determined using the circle diameter having the equal projected area. The most effective fine grain in the invention is that having a grain size of 0.06 μm or less and 0.02 μm or more, and the variation coefficient of a size distribution of grains of 18% or less.

In the formation of the silver iodide fine grain emulsion, after the above-mentioned grain formation, a usual washing with water described in U.S. Pat. No. 2,614,929 is preferably carried out to the silver iodide fine grain emulsion, and pH, pI, the concentration of protective colloid agents such as a gelatin and the like and the concentration of the silver iodide contained are carried out. The pH is preferably 5 or more and 7 or less. The pI value is preferably set at a pI value in which the solubility of silver iodide is minimum, or at a higher pI value than the value. As the protective agent, a usual gelatin having an average molecular weight of about 100,000 is preferably used. A low-molecular-weight gelatin having an average molecular weight of 20,000 or less is also preferably used. Further, there is occasionally a suitable case if the above-mentioned gelatins having different molecular weights are used in mixture. The amount of the gelatin per one kg of the emulsion is preferably 10 g or more and 100 g or less. 20 g or more and 80 g or less is more preferable. The amount of silver converted to silver atom per one kg of the emulsion is preferably 10 g or more and 100 g or less. 20 g or more and 80 g or less is more preferable. As the amount of the gelatin and/or the amount of silver, a value suitable for abruptly adding the silver iodide fine grain emulsion is preferably selected.

The silver iodide fine grain emulsion is usually added by preliminarily being dissolved, and the stirring efficiency of the system at addition is required to be adequately enhanced. The rotational number of stirring is preferably set higher than usual. The addition of a defoaming agent is effective for preventing the generation of foam at stirring. Specifically, a defoaming agent described in Examples and the like of U.S. Pat. No. 5,275,929 is used.

When the fine grains immediately after preparation is used, a detail concerning a mixer for forming the silver halide fine grain can be referred to the description of JP-A-10-43570.

For the silver halide fine grains of the invention, it is preferable that the variation coefficient of the silver iodide contents distribution is 20% or less. 15% or less is preferable, and 10% or less is preferable in particular. When the variation coefficient is more than 20%, it does not have high contrast, and when a pressure is applied, it is not preferable because the decrease of sensitivity becomes also great. The silver iodide content of each grain can be measured by analyzing the composition of each of grains using an X-ray micro analyzer. The variation coefficient of the silver iodide content distribution between the respective grains is a value determined by the relation equation (standard deviation/average silver iodide content)×100= variation coefficient using the standard deviation of the silver iodide content and the average silver iodide content when the silver iodide content of at least 100 or more, more preferably 200 or more and in particular preferably 300 or more of the emulsion grains is measured. The measurement of the silver iodide contents of individual grains is described in, for example, EP 147,868. There is a correlation or no correlation between the silver iodide content Yi (mol) of the individual grains and the equivalent-sphere diameter Xi ($\mu$m) of the respective grains, but no correlation is desirable.

The silver halide emulsion of the invention is preferably provided with a positive hole-capturing zone in at least a portion of the inside of the silver halide grains. The positive hole-capturing zone of the invention indicates a region having a function of capturing a positive hole generated in pair with photo-electron generated by, for example, photo-excitation. Such positive hole-capturing zone is defined in the invention as a zone provided by an intentional reduction sensitization.

The intentional reduction sensitization in the invention means an operation of introducing a positive hole-capturing silver nuclei into a portion or all of the inside of the silver halide grains by adding a reduction sensitizing agent. The positive hole-capturing silver nuclei means a small silver nuclei having a little development activity, and the recombination loss at a lightsensitive process is prevented by the silver nuclei and the sensitivity can be enhanced.

Examples of known reduction sensitizers include stannous salts, ascorbic acid and derivatives thereof, amines and polyamines, hydrazine derivatives, formamidinesulfinic acid, silane compounds and borane compounds. In the reduction sensitization employed in the invention, appropriate one may be selected from among these known reduction sensitizers and used or at least two may be selected and used in combination. Preferred reduction sensitizers are stannous chloride, thiourea dioxide, dimethylaminoborane, ascorbic acid and derivatives thereof. Although the addition amount of reduction sensitizer must be selected because it depends on the emulsion manufacturing conditions, it is preferred that the addition amount range from $10^{-7}$ to $10^{-3}$ mol per mol of silver halide.

The reduction sensitizer is dissolved in water or any of organic solvents such as alcohols, glycols, ketones, esters and amides and added during the grain growth.

In the invention, the positive hole-capturing silver nuclei is formed preferably by adding a reduction sensitizer at a time of after nucleation and after the completion of the physical ripening, and immediately before the initiation of grain formation. However, the positive hole-capturing silver nuclei can also be introduce on the grain surface by adding a reduction sensitizer on and after the completion of the grain formation.

When a reduction sensitizer is added during grain formation, some silver nuclei formed can stay inside a grain, but some ooze out to form silver nuclei on the grain surface. In the invention, these oozing silver nuclei are preferably used as positive hole-capturing silver nuclei.

In the invention, when the intentional reduction sensitization is performed during a step in the midst of grain growth in order to form the positive hole-capturing nuclei inside the silver halide grain, it is necessary to perform the intentional reduction sensitization in the presence of a compound represented by general formula (I-1) or general formula (I-2).

Herein, the step in the midst of the grain growth does not include the step after the final desalting is performed. For example, a step of chemical sensitization in which silver halide grains grow as a result of the addition of a silver salt solution and fine grain silver halide, is not included.

(I-1)

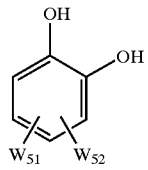

(I-2)

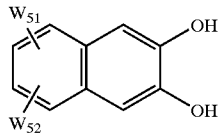

In formulas (I-1) and (I-2), each of $W_{51}$ and $W_{52}$ independently represents a sulfo group or hydrogen atom. However, at least one of $W_{51}$ and $W_{52}$ represents a sulfo group. A sulfo group is generally an alkali metal salt such as sodium or potassium or a water-soluble salt such as ammonium salt. Favorable practical examples are 3,5-disulfocatechol disodium salt, 4-sulfocatechol ammonium salt, 2,3-dihydroxy-7-sulfonaphthalene sodium salt, and 2,3-dihydroxy-6,7-jisulfonaphthalen potassium salt. A preferred addition amount can vary in accordance with, e.g., the temperature, pBr, and pH of the system to which the compound is added, the type and concentration of a protective colloid agent such as gelatin, and the presence/absence, type, and concentration of a silver halide solvent. Generally, the addition amount is preferably 0.0005 to 0.5 mol, and more preferably, 0.003 to 0.02 mol per mol of a silver halide.

An oxidizer capable of oxidizing silver is preferably used during the process of producing the emulsion for use in the invention (hereinafter also referred to as the emulsion of the invention). The silver oxidizer is a compound having an effect of acting on metallic silver to thereby convert the same to silver ion. A particularly effective compound is one that converts very fine silver grains, formed as a by-product in the step of forming silver halide grains and the step of chemical sensitization, into silver ions. Each silver ion produced may form a silver salt sparingly soluble in water, such as a silver halide, silver sulfide or silver selenide, or may form a silver salt easily soluble in water, such as silver nitrate. The silver oxidizer may be either an inorganic or an organic substance. Examples of suitable inorganic oxidizers include ozone, hydrogen peroxide and its adducts (e.g., $NaBO_2.H_2O_2.3H_2O$, $2NaCO_3.3H_2O_2$, $Na_4P_2O_7.2H_2O_2$ and $2Na_2SO_4.H_2O_2.2H_2O$), peroxy acid salts (e.g., $K_2S_2O_8$, $K_2C_2O_6$ and $K_2P_2O_8$), peroxy complex compounds (e.g., $K_2[Ti(O_2)C_2O_4].3H_2O$, $4K_2SO_4.Ti(O_2)OH.SO_4.2H_2O$ and $Na_3[VO(O_2)(C_2H_4)_2].6H_2O$), permanganates (e.g., $KMnO_4$), chromates (e.g., $K_2Cr_2O_7$) and other oxyacid salts, halogen elements such as iodine and bromine, perhalogenates (e.g., potassium periodate), salts of high-valence metals (e.g., potassium hexacyanoferrate (II)) and thiosulfonates.

Examples of suitable organic oxidizers include quinones such as p-quinone, organic peroxides such as peracetic acid and perbenzoic acid and active halogen-releasing compounds (e.g., N-bromosuccinimide, chloramine T and chloramine B).

Oxidizers preferred in the invention are inorganic oxidizers selected from among ozone, hydrogen peroxide and its adducts, halogen elements and thiosulfonates and organic oxidizers selected from among quinones. Especially preferably, the oxidizers are thisosulfonate such as those described in JP-A-2-191938.

The addition of the oxidizer to silver may be performed at any time selected from before the initiation of the intentional reduction sensitization, during reduction sensitization, immediately before the termination of reduction sensitization and immediately after the termination of reduction sensitization. The addition of the oxidizer to silver may be performed several times separately. The addition amount, although it varies depending on a kind of the oxidizer, is preferably in a range of $1\times10^{-7}$ to $1\times10^{-3}$ mol per mol of silver halide.

It is advantageous to use gelatin as a protective colloid for use in preparation of emulsions of the invention or as a binder for other hydrophilic colloid layers. However, another hydrophilic colloid can also be used in place of gelatin.

Examples of the hydrophilic colloid are protein, such as a gelatin derivative, a graft polymer of gelatin and another high polymer, albumin, and casein; sugar derivatives, such as cellulose derivatives, e.g., cellulose sulfates, hydroxyethylcellulose, and carboxymethylcellulose, soda alginate, and starch derivatives; and a variety of synthetic hydrophilic high polymers, such as homopolymers or copolymers, e.g., polyvinyl alcohol, polyvinyl alcohol with partial acetal, poly-N-vinylpyrrolidone, polyacrylic acid, polymethacrylic acid, polyacrylamide, polyvinylimidazole, and polyvinylpyrazole.

Examples of gelatin are lime-processed gelatin, acid-processed gelatin, and enzyme-processed gelatin described in Bull. Soc. Sci. Photo. Japan, 16, page 30 (1966). In addition, a hydrolyzed product or an enzyme-decomposed product of gelatin can also be used.

It is preferable to wash with water an emulsion of the invention to desalt, and disperse into a newly prepared protective colloid. Although the temperature of washing can be selected in accordance with the intended use, it is preferably 5° C. to 50° C. Although the pH of washing can also be selected in accordance with the intended use, it is preferably 2 to 10, and more preferably, 3 to 8. The pAg of washing is preferably 5 to 10, though it can also be selected in accordance with the intended use. The washing method can be selected from noodle washing, dialysis using a semipermeable membrane, centrifugal separation, coagulation precipitation, and ion exchange. The coagulation precipitation can be selected from a method using sulfate, a method using an organic solvent, a method using a water-soluble polymer, and a method using a gelatin derivative.

In the preparation of the emulsion of the invention, it is preferable to make salt of metal ion exist, for example, during grain formation, desalting, or chemical sensitization, or before coating in accordance with the intended use. The metal ion salt is preferably added during grain formation when doped into grains, and after grain formation and before completion of chemical sensitization when used to decorate the grain surface or used as a chemical sensitizer. The salt can be doped in any of an overall grain, only the core, the shell, or the epitaxial portion of a grain, and only a substrate grain. Examples of the metal are Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi. These metals can be added as long as they are in the form of salt that can be dissolved during grain formation, such as ammonium salt, acetate, nitrate, sulfate, phosphate, hydroxide, 6-coordinated complex salt, or 4-coordinated complex salt. Examples are $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_4[Fe(CN)_6]$, $K_2IrCl_6$, $K_3IrCl_6$, $(NH_4)_3RhCl_6$, and $K_4Ru(CN)_6$. The ligand of a coordination compound can be selected from halo, aquo, cyano, cyanate, thiocyanate, nitrosyl, thionitrosyl, oxo, and carbonyl. These metal compounds can be used either singly or in the form of a combination of two or more types of them.

The metal compounds are preferably dissolved in an appropriate solvent, such as methanol or acetone, and added in the form of a solution. To stabilize the solution, an aqueous hydrogen halogenide solution (e.g., HCl or HBr) or an alkali halide (e.g., KCl, NaCl, KBr, or NaBr) can be added. It is also possible to add acid or alkali if necessary. The metal compounds can be added to a reactor vessel either before or during grain formation. Alternatively, the metal compounds can be added to a water-soluble silver salt (e.g., $AgNO_3$) or an aqueous alkali halide solution (e.g., NaCl, KBr, or KI) and added in the form of a solution continuously during formation of silver halide grains. Furthermore, a solution of the metal compounds can be prepared independently of a water-soluble salt or an alkali halide and added continuously at a proper timing during grain formation. It is also possible to combine several different addition methods.

It is sometimes useful to perform a method of adding a chalcogen compound during preparation of an emulsion, such as described in U.S. Pat. No. 3,772,031. In addition to S, Se, and Te, cyanate, thiocyanate, selenocyanic acid, carbonate, phosphate, and acetate can be present.

In the silver halide grains used in the invention, at least one of chalcogen sensitization including sulfur sensitization and selenium sensitization, and noble metal sensitization including gold sensitization and palladium sensitization, and reduction sensitization can be performed at any point during the process of preparing a silver halide emulsion. The use of two or more different sensitizing methods is preferable.

Several different types of emulsions can be prepared by changing the timing at which the chemical sensitization is performed. The emulsion types are classified into: a type in which a chemical sensitization nucleus is embedded inside a grain, a type in which it is embedded in a shallow position from the surface of a grain, and a type in which it is formed on the surface of a grain. In emulsions of the invention, the position of a chemical sensitization nucleus can be selected in accordance with the intended use. However, it is preferable to form at least one type of a chemical sensitization nucleus in the vicinity of the surface.

One chemical sensitization which can be preferably performed in the invention is chalcogen sensitization, noble metal sensitization, or a combination of these. The sensitization can be performed by using active gelatin as described in T. H. James, The Theory of the Photographic Process, 4th ed., Macmillan, 1977, pages 67 to 76. The sensitization can also be performed by using any of sulfur, selenium, tellurium, gold, platinum, palladium, and iridium, or by using a combination of a plurality of these sensitizers at pAg 5 to 10, pH 5 to 8, and a temperature of 30° C. to 80° C., as described in Research Disclosure, Vol. 120, April, 1974, 12008, Research Disclosure, Vol. 34, June, 1975, 13452, U.S. Pat. Nos. 2,642,361, 3,297,446, 3,772,031, 3,857,711, 3,901,714, 4,266,018, and 3,904,415, and British Patent 1,315,755.

In the noble metal sensitization, salts of noble metals, such as gold, platinum, palladium, and iridium, can be used. In particular, gold sensitization, palladium sensitization, or a combination of the both is preferred. In the gold sensitization, it is possible to use known compounds, such as chloroauric acid, potassium chloroaurate, potassium aurithiocyanate, gold sulfide, and gold selenide, or mesoionic gold compounds described in U.S. Pat. No. 5,220,030 and azole gold compounds described in U.S. Pat. No. 5,049, 484 and so on. A palladium compound means a divalent or tetravalent salt of palladium. A preferable palladium compound is represented by $R_2PdX_6$ or $R_2PdX_4$ wherein R represents a hydrogen atom, an alkali metal atom, or an ammonium group and X represents a halogen atom, e.g., a chlorine, bromine, or iodine atom.

More specifically, the palladium compound is preferably $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$. It is preferable that the gold compound and the palladium compound be used in combination with thiocyanate or selenocyanate.

A preferable amount of a gold sensitizer used in the invention is $1\times10^{-3}$ to $1\times10^{-7}$ mol, and more preferably, $1\times10^{-4}$ to $5\times10^{-7}$ mol per mol of a silver halide. A preferable amount of a palladium compound is $1\times10^{-3}$ to $5\times10^{-7}$ mol per mol of a silver halide. A preferable amount of a thiocyan compound or a selenocyan compound is $5\times10^{-2}$ to $1\times10^{-6}$ mol per mol of a silver halide.

Examples of a sulfur sensitizer are hypo, a thiourea-based compound, a rhodanine-based compound, and sulfur-containing compounds described in U.S. Pat. Nos. 3,857, 711, 4,266,018, and 4,054,457. The chemical sensitization can also be performed in the presence of a so-called chemical sensitization aid. Examples of a useful chemical sensitization aid are compounds, such as azaindene, azapyridazine, and azapyrimidine, which are known as compounds capable of suppressing fog and increasing sensitivity in the process of chemical sensitization. Examples of the chemical sensitization aid and the modifier are described in U.S. Pat. Nos. 2,131,038, 3,411,914, and 3,554,757, JP-A-58-126526, and G. F. Duffin, Photographic Emulsion Chemistry, pages 138 to 143.

A preferable amount of a sulfur sensitizer used in the invention is $1\times10^{-4}$ to 1×10−7 mol, and more preferably, $1\times10^{-5}$ to $5\times10^{-7}$ mol per mol of a silver halide.

As a preferable sensitizing method for the emulsion of the invention, selenium sensitization can be mentioned. As a selenium sensitize used in the invention, selenium compounds disclosed in hitherto published patents can be used as the selenium sensitizer in the invention. In the use of labile selenium compound and/or nonlabile selenium compound, generally, it is added to an emulsion and the emulsion is agitated at high temperature, preferably 40° C. or above, for a given period of time. Compounds described in, for example, JP-B-44-15748, JP-B-43-13489, JP-A's-4-25832 and 4-109240 are preferably used as the unlabile selenium compound.

Specific examples of the labile selenium sensitizers include isoselenocyanates (for example, aliphatic isoselenocyanates such as allyl isoselenocyanate), selenoureas, selenoketones, selenoamides, selenocarboxylic acids (for example, 2-selenopropionic acid and 2-selenobutyric acid), selenoesters, diacyl selenides (for example, bis(3-chloro-2, 6-dimethoxybenzoyl) selenide), selenophosphates, phosphine selenides and colloidal metal selenium.

The labile selenium compounds, although preferred types thereof are as mentioned above, are not limited thereto. It is generally understood by persons of ordinary skill in the art to which the invention pertains that the structure of the labile selenium compound as a photographic emulsion sensitizer is not so important as long as the selenium is labile and that the labile selenium compound plays no other role than having its selenium carried by organic portions of selenium sensitizer molecules and causing it to present in labile form in the emulsion. In the invention, the labile selenium compounds of this broad concept can be used advantageously.

Compounds described in JP-B's-46-4553, 52-34492 and 52-34491 can be used as the nonlabile selenium compound used in the invention. Examples of the nonlabile selenium compounds include selenious acid, potassium selenocyanate, selenazoles, quaternary selenazole salts, diaryl selenides, diaryl diselenides, dialkyl selenides, dialkyl diselenides, 2-selenazolidinedione, 2-selenoxazolidinethione and derivatives thereof.

These selenium sensitizers are dissolved in water or in a single solvent or a mixture of organic solvents selected from methanol and ethanol and added at the time of chemical sensitization. Preferably, the addition is performed prior to the initiation of chemical sensitization. The use of the above selenium sensitizers is not limited to a single kind, but the combined use of two or more kinds may be acceptable. The combined use of a labile selenium compound and an unlabile selenium compound is preferred.

The addition amount of the selenium sensitizer for use in the invention, although varied depending on the activity of employed selenium sensitizer, the type and size of silver halide, the ripening temperature and time, etc., is preferably in the range of $1\times10^{-8}$ or more. More preferably, the amount is $1\times10^{-7}$ mol or more and $5\times10^{-5}$ mol or less per mol of silver halide. The temperature of chemical ripening in the use of a selenium sensitizer is preferably 40° C. or more and 80° C. or less. The pAg and pH are arbitrary. For example, with respect to pH, the effect of the invention can be exerted even if it widely ranges from 4 to 9.

Selenium sensitization is preferably used in combination with sulfur sensitization or noble metal sensitization or both of them. Further, in the invention, a thiocyanic acid salt is preferably added in the silver halide emulsion at the chemical sensitization. As the thiocyanate, potassium thiocyanate, sodium thiocyanate, ammonium thiocyanate, and the like are used. It is usually added by being dissolved in an aqueous solution or a water-soluble solvent. The addition amount per mol of silver halide is $1\times10^{-5}$ mol to $1\times10^{-2}$ mol, and more preferably $5\times10^{-5}$ mol to 5×10−3 mol.

It is preferred that in the silver halide emulsion of the invention, an appropriate amount of calcium ion and/or a magnesium ion be contained. Thereby, the grain shape is made better, the quality of an image is improved, and the preservation property is made better. The range of the appropriate amount is 400 to 2500 ppm for calcium and/or 50 to 2500 ppm for magnesium, and calcium is more preferably 500 to 2000 ppm and magnesium is 200 to 2000 ppm. Herein, 400 to 2500 ppm for calcium and/or 50 to 2500 ppm for magnesium means that at least one of calcium and magnesium is a concentration within the range prescribed. When the content of calcium or magnesium is higher than these values, it is not preferable that inorganic salts which calcium salt, magnesium salt, a gelatin or the like has preliminarily retained precipitate and become the cause of trouble at the manufacture of the lightsensitive material. Herein, the content of calcium or magnesium is represented by weight converted to calcium atom or magnesium atom for all of the compounds containing calcium or magnesium such as a calcium ion, a magnesium ion, a calcium salt, a magnesium salt and the like, and represented by concentration based on the unit weight of the emulsion.

The adjustment of the calcium content in the silver halide tabular emulsion of the invention is preferably carried out adding the calcium salt at the chemical sensitization. The gelatin generally used at manufacturing an emulsion contains already calcium by 100 to 4000 ppm as a solid gelatin, and calcium may be adjusted by adding a calcium salt to the gelatin to be increased. Further, if necessary, after carrying out the desalting (removal of calcium) from the gelatin according to a known method such as a washing method with water or an ion exchange method or the like, the content can be also adjusted by a calcium salt. As the calcium salt, calcium nitrate and calcium chloride are preferable, and calcium nitrate is most preferable. Similarly, the adjustment of the magnesium content can be carried out adding a magnesium salt. As the magnesium salt, magnesium nitrate, magnesium sulfate and magnesium chloride are preferable, and magnesium nitrate is most preferable. As the quantitative determination method of calcium or magnesium, it can be determined by ICP emission spectral analysis method. Calcium and magnesium may be used alone and a mixture of both may be used. It is more preferable to contain calcium. The addition of calcium or magnesium can be carried out at the arbitrary period of the manufacturing steps of the silver halide emulsion, but is preferably from after the grain formation to just after completion of the spectral sensitization and the chemical sensitization, and more preferably after addition of a sensitizing dye. Further, it is preferable in particular to add after addition of a sensitizing dye and before carrying out the chemical sensitization.

As a particularly effective compound for reducing the fog of the silver halide emulsion and suppressing the increase of the fog during preservation, a mercaptotetrazol compound having a water-soluble group described in JP-A-4-16838 is mentioned. Further, in the JP-A above, it is disclosed that the preservation property is enhanced by using the mercaptotetrazol compound and a mercaptothiadiazol compound in combination.

The surface or an arbitrary position from the surface of the emulsion used in the invention may be chemically sensitized, but it is preferable to chemically sensitize the surface. When the inner part is chemically sensitized, a method described in JP-A-63-264740 can be referred.

Photographic emulsions used in the invention can contain various compounds in order to prevent fog during the preparing process, storage, or photographic processing of a sensitized material, or to stabilize photographic properties. That is, it is possible to add many compounds known as antifoggants or stabilizers, e.g., thiazoles such as benzothiazolium salt; nitroimidazoles; nitrobenzimidazoles; chlorobenzimidazoles; bromobenzimidazoles; mercaptothiazoles; mercaptobenzothiazoles; mercaptobenzimidazoles; mercaptothiadiazoles; aminotriazoles; benzotriazoles; nitrobenzotriazoles; and mercaptotetrazoles (particularly 1-phenyl-5-mercaptotetrazole); mercaptopyrimidines; mercaptotriazines; a thioketo compound such as oxazolinethione; azaindenes such as triazaindenes, tetrazaindenes (particularly 4-hydroxy-substituted(1,3,3a,7) tetrazaindenes), and pentazaindenes. For example, compounds described in U.S. Pat. Nos. 3,954,474 and 3,982,947 and JP-B-52-28660 can be used. One preferred compound is described in JP-A-63-212932. Antifoggants and stabilizers can be added at any of several different timings, such as before, during, and after grain formation, during washing with water, during dispersion after the washing, before, during, and after chemical sensitization, and before coating, in accordance with the intended application. The antifoggants and stabilizers can be added during preparation of an emulsion to achieve their original fog preventing effect and stabilizing effect. In addition, the antifoggants and stabilizers can be used for various purposes of, e.g., controlling the crystal habit of grains, decreasing the grain size, decreasing the solubility of grains, controlling chemical sensitization, and controlling the arrangement of dyes.

The photographic emulsion for use in the invention is preferably subjected to a spectral sensitization with a methine dye or the like to thereby exert the effects of the invention. Examples of employed dyes include cyanine dyes, merocyanine dyes, composite cyanine dyes, composite merocyanine dyes, holopolar cyanine dyes, hemicyanine dyes, styryl dyes and hemioxonol dyes. Particularly useful dyes are those belonging to cyanine dyes, merocyanine dyes and composite merocyanine dyes. These dyes may contain any of nuclei commonly used in cyanine dyes as basic heterocyclic nuclei. Examples of such nuclei include a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus and a pyridine nucleus; nuclei comprising these nuclei fused with alicyclic hydrocarbon rings; and nuclei comprising these nuclei fused with aromatic hydrocarbon rings, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus and a quinoline nucleus. These nuclei may have substituents on carbon atoms thereof.

The merocyanine dye or composite merocyanine dye may have a 5 or 6-membered heterocyclic nucleus such as a pyrazolin-5-one nucleus, a thiohydantoin nucleus, a 2-thioxazolidine-2,4-dione nucleus, a thiazolidine-2,4-dione nucleus, a rhodanine nucleus or a thiobarbituric acid nucleus as a nucleus having a ketomethylene structure.

These spectral sensitizing dyes may be used either individually or in combination. The spectral sensitizing dyes are often used in combination for the purpose of attaining supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, and 3,837,862, 4,026,707, GB Nos. 1,344,281 and 1,507,803, JP-B's-43-4936 and 53-12375, and JP-A's-52-110618 and 52-109925.

The emulsion used in the invention may contain a dye which itself exerts no spectral sensitizing effect or a substance which absorbs substantially none of visible radiation and exhibits supersensitization, together with the above spectral sensitizing dye.

The addition timing of the spectral sensitizing dye to the emulsion may be performed at any stage of the process for preparing the emulsion which is known as being useful. Although the doping is most usually conducted at a stage between the completion of the chemical sensitization and the coating, the spectral sensitizing dye can be added simultaneously with the chemical sensitizer to thereby simultaneously effect the spectral sensitization and the chemical sensitization as described in U.S. Pat. Nos. 3,628,969 and 4,225,666. Alternatively, the spectral sensitization can be conducted prior to the chemical sensitization and, also, the spectral sensitizing dye can be added prior to the completion of silver halide grain precipitation to thereby initiate the spectral sensitization as described in JP-A-58-113928. Further, the above sensitizing dye can be divided prior to addition, that is, part of the sensitizing dye can be added prior to the chemical sensitization with the rest of the sensitizing dye added after the chemical sensitization as taught in U.S. Pat. No. 4,225,666. Still further, the spectral sensitizing dye can be added at any stage during the formation of silver halide grains according to the method disclosed in U.S. Pat. No. 4,183,756 and other methods.

The addition thereof may be set from $4\times10^{-6}$ to $8\times10^{-3}$ mol per mol of silver halide.

The silver halide grain other than the tabular grain used in the lightsensitive material of the invention will be described below.

The preferable silver halide contained in the photographic emulsion layer of the photographic material of the invention is silver iodobromide, silver iodochloride or silver iodochlorobromide containing about 30 mol % or less of silver iodide. Silver iodobromide or silver iodochlorobromide containing about 1 mol % to about 10 mol % of silver iodide is preferable in particular.

The silver halide grains in the photographic emulsion may be those having a regular crystal such as cubic, octahedral and tetradecahedral; those having a regular crystal shape such as sphere and tabular; those having a crystal defect such as twin plane or the like, or a complex shape thereof.

The grain may be a fine grain having a grain seize of about 0.2 $\mu$m or less, and may be a large size grain having a projected area diameter up to about 10 $\mu$m. The emulsion containing the grains may be a polydisperse emulsion or a monodisperse emulsion.

The silver halide photographic emulsion which can be used in the invention can be prepared by, for example, "Research Disclosure (RD) No. 17643 (December in 1978), page 22 to 23", "I. Emulsion Preparation and types", "ibid., No. 18716 (November in 1979), page 648", "ibid., No. 307105 (November in 1989), page 863 to 865", "Chemie et Phisique Photographique" authored by P. Glafkides and published by Paul Montel Co., Ltd. (1967), "Photographic Emulsion Chemistry" authored by G. F. Duffin and published by Forcal Press Co., Ltd. (1966), and "Making and Coating Photographic Emulsion" authored by V. L. Zelikman et al and published by Forcal Press Co., Ltd.

Monodisperse emulsions described in U.S. Pat. Nos. 3,574,628 and 3,655,394, and GB 1,413,748 are preferable.

The crystal structure may be a uniform one, a structure consisting of a halogen composition in which inner part is different from outer part, and a laminar structure. Further, silver halide having a different composition may be joined by epitaxial junction, and may be joined with a compound such as Rodin silver, lead oxide or the like other than silver halide. Further, a mixture of grains having various crystal shapes may be used.

The above-mentioned emulsion may be any one of a surface latent image type in which a latent image is mainly formed on a surface, an internal latent image type in which a latent image is formed in the inside of grains, and a type having latent images both on a surface and in the inside, but requires a negative emulsion. Among the internal latent image types, it may be a core/shell type internal latent image type emulsion described in JP-A-63-264740. The preparation method of the core/shell internal latent image type emulsion is described in JP-A-59-133542. The thickness of the shell of the emulsion differs according to development treatment and the like, but is preferably 3 to 40 nm and preferably 5 to 20 nm in particular.

It is also possible to preferably use surface-fogged silver halide grains described in U.S. Pat. No. 4,082,553, internally fogged silver halide grains described in U.S. Pat. No. 4,626,498 and JP-A-59-214852, and colloidal silver, in lightsensitive silver halide emulsion layers and/or essentially non-lightsensitive hydrophillic colloid layers. The internally fogged or surface-fogged silver halide grains means a silver halide grain which can be developed uniformly (non-imagewise) regardless of whether the location is a non-exposed or an exposed portion of the photosensitive material. A method of preparing the internally fogged or surface-fogged silver halide grain is described in U.S. Pat. No. 4,626,498 and JP-A-59-214852.

A silver halide which forms the core of an internally fogged core/shell type silver halide grain can have the same halogen composition or a different halogen composition. As the silver halide composition of the internally fogged or surface-fogged silver halide grains, any of silver chloride, silver chlorobromide, silver iodobromide and silver chloroiodobromide can be used. Although the grain size of these fogged silver halide grains is not particularly limited, the equivalent-sphere diameter thereof is 0.01 to 0.75 $\mu$m, and especially preferably 0.05 to 0.6 $\mu$m. Further, the grain shape is not specifically limited, and can be a regular grain and a polydisperse emulsion. However, it is preferably a monodisperse, i.e., at least 95% in weight or number of silver halide grains thereof have grain sizes falling within the range of ±40% of the average equivalent-sphere diameter).

The equivalent-sphere average grain size herein means volume-weighted average of equivalent-sphere size of the grains contained in an emulsion. The equivalent-sphere size of a grain means a diameter of the sphere having the same volume as the grain.

In the lightsensitive material of the invention, two or more of emulsions having at least one of different properties of the grain size, grain size distribution, halogen composition, grain shape and sensitivity of the lightsensitive silver halide emulsion can be used in the same layer by mixing.

In the preparation method of the photographic material of the invention, photographically useful substances are usually added to a photographic coating solution, i.e., a hydrophilic colloidal solution.

In silver halide photosensitive emulsion of the invention and the silver halide photographic material in which the emulsion is used, it is generally possible to use various techniques and inorganic and organic materials described in Research Disclosure Nos. 308119 (1989), 37038 (1995), and 40145 (1997).

In addition, techniques and inorganic and organic materials usable in color photosensitive materials of the invention can be applied are described in portions of EP436,938A2 and patents cited below, the disclosures of which are incorporated herein by reference.

| | Items | Corresponding portions |
|---|---|---|
| 1) | Layer configurations | page 146, line 34 to page 147, line 25 |
| 2) | Silver halide emulsions usable together | page 147, line 26 to page 148 line 12 |
| 3) | Yellow couplers usable together | page 137, line 35 to page 146, line 33, and page 149, lines 21 to 23 |
| 4) | Magenta couplers usable together | page 149, lines 24 to 28; EP421, 453A1, page 3, line 5 to page 25, line 55 |
| 5) | Cyan couplers usable together | page 149, lines 29 to 33; EP432, 804A2, page 3, line 28 to page 40, line 2 |

-continued

| | Items | Corresponding portions |
|---|---|---|
| 6) | Polymer couplers | page 149, lines 34 to 38; EP435, 334A2, page 113, line 39 to page 123, line 37 |
| 7) | Colored couplers | page 53, line 42 to page 137, line 34, and page 149, lines 39 to 45 |
| 8) | Functional couplers usable together | page 7, line 1 to page 53, line 41, and page 149, line 46 to page 150, line 3; EP435, 334A2, page 3, line 1 To page 29, line 50 |
| 9) | Antiseptic and mildewproofing agents | page 150, lines 25 to 28 |
| 10) | Formalin scavengers | page 149, lines 15 to 17 |
| 11) | Other additives usable together | page 153, lines 38 to 47; EP421, 453A1, page 75, line 21 to page 84, line 56, and page 27, line 40 to page 37, line 40 |
| 12) | Dispersion methods | page 150, lines 4 to 24 |
| 13) | Supports | page 150, lines 32 to 34 |
| 14) | Film thickness· film physical properties | page 150, lines 35 to 49 |
| 15) | Color development step | page 150, line 50 to page 151, line 47 |
| 16) | Desilvering step | page 151, line 48 to page 152, line 53 |
| 17) | Automatic processor | page 152, line 54 to page 153, line 2 |
| 18) | Washing·stabilizing step | page 153, lines 3 to 37 |

The photographic material of the invention is usually processed with an alkali developing solution containing a developing agent after it is subjected to an image wise exposure. After this color development, the color photographic material is subjected to an image-forming method in which it is processed with a processing solution containing a bleaching agent thereby having a bleaching ability.

EXAMPLE-1

The invention will be specifically described with reference to examples, but the invention is not limited to these.

Preparation of Sample 101

(1) Preparation of Triacetylcellulose Film

Triacetylcellulose was dissolved (13% by weight) by a common solution casting process in dichloromethane/methanol=92/8(weight ratio), and triphenyl phosphate and biphenyldiphenyl phosphate in a weight ratio of 2:1, which are plasticizers, were added to the resultant solution so that the total amount of the plasticizers was 14% to the triacetylcellulose. Then, a triacetylcellulose film was made by a band process. The thickness of the support after drying was 97 μm.

(2) Components of Undercoat Layer

The two surfaces of the triacetylcellulose film were subjected to undercoating treatment. Numbers represent weight contained per 1 liter of an undercoat solution.

The two surfaces of the triacetylcellulose film were subjected to corona discharge treatment before undercoating treatment.

| | | |
|---|---|---|
| Gelatin | 10.0 | g |
| Salicylic acid | 0.5 | g |
| Glycerin | 4.0 | g |
| Acetone | 700 | mL |
| Methanol | 200 | mL |
| Dichloromethane | 80 | mL |
| Formaldehyde | 0.1 | mg |
| Water to make | 1.0 | L |

The under coat solution was coated in an amount of 50 mL per $m^2$ of the support. After the coating, the sample was dried by blowing warm wind at a temperature of 35° C. and humidity of 50% for two minutes, and further blowing dry wing at 100° C. for 20 seconds. Thereafter, the sample was rolled up while the temperature was adjusted to 25° C., then lightsensitive emulsion layers were coated thereto for use.

(3) Coating of Back Layers

One surface of the undercoated support was coated with the following back layers.

| | |
|---|---|
| 1st layer | |
| Binder: acid-processed gelatin (isoelectric point: 9.0) | 1.00 g |
| Polymer latex: P-2 (average grain size: 0.1 μm) | 0.13 g |
| Polymer latex: P-3 (average grain size 0.2 μm) | 0.23 g |
| Ultraviolet absorbent U-1 | 0.030 g |
| Ultraviolet absorbent U-3 | 0.010 g |
| Ultraviolet absorbent U-4 | 0.020 g |
| High-boiling organic solvent Oil-2 | 0.030 g |
| Surfactant W-3 | 0.010 g |
| Surfactant W-6 | 3.0 mg |
| 2nd layer | |
| Binder: acid-processed gelatin (isoelectric point: 9.0) | 3.10 g |
| Polymer latex: P-3 (average grain size: 0.2 μm) | 0.11 g |
| Ultraviolet absorbent U-1 | 0.030 g |
| Ultraviolet absorbent U-3 | 0.010 g |
| Ultraviolet absorbent U-4 | 0.020 g |
| High-boiling organic solvent Oil-2 | 0.030 g |
| Surfactant W-3 | 0.010 g |
| Surfactant W-6 | 3.0 mg |
| Dye D-2 | 0.10 g |
| Dye D-10 | 0.12 g |
| Potassium sulfate | 0.25 g |
| Sodium hydroxide | 0.03 g |
| 3rd layer | |
| Binder: acid-processed gelatin (isoelectric point: 9.0) | 3.30 g |
| Surfactant W-3 | 0.020 g |
| Potassium sulfate | 0.30 g |
| Sodium hydroxide | 0.03 g |
| 4th layer | |
| Binder: lime-processed gelatin (isoelectric point: 5.4) | 1.15 g |
| 1:9 copolymer of methacrylic acid and methylmethacrylate (average grain size: 2.0 μm) | 0.040 g |
| 6:4 copolymer of methacrylic acid and methylmethacrylate (average grain size: 2.0 μm) | 0.030 g |
| Surfactant W-3 | 0.060 g |
| Surfactant W-2 | 7.0 mg |
| Hardener H-1 | 0.23 g |

(4) Coating of Photosensitive Emulsion Layers

Sample 101 was made by coating photosensitive emulsion layers presented below on the side opposite, against the support, to the side having the back layers. Numbers represent addition amounts per $m^2$ of the coating surface. Note that the effects of added compounds are not restricted to the described purposes. Note that each layer was coated with a coating solution that was adjusted to a gelatin concentration in a range of 4 to 11%, and a pH of 5.50 to 8.00. Note that the coating solutions of the 5th to 7th, and 10th to 12th layers which contain the couplers of the invention had a pH in a range of 5.80 to 7.80.

| | | | |
|---|---|---|---|
| 1st layer: Antihalation layer | | | |
| Black colloidal silver | | 0.25 | g |
| Gelatin | | 2.40 | g |
| Ultraviolet absorbent U-1 | | 0.20 | g |
| Ultraviolet absorbent U-3 | | 0.20 | g |
| Ultraviolet absorbent U-4 | | 0.10 | g |
| High-boiling organic solvent Oil-1 | | 0.10 | g |
| High-boiling organic solvent Oil-2 | | 0.10 | g |
| High-boiling organic solvent Oil-5 | | 0.010 | g |
| Dye D-4 | | 1.0 | mg |
| Dye D-8 | | 2.5 | mg |
| Fine crystal solid dispersion of dye E-1 | | 0.05 | g |
| 2nd layer: Interlayer | | | |
| Gelatin | | 0.50 | g |
| Compound Cpd-A | | 0.2 | mg |
| Compound Cpd-K | | 3.0 | mg |
| Compound Cpd-M | | 0.030 | g |
| Ultraviolet absorbent U-6 | | 6.0 | mg |
| High-boiling organic solvent Oil-3 | | 0.010 | g |
| High-boiling organic solvent Oil-4 | | 0.010 | g |
| High-boiling organic solvent Oil-7 | | 2.0 | mg |
| Dye D-7 | | 4.0 | mg |
| 3rd layer: Lightsensitive emulsion layer | | | |
| Emulsion R | silver | 0.4 | g |
| Fine grain silver iodide emulsion (cubic, equivalent-sphere average grain size: 0.05 $\mu$m) | silver | 0.020 | g |
| Gelatin | | 0.8 | g |
| Compound Cpd-M | | 0.10 | g |
| Compound Cpd-K | | 2.0 | mg |
| High-boiling organic solvent Oil-6 | | 0.10 | g |
| Ultraviolet absorbent U-1 | | 0.10 | g |
| 4th layer: Interlayer | | | |
| Gelatin | | 0.8 | g |
| Compound Cpd-M | | 0.080 | g |
| Compound Cpd-D | | 0.020 | g |
| High-boiling organic solvent Oil-6 | | 0.050 | g |
| High-boiling organic solvent Oil-3 | | 0.010 | g |
| 5th layer: Low-speed red-sensitive emulsion layer | | | |
| Emulsion A | silver | 0.10 | g |
| Emulsion B | silver | 0.20 | g |
| Emulsion C | silver | 0.20 | g |
| Silver iodobromide emulsion whose surface and interior are previously fogged (cubic, average silver iodide content: 1 mol %, equivalent-sphere average grain size: 0.06 $\mu$m) | silver | 0.010 | g |
| Gelatin | | 0.70 | g |
| Coupler CC-1 | | 0.040 | g |
| Coupler CC-2 | | 0.070 | g |
| Coupler C-6 | | 6.0 | mg |
| Coupler C-9 | | 5.0 | mg |
| Coupler C-10 | | 0.020 | g |
| Ultraviolet absorbent U-3 | | 0.010 | g |
| Compound Cpd-A | | 1.0 | mg |
| Compound Cpd-I | | 0.020 | g |
| Compound Cpd-J | | 2.0 | mg |

-continued

| | | | |
|---|---|---|---|
| High-boiling organic solvent Oil-2 | | 0.050 | g |
| Additive P-1 | | 0.020 | g |
| 6th layer: Medium-speed red-sensitive emulsion layer | | | |
| Emulsion C | silver | 0.30 | g |
| Emulsion D | silver | 0.25 | g |
| Silver bromide emulsion only whose interior is previously fogged (cubic, equivalent-sphere average grain size: 0.08 $\mu$m) | silver | 0.010 | g |
| Gelatin | | 1.00 | g |
| Coupler CC-1 | | 0.10 | g |
| Coupler CC-2 | | 0.050 | g |
| Coupler C-1 | | 0.005 | g |
| Coupler C-6 | | 7.0 | mg |
| Coupler C-10 | | 0.030 | g |
| Ultraviolet absorbent U-3 | | 0.010 | g |
| High-boiling organic solvent Oil-2 | | 0.070 | g |
| Additive P-1 | | 0.020 | g |
| 7th layer: High-speed red-sensitive emulsion layer | | | |
| Emulsion E | silver | 0.20 | g |
| Emulsion F | silver | 0.30 | g |
| Gelatin | | 1.70 | g |
| Coupler CC-1 | | 0.020 | g |
| Coupler CC-2 | | 0.010 | g |
| Coupler C-3 | | 0.60 | g |
| Coupler C-6 | | 0.010 | g |
| Coupler C-10 | | 0.20 | g |
| Coupler C-11 | | 0.05 | g |
| Ultraviolet absorbent U-1 | | 0.010 | g |
| Ultraviolet absorbent U-2 | | 0.010 | g |
| High-boiling organic solvent Oil-2 | | 0.030 | g |
| High-boiling organic solvent Oil-9 | | 0.010 | g |
| Compound Cpd-D | | 5.0 | mg |
| Compound Cpd-K | | 1.0 | mg |
| Compound Cpd-L | | 1.0 | mg |
| Compound Cpd-F | | 0.030 | g |
| Additive P-1 | | 0.10 | g |
| 8th layer: Interlayer | | | |
| Gelatin | | 1.00 | g |
| Additive P-2 | | 0.10 | g |
| Compound Cpd-I | | 0.010 | g |
| Dye D-5 | | 0.020 | g |
| Dye D-9 | | 6.0 | mg |
| Compound Cpd-M | | 0.040 | g |
| Compound Cpd-O | | 3.0 | mg |
| Compound Cpd-P | | 5.0 | mg |
| High-boiling organic solvent Oil-6 | | 0.050 | g |
| 9th layer: Interlayer | | | |
| Yellow colloidal silver | silver | 0.020 | g |
| Gelatin | | 1.20 | g |
| Additive P-2 | | 0.05 | g |
| Ultraviolet absorbent U-1 | | 0.010 | g |
| Ultraviolet absorbent U-3 | | 0.010 | g |
| Compound Cpd-A | | 0.050 | g |
| Compound Cpd-D | | 0.030 | g |
| Compound Cpd-M | | 0.050 | g |
| High-boiling organic solvent Oil-3 | | 0.010 | g |
| High-boiling organic solvent Oil-6 | | 0.050 | g |
| 10th layer: Low-speed green-sensitive emulsion layer | | | |
| Emulsion G | silver | 0.20 | g |
| Emulsion H | silver | 0.35 | g |
| Emulsion I | silver | 0.35 | g |
| Gelatin | | 1.70 | g |
| Coupler MC-7 | | 0.13 | g |
| Coupler MC-8 | | 0.070 | g |
| Coupler MC-11 | | 0.010 | g |
| Coupler C-2 | | 0.007 | g |
| Compound Cpd-B | | 0.030 | g |
| Compound Cpd-D | | 5.0 | mg |
| Compound Cpd-E | | 5.0 | mg |
| Compound Cpd-G | | 2.5 | mg |
| Compound Cpd-F | | 0.010 | g |
| Compound Cpd-K | | 2.0 | mg |

-continued

| | | |
|---|---|---|
| Ultraviolet absorbent U-6 | | 5.0 mg |
| High-boiling organic solvent Oil-2 | | 0.10 g |
| High-boiling organic solvent Oil-6 | | 0.030 g |
| High-boiling organic solvent Oil-4 | | 8.0 mg |
| 11th layer: Medium-speed green-sensitive emulsion layer | | |
| Emulsion I | silver | 0.20 g |
| Emulsion J | silver | 0.30 g |
| Silver bromide emulsion only whose interior is previously fogged (cubic, equivalent-sphere average grain size: 0.11 μm) | silver | 5.0 mg |
| Gelatin | | 0.70 g |
| Coupler MC-4 | | 0.40 g |
| Coupler MC-8 | | 0.020 g |
| Coupler MC-11 | | 0.010 g |
| Coupler C-5 | | 0.002 g |
| Compound Cpd-B | | 0.030 g |
| Compound Cpd-F | | 0.010 g |
| Compound Cpd-G | | 2.0 mg |
| High-boiling organic solvent Oil-2 | | 0.050 g |
| High-boiling organic solvent Oil-5 | | 6.0 mg |
| 12th layer: High-speed green-sensitive emulsion layer | | |
| Emulsion K | silver | 0.65 g |
| Gelatin | | 0.70 g |
| Coupler MC-3 | | 5.0 mg |
| Coupler MC-4 | | 0.50 g |
| Coupler MC-8 | | 0.010 g |
| Coupler C-4 | | 0.003 g |
| Compound Cpd-B | | 0.050 g |
| Compound Cpd-F | | 0.010 g |
| Compound Cpd-K | | 2.0 mg |
| High-boiling organic solvent Oil-2 | | 0.050 g |
| High-boiling organic solvent Oil-8 | | 0.010 g |
| 13th layer: Yellow filter layer | | |
| Gelatin | | 1.20 g |
| Compound Cpd-C | | 0.010 g |
| Compound Cpd-M | | 0.10 g |
| High-boiling organic solvent Oil-1 | | 0.020 g |
| High-boiling organic solvent Oil-6 | | 0.10 g |
| Fine crystal solid dispersion of dye E-2 | | 0.20 g |
| Dye D-6 | | 5.0 mg |
| P-4 | | 3.0 mg |
| 14th layer: Lightsensitive emulsion layer | | |
| Emulsion S | silver | 0.20 g |
| Gelatin | | 0.80 g |
| Coupler C-3 | | 0.010 g |
| Compound Cpd-A | | 0.10 g |
| Compound Cpd-M | | 0.10 g |
| High-boiling organic solvent Oil-3 | | 0.15 g |
| 15th layer: Interlayer | | |
| Silver iodide fine grain emulsion (cubic, equivalent-sphere grain size: 0.05 μm) | silver | 0.020 g |
| Gelatin | | 0.40 g |
| Compound Cpd-Q | | 0.20 g |
| 16th layer: Low-speed blue-sensitive emulsion layer | | |
| Emulsion L | silver | 0.15 g |
| Emulsion M | silver | 0.20 g |
| Emulsion N | silver | 0.10 g |
| Gelatin | | 0.80 g |
| Silver iodobromide emulsion whose surface and interior are previously fogged (cubic, average silver iodide content: 1 mol %, equivalent-sphere average grain size: 0.06 μm) | silver | 0.010 mg |
| Coupler C-7 | | 0.001 g |
| Coupler C-8 | | 0.020 g |
| Coupler C-9 | | 0.30 g |
| Coupler C-10 | | 0.005 g |
| Compound Cpd-B | | 0.10 g |
| Compound Cpd-I | | 8.0 mg |
| Compound Cpd-K | | 1.0 mg |

-continued

| | | |
|---|---|---|
| Compound Cpd-M | | 0.010 g |
| Ultraviolet absorbent U-6 | | 0.010 g |
| High-boiling organic solvent Oil-2 | | 0.010 g |
| 17th layer: Medium-speed blue-sensitive emulsion layer | | |
| Emulsion N | silver | 0.20 g |
| Emulsion O | silver | 0.20 g |
| Silver bromide emulsion whose interior is fogged (cubic, equivalent-sphere average grain size: 0.11 μm) | silver | 3.0 mg |
| Gelatin | | 0.90 g |
| Coupler C-3 | | 0.002 g |
| Coupler C-8 | | 0.020 g |
| Coupler C-9 | | 0.25 g |
| Coupler C-10 | | 0.010 g |
| Compound Cpd-B | | 0.10 g |
| Compound Cpd-N | | 2.0 mg |
| High-boiling organic solvent Oil-2 | | 0.010 g |
| 18th layer: High-speed blue-sensitive emulsion layer | | |
| Emulsion P | silver | 0.20 g |
| Emulsion Q | silver | 0.25 g |
| Gelatin | | 2.00 g |
| Coupler C-3 | | 5.0 mg |
| Coupler C-8 | | 0.05 g |
| Coupler C-9 | | 1.20 g |
| Coupler C-10 | | 0.03 g |
| High-boiling organic solvent Oil-2 | | 0.10 g |
| High-boiling organic solvent Oil-3 | | 0.020 g |
| Ultraviolet absorbent U-6 | | 0.10 g |
| Compound Cpd-B | | 0.20 g |
| Compound Cpd-N | | 5.0 mg |
| 19th layer: 1st protective layer | | |
| Gelatin | | 1.00 g |
| Ultraviolet absorbent U-1 | | 0.15 g |
| Ultraviolet absorbent U-2 | | 0.050 g |
| Ultraviolet absorbent U-5 | | 0.20 g |
| Compound Cpd-O | | 5.0 mg |
| Compound Cpd-A | | 0.030 g |
| Compound Cpd-H | | 0.20 g |
| Dye D-1 | | 8.0 mg |
| Dye D-2 | | 0.010 g |
| Dye D-3 | | 0.010 g |
| High-boiling organic solvent Oil-3 | | 0.10 g |
| 20th layer: 2nd protective layer | | |
| Colloidal silver | silver | 2.5 mg |
| Fine grain silver iodobromide emulsion (average silver iodide content: 1 mol %, equivalent-sphere average grain diameter 0.06 μm) | silver | 0.10 g |
| Gelatin | | 0.80 g |
| Ultraviolet absorbent U-1 | | 0.030 g |
| Ultraviolet absorbent U-6 | | 0.030 g |
| High-boiling organic solvent Oil-3 | | 0.010 g |
| 21st layer: 3rd protective layer | | |
| Gelatin | | 1.20 g |
| Polymethylmethacrylate (average grain size 1.5 μm) | | 0.10 g |
| 6:4 copolymer of methylmethacrylate and methacrylic acid (average grain size 1.5 μm) | | 0.15 g |
| Silicone oil SO-1 | | 0.20 g |
| Surfactant W-1 | | 3.0 mg |
| Surfactant W-2 | | 8.0 mg |
| Surfactant W-3 | | 0.040 g |
| Surfactant W-7 | | 0.015 g |

In addition to the above compositions, additives F-1 to F-9 were added to all emulsion layers. Also, a gelatin hardener H-1 and surfactants W-3, W-4, W-5, and W-6 for coating and emulsification were added to each layer.

Furthermore, phenol, 1,2-benzisothiazoline-3-one, 2-phenoxyethanol, phenethylalcohol, and butyl p-benzoic acid ester were added as antiseptic and mildewproofing agents.

TABLE 1

Silver halide emulsions used in Sample 101

| Emulsion | Characteristics | Av. ESD (μm) | COV (%) | Av. AgI content (mol %) | Structure in halide composition of silver halide grains | AgI content at grain surface (mol %) | Other characteristics (1) | (2) | (3) | (4) | (5) |
|---|---|---|---|---|---|---|---|---|---|---|---|
| A | Monodispersed tetradecahedral grains | 0.24 | 9 | 3.5 | Triple structure | 1.5 | | ○ | | | |
| B | Monodispersed (111) tabular grains Av. aspect ratio 2.0 | 0.25 | 10 | 3.5 | Quadruple structure | 1.5 | ○ | | ○ | ○ | ○ |
| C | Monodispersed (111) tabular grains Av. aspect ratio 2.0 | 0.30 | 19 | 3.0 | Triple structure | 0.1 | ○ | ○ | | ○ | ○ |
| D | Monodispersed (111) tabular grains Av. aspect ratio 3.0 | 0.35 | 21 | 4.8 | Triple structure | 2.0 | ○ | ○ | | ○ | ○ |
| E | Monodispersed (111) tabular grains Av. aspect ratio 3.0 | 0.40 | 10 | 2.0 | Quadruple structure | 1.5 | | ○ | | | |
| F | Monodispersed (111) tabular grains Av. aspect ratio 4.5 | 0.55 | 12 | 1.6 | Triple structure | 0.6 | ○ | ○ | | | ○ |
| G | Monodispersed cubic grains | 0.15 | 9 | 2.5 | Quadruple structure | 2.0 | | | ○ | | |
| H | Monodispersed cubic grains | 0.24 | 12 | 4.9 | Quadruple structure | 0.1 | ○ | ○ | | ○ | |
| I | Monodispersed (111) tabular grains Av. aspect ratio 4.0 | 0.30 | 12 | 3.5 | Quintuple structure | 4.5 | ○ | ○ | | ○ | ○ |
| J | Monodispersed (111) tabular grains Av. aspect ratio 5.0 | 0.45 | 21 | 3.0 | Quadruple structure | 0.2 | ○ | ○ | | ○ | ○ |
| K | Monodispersed (111) tabular grains Av. aspect ratio 5.5 | 0.60 | 13 | 2.7 | Triple structure | 1.3 | ○ | ○ | | | ○ |
| L | Monodispersed (111) tabular grains Av. aspect ratio 3.5 | 0.31 | 14 | 3.5 | Triple structure | 2.4 | | | ○ | ○ | ○ |
| M | Monodispersed (111) tabular grains Av. aspect ratio 3.5 | 0.31 | 14 | 3.5 | Triple structure | 2.3 | ○ | ○ | | ○ | ○ |
| N | Monodispersed (111) tabular grains Av. aspect ratio 5.0 | 0.33 | 13 | 2.1 | Quadruple structure | 4.0 | ○ | ○ | ○ | | |
| O | Monodispersed (111) tabular grains Av. aspect ratio 3.0 | 0.43 | 9 | 2.5 | Quadruple structure | 1.0 | ○ | ○ | | ○ | ○ |
| P | Monodispersed (111) tabular grains Av. aspect ratio 6.0 | 0.75 | 21 | 2.8 | Triple structure | 0.5 | ○ | ○ | | | ○ |
| Q | Monodispersed (111) tabular grains Av. aspect ratio 6.0 | 0.90 | 8 | 1.0 | Quadruple structure | 0.5 | ○ | ○ | | | ○ |
| R | Monodispersed (111) tabular grains Av. aspect ratio 7.0 | 0.60 | 9 | 10.0 | Quadruple structure | 1.5 | | | | | ○ |

TABLE 1-continued

Silver halide emulsions used in Sample 101

| Emulsion | Characteristics | Av. ESD (μm) | COV (%) | Av. AgI content (mol %) | Structure in halide composition of silver halide grains | AgI content at grain surface (mol %) | Other characteristics (1) | (2) | (3) | (4) | (5) |
|---|---|---|---|---|---|---|---|---|---|---|---|
| S | Monodispersed (111) tabular grains Av. aspect ratio 12.0 | 0.70 | 10 | 12.0 | Quadruple structure | 1.3 | | | ○ | | ○ |

Av. ESD = Equivalent-sphere average grain size; COV = Coefficient of variation
(Other characteristics)
The mark "○" means each of the conditions set forth below is satisfied.
(1) A reduction sensitizer was added during grain formation;
(2) A selenium sensitizer was used as an after-ripening agent
(3) A rhodium salt was added during grain formation.
(4) A shell was provided subsequent to after-ripening by using silver nitrate in an amount of 10%, in terms of silver molar ratio, of the emulsion grains at that time, together with the equimolar amount of potassium bromide
(5) The presence of dislocation lines in an average number of ten or more per grain was observed by a transmission electron microscope.
Note that all the lightsensitive emulsion were after-ripped by the use of sodium thiosulfate, sodium thiocyanate, and sodium aurichloride. Note, also, a iridium salt was added during grain formation.
Note, also, that chemically-modified gelatin whose amino groups were partially converted to phthalic acid amide, was added to emulsions B, C, E, H, J, N, and Q.

TABLE 2

Spectral sensitizing method of Emulsions A to S

| Emulsion | Spectral sensitizing dye added | Addition amount per mol of silver halide (g) | Timing at which the sensitizing dye was added |
|---|---|---|---|
| A | S-1 | 0.01 | Subsequent to after-ripening |
| | S-2 | 0.10 | Prior to after-ripening |
| | S-8 | 0.03 | Prior to after-ripening |
| | S-13 | 0.015 | Prior to after-ripening |
| | S-14 | 0.01 | Prior to after-ripening |
| | S-17 | 0.12 | Prior to after-ripening |
| | S-18 | 0.20 | Prior to after-ripening |
| B | S-2 | 0.14 | Prior to after-ripening |
| | S-3 | 0.02 | Prior to after-ripening |
| | S-8 | 0.03 | Prior to after-ripening |
| | S-13 | 0.015 | Prior to after-ripening |
| | S-14 | 0.01 | Prior to after-ripening |
| | S-17 | 0.15 | Prior to after-ripening |
| | S-18 | 0.01 | Prior to after-ripening |
| C | S-2 | 0.45 | Prior to after-ripening |
| | S-18 | 0.04 | Prior to after-ripening |
| | S-13 | 0.02 | Prior to after-ripening |
| D | S-2 | 0.5 | Subsequent to after-ripening |
| | S-17 | 0.15 | Subsequent to after-ripening |
| | S-8 | 0.05 | Prior to after-ripening |
| | S-13 | 0.015 | Prior to after-ripening |
| E | S-1 | 0.01 | Prior to after-ripening |
| | S-2 | 0.45 | Prior to after-ripening |
| | S-8 | 0.05 | Prior to after-ripening |
| | S-13 | 0.01 | Subsequent to after-ripening |
| F | S-17 | 0.4 | Prior to after-ripening |
| | S-3 | 0.04 | Prior to after-ripening |
| | S-18 | 0.10 | Prior to after-ripening |
| G | S-4 | 0.3 | Subsequent to after-ripening |
| | S-5 | 0.05 | Subsequent to after-ripening |
| | S-12 | 0.1 | Subsequent to after-ripening |
| H | S-4 | 0.2 | Prior to after-ripening |
| | S-5 | 0.05 | Subsequent to after-ripening |
| | S-9 | 0.15 | Prior to after-ripening |
| | S-14 | 0.02 | Subsequent to after-ripening |
| I | S-4 | 0.3 | Prior to after-ripening |
| | S-9 | 0.2 | Prior to after-ripening |
| | S-12 | 0.1 | Prior to after-ripening |
| J | S-4 | 0.35 | Prior to after-ripening |
| | S-5 | 0.05 | Subsequent to after-ripening |
| | S-12 | 0.1 | Prior to after-ripening |

TABLE 2-continued

Spectral sensitizing method of Emulsions A to S

| Emulsion | Spectral sensitizing dye added | Addition amount per mol of silver halide (g) | Timing at which the sensitizing dye was added |
|---|---|---|---|
| K | S-4 | 0.3 | Prior to after-ripening |
| | S-9 | 0.05 | Prior to after-ripening |
| | S-12 | 0.1 | Prior to after-ripening |
| | S-14 | 0.02 | Prior to after-ripening |
| L, M | S-6 | 0.1 | Subsequent to after-ripening |
| | S-10 | 0.2 | Subsequent to after-ripening |
| | S-11 | 0.05 | Subsequent to after-ripening |
| N | S-6 | 0.05 | Subsequent to after-ripening |
| | S-7 | 0.05 | Subsequent to after-ripening |
| | S-10 | 0.25 | Subsequent to after-ripening |
| | S-11 | 0.05 | Subsequent to after-ripening |
| O | S-10 | 0.4 | Subsequent to after-ripening |
| | S-11 | 0.15 | Subsequent to after-ripening |
| | S-16 | 0.15 | Subsequent to after-ripening |
| P | S-4 | 0.01 | Subsequent to after-ripening |
| | S-6 | 0.05 | Subsequent to after-ripening |
| | S-7 | 0.05 | Subsequent to after-ripening |
| | S-10 | 0.3 | Prior to after-ripening |
| | S-11 | 0.1 | Prior to after-ripening |
| Q | S-1 | 0.01 | Prior to after-ripening |
| | S-4 | 0.02 | Prior to after-ripening |
| | S-6 | 0.05 | Prior to after-ripening |
| | S-7 | 0.05 | Prior to after-ripening |
| | S-10 | 0.2 | Prior to after-ripening |
| | S-11 | 0.25 | Prior to after-ripening |
| R | S-1 | 0.40 | Prior to after-ripening |
| | S-12 | 0.05 | Prior to after-ripening |
| | S-15 | 0.15 | Prior to after-ripening |
| S | S-16 | 0.35 | Prior to after-ripening |

C-1

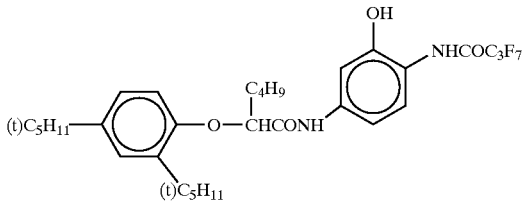

C-2

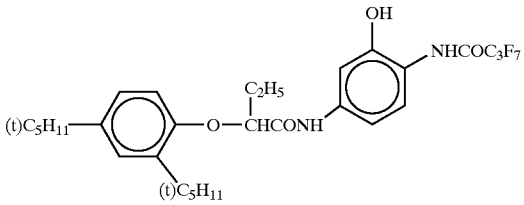

C-3

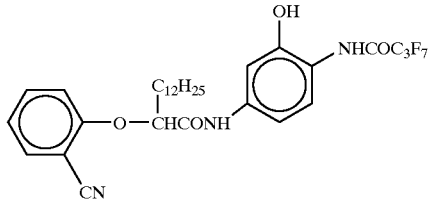

C-4

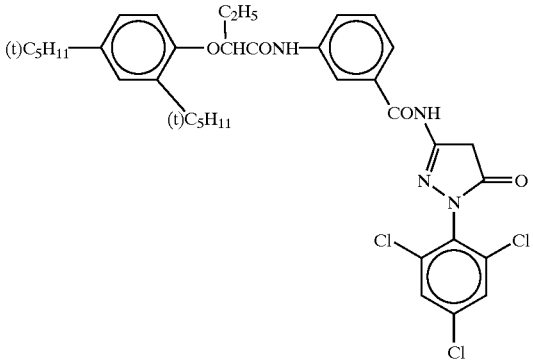

-continued
C-5
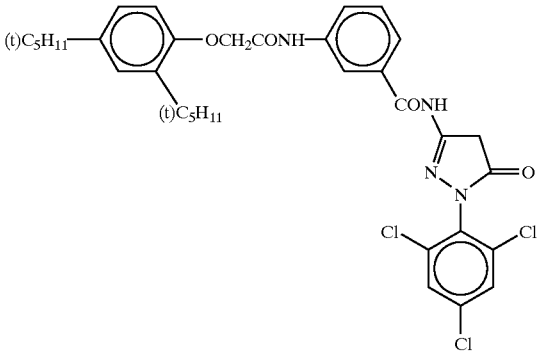
C-6
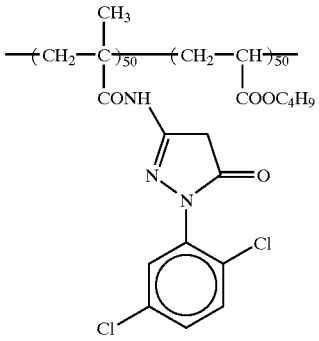
The numbers are in weight %
Average mol. weight: about 25,00
C-7
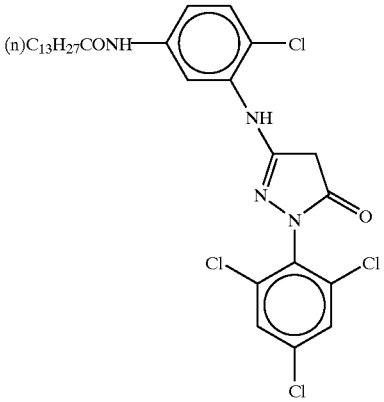
C-8
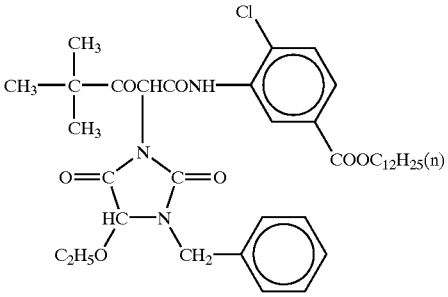
C-9
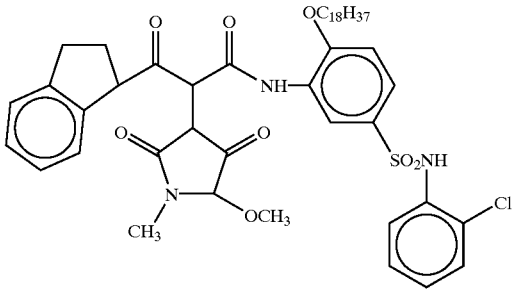
C-10
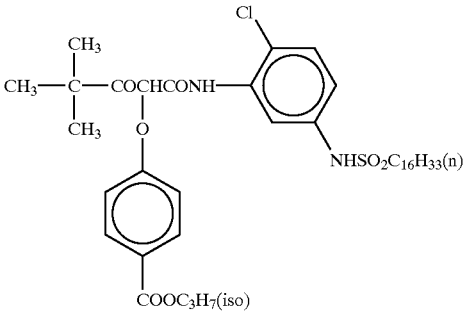
C-11
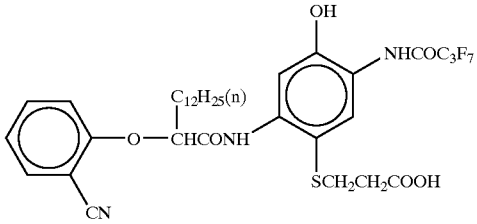
Oil-1
Tri-n-hexyl phosphate
Oil-2
Tricresyl phosphate
Oil-3
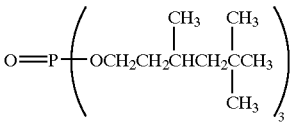
Oil-4
Tricyclohexyl phosphate
Oil-5
Bis(2-ethylhexho) succinate -continued
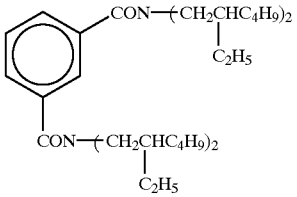
Oil-6
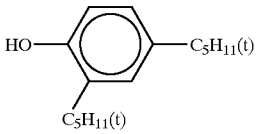
Oil-7
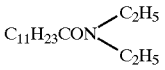
Oil-8
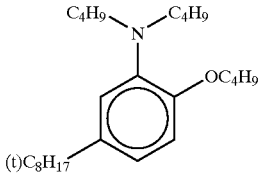
Oil-9
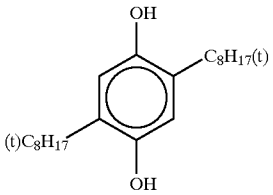
Cpd-A
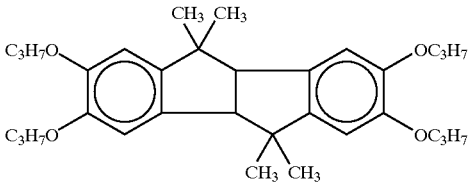
Cpd-B
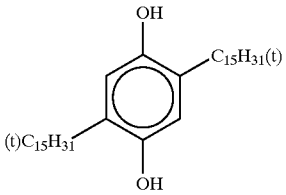
Cpd-C
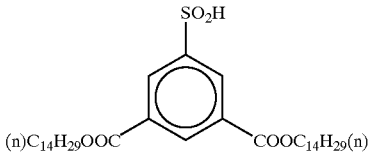
Cpd-D
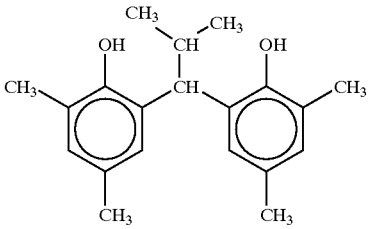
Cpd-E
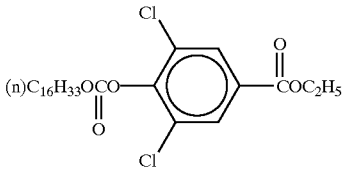
Cpd-F
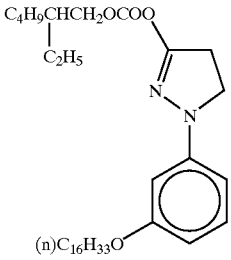
Cpd-G
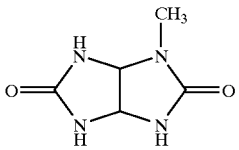
Cpd-H
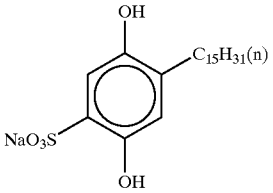
Cpd-I
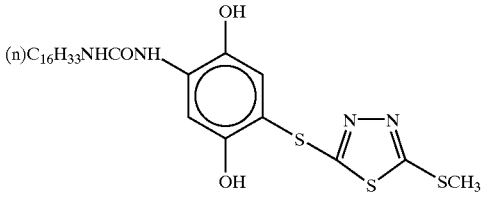
Cpd-J -continued
Cpd-K
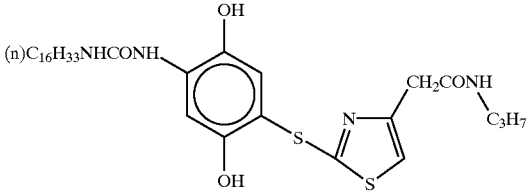
Cpd-L
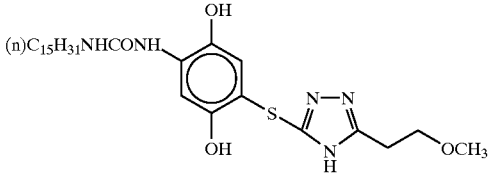
Cpd-M
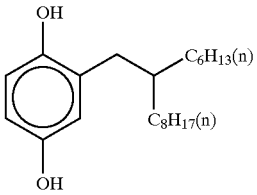
Cpd-N
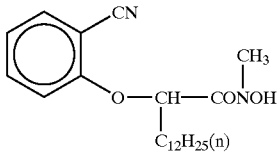
Cpd-O
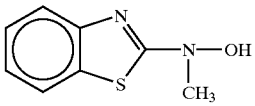
Cpd-P
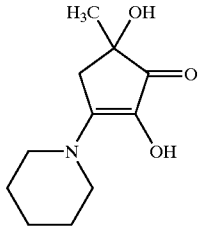
Cpd-Q
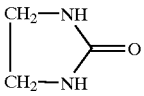
U-1
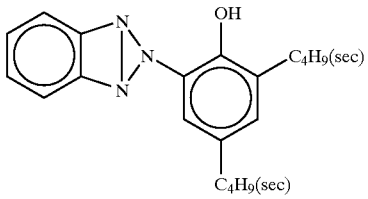
U-2
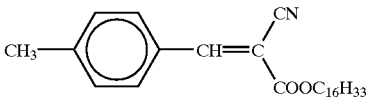
U-3
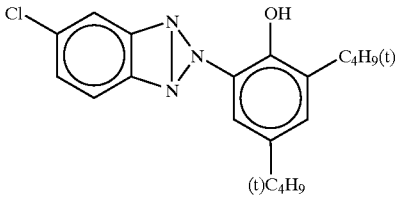
U-4
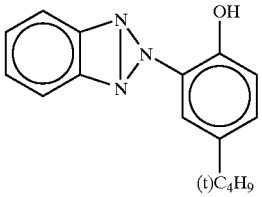
U-5
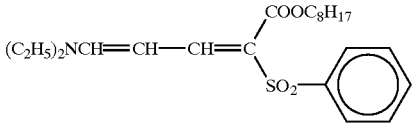
U-6
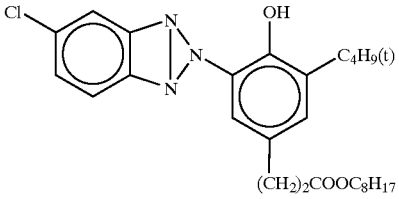
S-1
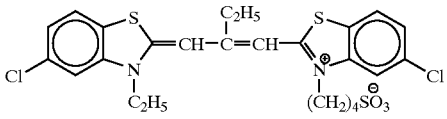

-continued
S-2
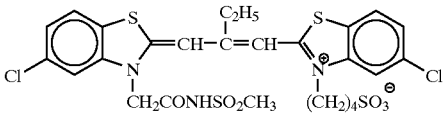
S-3
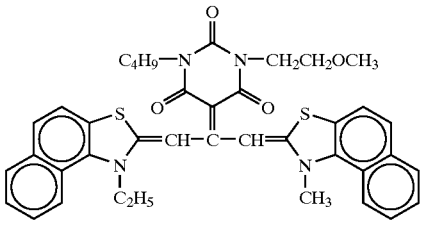
S-4
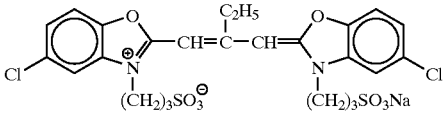
S-5
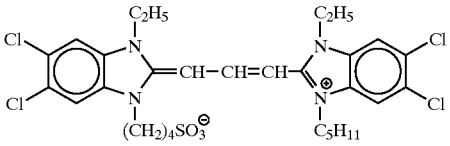
S-6
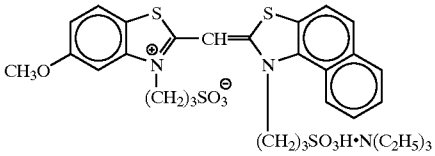
S-7
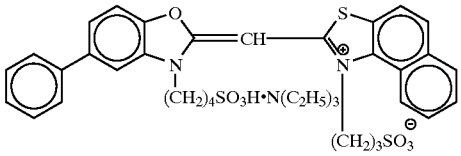
S-8
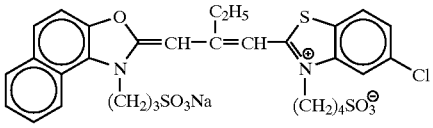
S-9
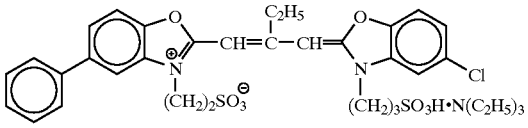
S-10
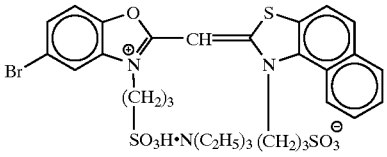
S-11
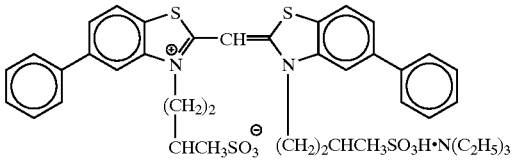
S-12
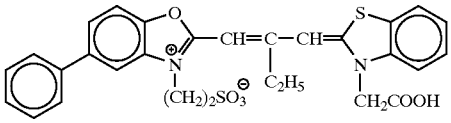
S-13
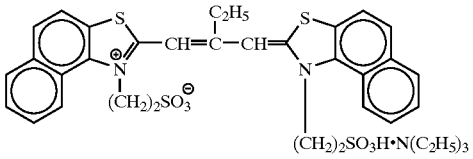
S-14
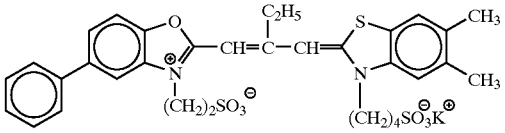
S-15
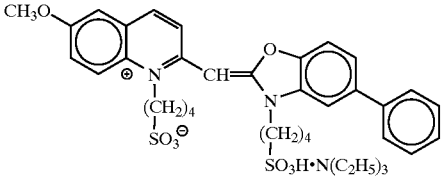
S-16
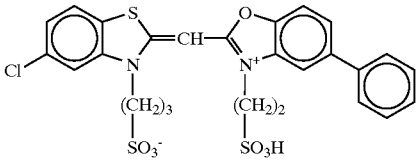
S-17
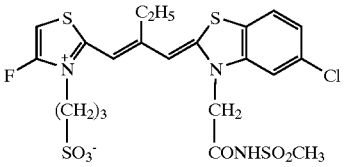

-continued
S-18
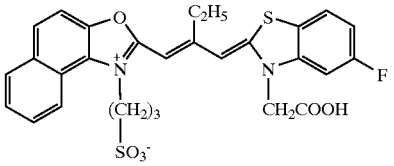
D-1
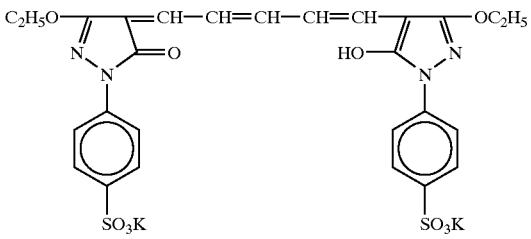
D-2
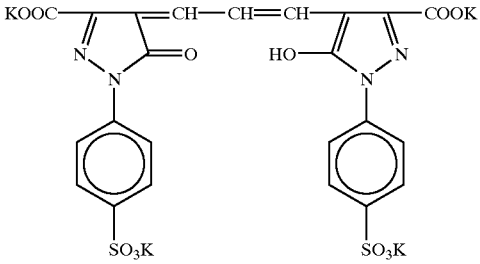
D-3
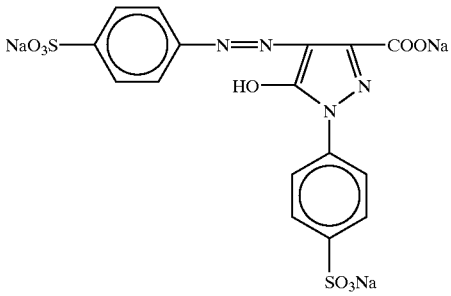
D-4
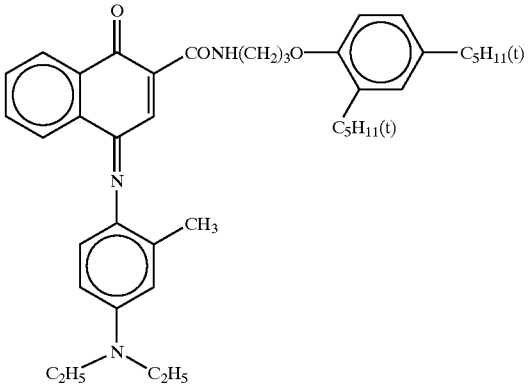
D-5
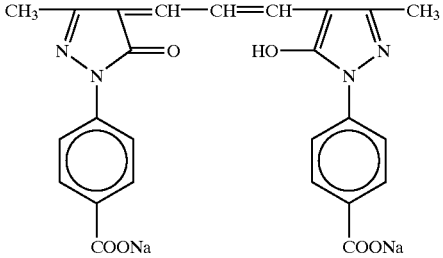
D-6
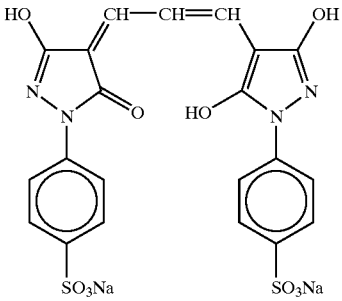
D-7
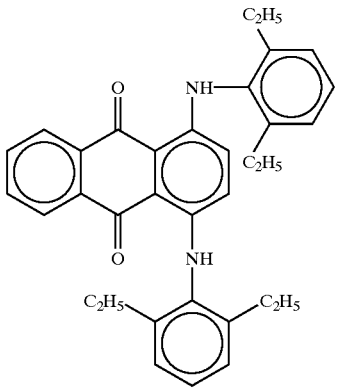
D-8
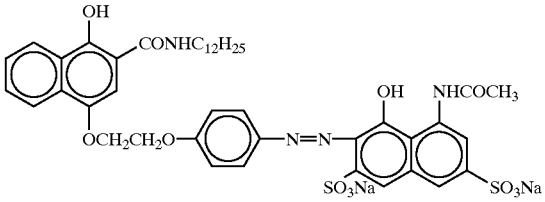
D-9
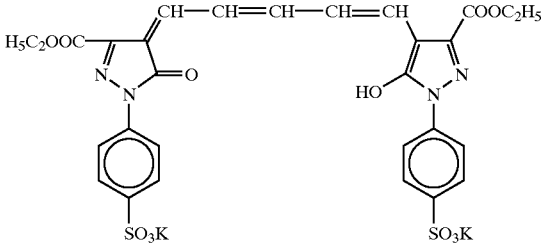

-continued
D-10
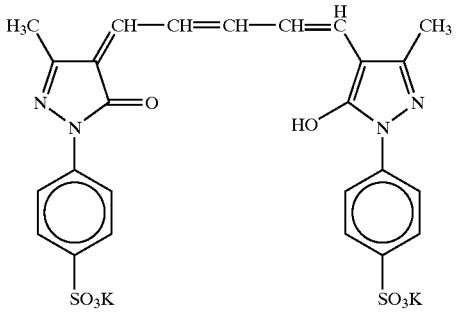
E-1
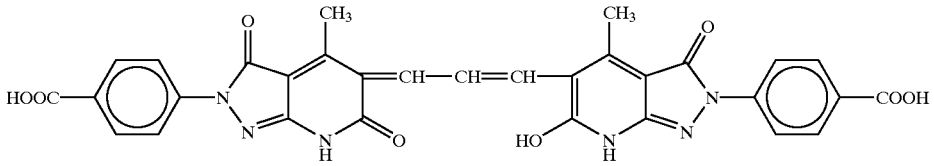
E-2
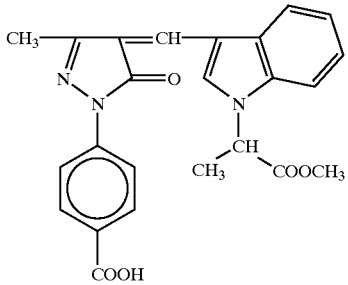
H-1
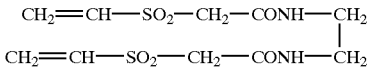
W-1
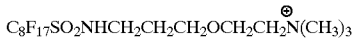
W-2
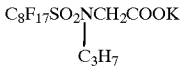
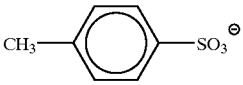
W-3
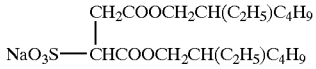
W-4
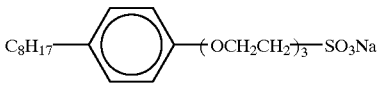
W-5
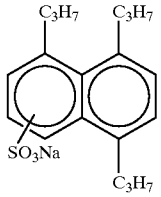
W-6
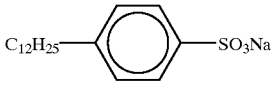
$C_8F_{17}SO_3Li$
W-7
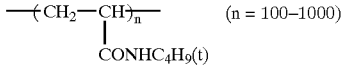
(n = 100–1000)
P-1

-continued
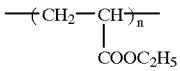
(n = 100–1000)
P-2
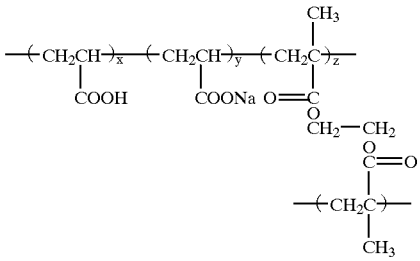
x:y:z = 42.5:7.5:50
P-3
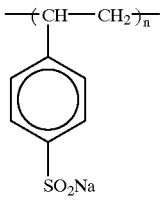
(n = 100–1000)
P-4
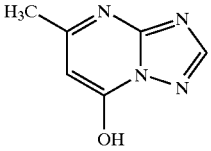
F-1
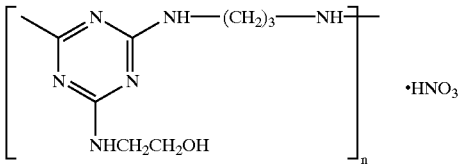
(n = 3–4)
F-2
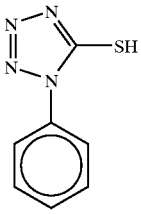
F-3
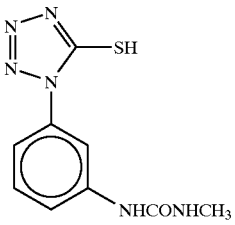
F-4
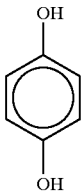
F-5
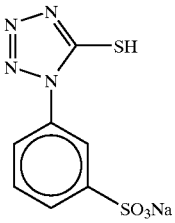
F-6
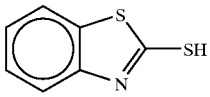
F-7
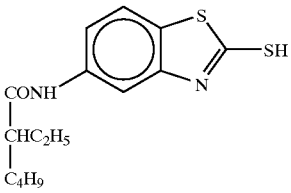
F-8
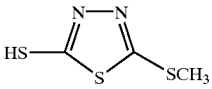
F-9

-continued

SO-1

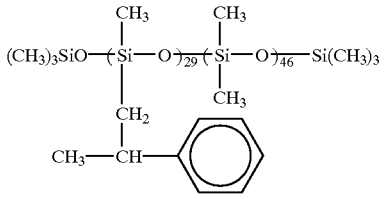

Preparation of Fine Crystalline Solid Dispersion of Organic Solid Disperse Dyes (Preparation of Fine Crystalline Solid Dispersion of Dye E-1)

100 g of Pluronic F88 (an ethylene oxide-propylene oxide block copolymer) manufactured by BASF CORP. and water were added to a wet cake of the dye E-1 (the net weight of E-1 was 270 g), and the resultant material was stirred to make 4,000 g. Next, the Ultra Visco Mill (UVM-2) manufactured by Imex K.K. was filled with 1,700 mL of zirconia beads with an average grain size of 0.5 mm, and the slurry was milled through this UVM-2 at a peripheral speed of approximately 10 m/sec and a discharge rate of 0.5 L/min for 2 hr. The beads were filtered out, and water was added to dilute the material to a dye concentration of 3%. After that, the material was heated to 90° C. for 10 hr for stabilization. The average grain size of the obtained fine dye grains was 0.30 $\mu$m, and the grain size distribution (grain size standard deviation×100/average grain size) was 20%.

(Preparation of Fine Crystalline Solid Dispersion of Dye E-2)

Water and 270 g of W-4 were added to 1,400 g of a wet cake of E-2 containing 30 weight % of water, and the resultant material was stirred to form a slurry having an E-2 concentration of 40 weight %. Next, the Ultra Visco Mill (UVM-2) manufactured by Imex K.K. was filled with 1,700 mL of zirconia beads with an average grain size of 0.5 mm, and the slurry was milled through this UVM-2 at a peripheral speed of approximately 10 m/sec and a discharge rate of 0.5 L/min for 8 hr, thereby obtaining a solid fine-grain dispersion of E-2. This dispersion was diluted to 20 weight % by ion exchange water to obtain a fine crystalline solid dispersion. The average grain size was 0.15 $\mu$m.

In this example, development processing steps (Development processing A) set forth below was performed. In the running processing, Sample 101 before exposure to light and the same sample after full exposure to light in a ratio of 1:1 were processed until the accumulated replenisher amount of each solution was four times the tank volume.

| Processing Step | Time | Temperature | Tank volume | Replenishment rate |
|---|---|---|---|---|
| 1st development | 6 min | 38° C. | 37 L | 2,200 mL/m$^2$ |
| 1st washing | 2 min | 38° C. | 16 L | 4,000 mL/m$^2$ |
| Reversal | 2 min | 38° C. | 17 L | 1,100 mL/m$^2$ |
| Color development | 6 min | 38° C. | 30 L | 2,200 mL/m$^2$ |
| Pre-bleaching | 2 min | 38° C. | 19 L | 1,100 mL/m$^2$ |
| Bleaching | 6 min | 38° C. | 30 L | 220 mL/m$^2$ |
| Fixing | 4 min | 38° C. | 29 L | 1,100 mL/m$^2$ |
| 2nd washing | 4 min | 38° C. | 35 L | 4,000 mL/m$^2$ |
| Final rinsing | 1 min | 25° C. | 19 L | 1,100 mL/m$^2$ |

The compositions of the respective solution are as follows:

| <1st developer> | <Tank solution> | <Replenisher> |
|---|---|---|
| Nitrilo-N,N,N-trimethylene phosphonic acid · pentasodium salt | 1.5 g | 1.5 g |
| Diethylenetriamine pentaacetic acid · pentasodium salt | 2.0 g | 2.0 g |
| Sodium sulfite | 30 g | 30 g |
| Hydroquinone · potassium monosulfonate | 20 g | 20 g |
| Potassium carbonate | 15 g | 20 g |
| Potassium bicarbonate | 12 g | 15 g |
| 1-phenyl-4-methyl-4-hydroxymethyl-3-pyrazolidone | 2.5 g | 3.0 g |
| Potassium bromide | 2.5 g | 1.4 g |
| Potassium thiocyanate | 1.2 g | 1.2 g |
| Potassium iodide | 2.0 mg | — |
| Diethyleneglycol | 13 g | 15 g |
| Water to make | 1,000 mL | 1,000 mL |
| pH | 9.60 | 9.60 |

The pH was adjusted by sulfuric acid or potassium hydroxide.

| <Reversal solution> | <Tank solution> | <Replenisher> |
|---|---|---|
| Nitrilo-N,N,N-trimethylene phosphonic acid · pentasodium salt | 3.0 g | the same as tank solution |
| Stannous chloride · dihydrate | 1.0 g | |
| p-aminophenol | 0.1 g | |
| Sodium hydroxide | 8 g | |
| Glacial acetic acid | 15 mL | |
| Water to make | 1,000 mL | |
| pH | 6.00 | |

The pH was adjusted by acetic acid or sodium hydroxide.

| <Color developer> | <Tank solution> | <Replenisher> |
|---|---|---|
| Nitrilo-N,N,N-trimethylene phosphonic acid · pentasodium salt | 2.0 g | 2.0 g |
| Sodium sulfite | 7.0 g | 7.0 g |
| Trisodium phosphate · dodecahydrate | 36 g | 36 g |
| Potassium bromide | 1.0 g | — |
| Potassium iodide | 90 mg | — |
| Sodium hydroxide | 12.0 g | 12.0 g |
| Citrazinic acid | 0.5 g | 0.5 g |
| N-ethyl-N-(β-methanesulfon amidoethyl)-3-methyl-4 | 10 g | 10 g |

-continued

| <Color developer> | <Tank solution> | <Replenisher> |
|---|---|---|
| aminoaniline · ½ sulfuric acid · monohydrate | | |
| 3,6-dithiaoctane-1,8-diol | 1.0 g | 1.0 g |
| Water to make | 1,000 mL | 1,000 mL |
| pH | 11.80 | 12.00 |

The pH was adjusted by sulfuric acid or potassium hydroxide.

| <Pre-bleaching solution> | <Tank solution> | <Replenisher> |
|---|---|---|
| Ethylenediaminetetraacetic acid · disodium salt · dihydrate | 8.0 g | 8.0 g |
| Sodium sulfite | 6.0 g | 8.0 g |
| 1-thioglycerol | 0.4 g | 0.4 g |
| Formaldehyde sodium bisulfite adduct | 30 g | 35 g |
| Water to make | 1,000 mL | 1,000 mL |
| pH | 6.3 | 6.10 |

The pH was adjusted by acetic acid or sodium hydroxide.

| <Bleaching solution> | <Tank solution> | <Replenisher> |
|---|---|---|
| Ethylenediaminetetraacetic acid · disodium salt · dihydrate | 2.0 g | 4.0 g |
| Ethylenediaminetetraacetic acid · Fe(III) · ammonium · dihydrate | 120 g | 240 g |
| Potassium bromide | 100 g | 200 g |
| Ammonium nitrate | 10 g | 20 g |
| Water to make | 1,000 mL | 1,000 mL |
| pH | 5.70 | 5.50 |

The pH was adjusted by nitric acid or sodium hydroxide.

| <Fixing solution> | <Tank solution> | <Replenisher> |
|---|---|---|
| Ammonium thiosulfate | 80 g | the same as tank solution |
| Sodium sulfite | 5.0 g | |
| Sodium bisulfite | 5.0 g | |
| Water to make | 1,000 mL | |
| pH | 6.60 | |

The pH was adjusted by acetic acid or ammonia water.

| <Stabilizer> | <Tank solution> | <Replenisher> |
|---|---|---|
| 1,2-benzoisothiazoline-3-one | 0.02 g | 0.03 g |
| Polyoxyethylene-p-monononyl phenylether (average polymerization degree = 10) | 0.3 g | 0.3 g |
| Polymaleic acid (average molecular weight = 2,000) | 0.1 g | 0.15 g |
| Water to make | 1,000 mL | 1,000 mL |
| pH | 7.0 | 7.0 |

Note that in the development processing step, the solution of each bath was continuously circulated and stirred, and at the bottom of each tank was provided with a bubbling pipe having small apertures of 0.3 mm diameter in an interval of 1 cm, and nitrogen gas was bubbled through the apertures to stir the solution.

Preparation of Samples 102 to 111

Samples 102 to 111 were prepared in the same manner as that employed in the preparation of sample 101 except changing the spectral sensitivity distribution and the magnitude of the interimage effect through changes in the silver iodide content and the amount of the sensitizing dye in the emulsion used for the preparation of sample 101.

Other physical properties of samples 101 to 111 were within the ranges summarized below.

Swelling ratio: 1.80 to 1.90

Film surface pH: 6.10 to 6.50

ISO sensitivity: 80 to 160 (by development processing A)

ISO sensitivity (when the 1st development in development processing A was extended to 11 minutes): 400 to 600

The spectral sensitivity distribution and the magnitude of the interimage effect of the individual samples are summarized in Table 3.

TABLE 3

| Sample No. | Remarks | λrmax | λgmax | Sr(580) | Sr(λrmax) | Sg(580) | Sg(500) | Sg(λgmax) | IIErg | IIEgr | IIEgb | IIEbg |
|---|---|---|---|---|---|---|---|---|---|---|---|---|
| 101 | Comp. | 660 | 580 | 1.0 | 3.5 | 2.8 | 1.2 | 3.5 | 0.1 | 0.0 | 0.05 | 0.02 |
| 102 | Comp. | 640 | 580 | 2.5 | 3.3 | 2.8 | 1.2 | 3.5 | 0.1 | 0.0 | 0.05 | 0.02 |
| 103 | Comp. | 640 | 545 | 2.5 | 3.3 | 2.8 | 2.7 | 3.4 | 0.1 | 0.0 | 0.05 | 0.02 |
| 104 | Comp. | 660 | 580 | 1.0 | 3.5 | 2.8 | 1.2 | 3.5 | 0.1 | 0.17 | 0.05 | 0.02 |
| 105 | Comp. | 660 | 580 | 1.0 | 3.5 | 2.8 | 1.2 | 3.5 | 0.1 | 0.17 | 0.05 | 0.18 |
| 106 | Inv. | 640 | 580 | 2.5 | 3.3 | 2.8 | 1.2 | 3.5 | 0.1 | 0.17 | 0.10 | 0.02 |
| 107 | Inv. | 640 | 545 | 2.5 | 3.3 | 2.8 | 2.7 | 3.4 | 0.1 | 0.17 | 0.10 | 0.18 |
| 108 | Inv. | 640 | 545 | 2.5 | 3.3 | 2.8 | 2.7 | 3.4 | 0.1 | 0.25 | 0.15 | 0.21 |
| 109 | Comp. | 640 | 545 | 2.5 | 3.3 | 2.8 | 2.7 | 3.4 | 0.28 | 0.10 | 0.25 | 0.10 |
| 110 | Comp. | 640 | 545 | 2.5 | 3.3 | 2.8 | 2.7 | 3.4 | 0.30 | 0.17 | 0.28 | 0.18 |
| 111 | Comp. | 640 | 545 | 2.5 | 3.3 | 2.8 | 2.7 | 3.4 | 0.1 | 0.08 | 0.15 | 0.21 |

(Evaluation of Samples)

The samples prepared as mentioned above were exposed to light in a manner described below.

By use of the Macbeth color chip of gray color (No. 22) and those of Nos. 1 to 18, the spectral distribution under the standard illumination of each of the colors (relative spectral luminance) was calculated from the spectral reflectance multiplied by the spectral distribution of an ISO sensitometric daylight source (D55).

The above spectral distribution was generated by use of an intensity modulating-type mask formed of liquid crystal panels arranged in a stripe form and also by use of a spectrosensitometer device capable of producing an optional spectral distribution through electrical control of the transmittance of each liquid crystal segment.

The above-mentioned spectrosensitometer device capable of producing a spectral distribution was manufactured with reference to the reports presented by Enomoto et al. in the Annual Meeting of SPSTJ '90.

A long slit light extending along the lattice direction of a diffraction lattice was obtained through an optical system using a cylindrical lens and a high-luminance xenon arc lamp as a light source as illustrated in FIG. 1. The light separated by a transmission-type diffraction lattice acts as a spectral face having a wavelength range of from 400 nm to 700 nm at the dispersion face. Onto this spectral face were placed liquid crystal panels composed of 60 segments wherein 1 segment was 5 nm, and transmittance was controlled at intervals of 5 nm, yielding an objective spectral distribution.

A color-mixed slit light was formed on the surface exposed, and samples 101 to 111, on each of which an optical wedge was placed, were exposed by being scanned in the direction perpendicular to the slit light.

These samples thus exposed under their individual spectral distributions were subjected to the development processing A described previously. Densitometry of the thus-obtained images was carried out. The measurement of the colores reproduced for these samples was carried out under observational conditions based on the color matching test using a 2 degree field adopted by the CIE (Commission Internationale de l'Eclairage) in 1931.

Further, to calculate the CIE Lab values, the 1976 CIE (L*, a*, b*) uniform perceptual color space calculations were used. For a more detailed explanation of the above-mentioned calculations, reference was made to, for example, New-Edition Color Science Handbook, edited by the publication party of Tokyo University (1980), Chapter 4. As an observation light source use was made of "F8" provided in Appendix Table 1 entitled "The values of the relative spectral distribution of typical fluorescent lamps" in JIS8719-1996 "Evaluation of metameric function-degree of illuminating light metamerism."

When the C* value of a "gray" image was 0.5 or more at L*=40, color correction was made by means of exposure through a commercially available color correction filter.

As in the calculation of Lab values of the individual samples, an original hue angle was calculated based on a spectral reflectance using the above-mentioned "F8" as an observation light source.

The results of the evaluation for the samples are summarized in Table 4.

TABLE 4

| Sample No. | Remarks | Average saturation | Declination in hue (degree) |
|---|---|---|---|
| 101 | Comp. | 56 | 35 |
| 102 | Comp. | 42 | 15 |
| 103 | Comp. | 38 | 8 |
| 104 | Comp. | 62 | 36 |
| 105 | Comp. | 78 | 38 |
| 106 | Inv. | 63 | 9 |
| 107 | Inv. | 72 | 8 |
| 108 | Inv. | 88 | 10 |
| 109 | Comp. | 68 | 45 |
| 110 | Comp. | 68 | 48 |
| 111 | Comp. | 72 | 52 |

Table 4 shows that changing the spectral characteristics only, like samples 102 and 103, can improve the faithful color reproduction, but deteriorates saturation. Further, only emphasizing the interimage effect can improve the saturation but deteriorates the faithful color reproduction.

Furthermore, even though the modification of spectral activity characteristics and the emphasis of the interimage effect are made together, like samples 109 to 111, the faithful color reproduction, on the contrary, is deteriorated unless the emphasizing direction meats the requirements according to the invention.

It is shown that only the constitution of the invention combines the faithful color reproduction and the high degree of saturation.

EXAMPLE-2

Preparation of Sample 201

Sample 201 was prepared, the sample having a layer resulting from modifying the 3rd layer of sample 108 to form the following composition by the addition of emulsions T and U provided in Table 5.

| 3rd layer: Light-sensitive emulsion layer | | |
|---|---|---|
| Emulsion R | silver | 0.3 g |
| Emulsion T | silver | 0.1 g |
| Emulsion U | silver | 0.2 g |
| Silver iodide fine grain emulsion (cubic, equivalent-sphere average grain size = 0.05 μm) | silver | 0.020 g |
| Gelatin | | 0.8 g |
| Compound Cpd-M | | 0.10 g |
| Compound Cpd-K | | 2.0 mg |
| High boiling organic solvent Oil-6 | | 0.10 g |
| Ultraviolet absorber U-1 | | 0.10 g |

TABLE 5

Silver halide emulsions used in Sample 201

| Emulsion | Characteristics | Av. ESD (μm) | COV (%) | Av. AgI content (mol %) | Structure in halide composition of silver halide grains | AgI content at grain surface (mol %) | Other characteristics (1) | (2) | (3) | (4) | (5) |
|---|---|---|---|---|---|---|---|---|---|---|---|
| T | Monodispersed (111) tabular grains Av. aspect ratio 6.0 | 0.90 | 10 | 12.0 | Quadruple structure | 1.5 | | | | | ○ |
| U | Monodispersed (111) tabular grains Av. aspect ratio 9.0 | 0.30 | 15 | 10.0 | Quadruple structure | 1.5 | | | | | ○ |

Av. ESD = Average equivalent sphere diameter; COV = Coefficient of variation
(Other characteristics)
The mark "○" means each of the conditions set forth below is satisfied.
(1) A reduction sensitizer was added during grain formation;
(2) A selenium sensitizer was used as an after-ripening agent
(3) A rhodium salt was added during grain formation.
(4) A shell was provided subsequent to after-ripening by using silver nitrate in an amount of 10%, in terms of silver molar ratio, of the emulsion grains at that time, together with the equimolar amount of potassium bromide
(5) The presence of dislocation lines in an average number of ten of more per grain was observed by a transmission electron microscope.

Preparation of Sample 202

A sample resulting from changing the 3rd layer of sample 108 to a lightsensitive unit composed of the three layers below was prepared to make sample 202.

| | | |
|---|---|---|
| **3rd-1 layer: Light-sensitive emulsion layer** | | |
| Emulsion R | silver | 0.1 g |
| Silver iodide fine grain emulsion (cubic, equivalent-sphere average grain size = 0.05 μm) | silver | 0.020 g |
| Gelatin | | 0.8 g |
| Compound Cpd-M | | 0.10 g |
| Compound Cpd-K | | 2.0 mg |
| High boiling organic solvent Oil-6 | | 0.10 g |
| Ultraviolet absorber U-1 | | 0.10 g |
| **3rd-2 layer: Light-sensitive emulsion layer** | | |
| Emulsion T | silver | 0.1 g |
| Silver iodide fine grain emulsion (cubic, equivalent-sphere average grain size = 0.05 μm) | silver | 0.020 g |
| Gelatin | | 0.8 g |
| Compound Cpd-M | | 0.10 g |
| Compound Cpd-K | | 2.0 mg |
| High boiling organic solvent Oil-6 | | 0.10 g |
| Ultraviolet absorber U-1 | | 0.10 g |
| **3rd-3 layer: Light-sensitive emulsion layer** | | |
| Emulsion U | silver | 0.1 g |
| Silver iodide fine grain emulsion (cubic, equivalent-sphere average grain size = 0.05 μm) | silver | 0.020 g |
| Gelatin | | 0.8 g |
| Compound Cpd-M | | 0.10 g |
| Compound Cpd-K | | 2.0 mg |
| High boiling organic solvent Oil-6 | | 0.10 g |
| Ultraviolet absorber U-1 | | 0.10 g |

Samples 201 and 202 were evaluated in the same manner as in Example-1. There were obtained results showing good compatibility between the faithful color reproduction and the great degree of saturation, as in Sample 108.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide color reversal photographic material comprising, on a transparent support, at least one blue-sensitive emulsion layer unit containing a color coupler that forms yellow color, at least one green-sensitive emulsion layer unit containing a color coupler that forms magenta color and at least one red-sensitive emulsion layer unit containing a color coupler that forms cyan color, wherein, the lightsensitive material having means for regulating an interimage effect;

spectral sensitivity distribution of the red-sensitive emulsion layer unit satisfying the following relation:

$$620\ \text{nm} \leqq \lambda r\max \leqq 660\ \text{nm},$$

wherein λrmax is the wavelength at which the maximum sensitivity of the spectral sensitivity distribution of the red-sensitive emulsion layer unit is given;

sensitivities of the red-sensitive emulsion layer unit and the green-sensitive emulsion layer unit satisfying the following relations:

$$Sr(\lambda rmax)-Sr(580) \leqq 1.0 \text{ and}$$

$$-0.5 \leqq Sr(580)-Sg(580) \leqq 0.5$$

wherein Sr(λrmax) is the maximum sensitivity of the red-sensitive emulsion layer unit and Sr(580) is the sensitivity of the red-sensitive emulsion layer unit at 580 nm, and Sg(580) is the sensitivity of the green-sensitive emulsion layer unit at 580 nm; and magnitude of the interimage effect between the red-sensitive emulsion layer unit and the green-sensitive emulsion layer unit satisfying the following relations:

$$\text{IIEgr} \geqq 0.15 \text{ and}$$

$$\text{IIErg} \geqq 0.0$$

wherein IIEgr is the magnitude of the interimage effect from the green-sensitive emulsion layer unit to the red-sensitive emulsion layer unit, and IIErg is the magnitude of the interimage effect from the red-sensitive emulsion layer unit to the green-sensitive emulsion layer unit.

2. The silver halide color reversal photographic material according to claim 1, wherein, spectral sensitivity distribution of the green-sensitive emulsion layer unit satisfying the following relation:

$$520\ \text{nm} \leqq \lambda gmax \leqq 570\ \text{nm}$$

wherein λgmax is the wavelength at which the maximum sensitivity of the spectral sensitivity distribution of the green-sensitive emulsion layer unit is given;

sensitivities of the green-sensitive emulsion layer unit satisfying the following relations:

$$Sg(500) > Sg(580)\ \text{and}$$

$$0 < Sg(\lambda gmax) - Sg(500) \leqq 1.0$$

wherein Sg(500) is the sensitivity of the green-sensitive emulsion layer unit at 500 nm, Sg(580) is the sensitivity of the green-sensitive emulsion layer unit at 580 nm, and Sg(λgmax) is the maximum sensitivity of the green-sensitive emulsion layer unit; and magnitude of the interimage effect between the green-sensitive emulsion layer unit and the blue-sensitive emulsion layer unit satisfying the following relations:

$$IIEbg \geqq 0.15\ \text{and}$$

$$IIEgb \geqq 0.0$$

wherein IIEbg is the magnitude of the interimage effect from the blue-sensitive emulsion layer unit to the green-sensitive emulsion layer unit, and IIEgb is the magnitude of the interimage effect from the green-sensitive emulsion layer unit to the blue-sensitive emulsion layer unit.

3. The silver halide color reversal photographic material according to claim 2, wherein the means for regulating an interimage effect is at least one interimage effect-donating layer that contains a lightsensitive emulsion and that does not substantially form a color image.

4. The silver halide color reversal photographic material according to claim 3, wherein at least one green-sensitive emulsion layer of the green-sensitive emulsion layer unit containing at least one magenta coupler represented by the following general formula (MC-I) and/or at least one red-sensitive emulsion layer of the red-sensitive emulsion layer unit containing at least one cyan coupler represented by the following general formula (CC-I), and each of the amounts of the magenta coupler and the cyan coupler is 30 mol % or more and 100 mol % or less with respect to a image-forming coupler contained in the green-sensitive emulsion layer and the red-sensitive emulsion layer, respectively:

(MC-I)

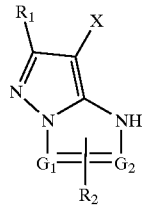

wherein in formula (MC-I), $R_1$ represents a hydrogen atom or substituent; one of $G_1$ and $G_2$ represents a carbon atom, and the other represents a nitrogen atom; $R_2$ represents a substituent that substitutes one of $G_1$ and $G_2$ which is a carbon atom, and $R_1$ and $R_2$ may further have a substituent; X represents a hydrogen atom or a group that is capable of splitting off by a coupling reaction with an aromatic primary amine color developing agent in an oxidized form;

(CC-I)

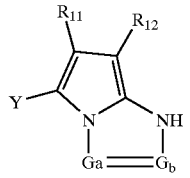

wherein in formula (CC-I), $G_a$ represents —C($R_{13}$)═or —N═, provided that when $G_a$ represents —N═, $G_b$ represents —C($R_{13}$)═, and when $G_a$ represents —C($R_{13}$)═, $G_b$ represents —N═; each of $R_{11}$ and $R_{12}$ represents an electron-withdrawing group having a Hammett substituent constant σp value of 0.20 to 1.0; $R_{13}$ represents a substituent; Y represents a hydrogen atom or a group that is capable of splitting off by a coupling reaction with an aromatic primary amine color developing agent in an oxidized form.

5. The silver halide color reversal photographic material according to claim 2, wherein at least one green-sensitive emulsion layer of the green-sensitive emulsion layer unit containing at least one magenta coupler represented by the following general formula (MC-I) and/or at least one red-sensitive emulsion layer of the red-sensitive emulsion layer unit containing at least one cyan coupler represented by the following general formula (CC-I), and each of the amounts of the magenta coupler and the cyan coupler is 30 mol % or more and 100 mol % or less with respect to a image-forming coupler contained in the green-sensitive emulsion layer and the red-sensitive emulsion layer, respectively:

(MC-I)

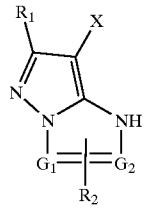

wherein in formula (MC-I), $R_1$ represents a hydrogen atom or substituent; one of $G_1$ and $G_2$ represents a carbon atom, and the other represents a nitrogen atom;

$R_2$ represents a substituent that substitutes one of $G_1$ and $G_2$ which is a carbon atom, and $R_1$ and $R_2$ may further have a substituent; X represents a hydrogen atom or a group that is capable of splitting off by a coupling reaction with an aromatic primary amine color developing agent in an oxidized form;

(CC-I)

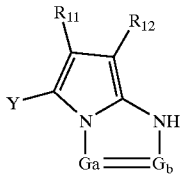

wherein in formula (CC-I), $G_a$ represents —C($R_{13}$)═ or —N═, provided that when $G_a$ represents —N═, $G_b$ represents —C($R_{13}$)═, and when $G_a$ represents —C($R_{13}$)═, $G_b$ represents —N═; each of $R_{11}$ and $R_{12}$ represents an electron-withdrawing group having a Hammett substituent constant σp value of 0.20 to 1.0; $R_{13}$ represents a substituent; Y represents a hydrogen atom or a group that is capable of splitting off by a coupling reaction with an aromatic primary amine color developing agent in an oxidized form.

6. The silver halide color reversal photographic material according to claim 1, wherein the means for regulating an interimage effect is at least one interimage effect-donating layer that contains a lightsensitive emulsion and that does not substantially form a color image.

7. The silver halide color reversal photographic material according to claim 6, wherein at least one green-sensitive emulsion layer of the green-sensitive emulsion layer unit containing at least one magenta coupler represented by the following general formula (MC-I) and/or at least one red-sensitive emulsion layer of the red-sensitive emulsion layer unit containing at least one cyan coupler represented by the following general formula (CC-I), and each of the amounts of the magenta coupler and the cyan coupler is 30 mol % or more and 100 mol % or less with respect to a image-forming coupler contained in the green-sensitive emulsion layer and the red-sensitive emulsion layer, respectively:

(MC-I)

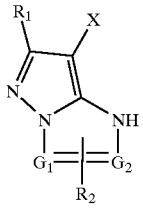

wherein in formula (MC-I), $R_1$ represents a hydrogen atom or substituent; one of $G_1$ and $G_2$ represents a carbon atom, and the other represents a nitrogen atom; $R_2$ represents a substituent that substitutes one of $G_1$ and $G_2$ which is a carbon atom, and $R_1$ and $R_2$ may further have a substituent; X represents a hydrogen atom or a group that is capable of splitting off by a coupling reaction with an aromatic primary amine color developing agent in an oxidized form;

(CC-I)

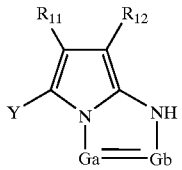

wherein in formula (CC-I), $G_a$ represents —C($R_{13}$)═ or —N═, provided that when $G_a$ represents —N═, $G_b$ represents —C($R_{13}$)═, and when $G_a$ represents —C($R_{13}$)═, $G_b$ represents —N═; each of $R_{11}$ and $R_{12}$ represents an electron-withdrawing group having a Hammett substituent constant σp value of 0.20 to 1.0; $R_{13}$ represents a substituent; Y represents a hydrogen atom or a group that is capable of splitting off by a coupling reaction with an aromatic primary amine color developing agent in an oxidized form.

8. The silver halide color reversal photographic material according to claim 1, wherein at least one green-sensitive emulsion layer of the green-sensitive emulsion layer unit containing at least one magenta coupler represented by the following general formula (MC-I) and/or at least one red-sensitive emulsion layer of the red-sensitive emulsion layer unit containing at least one cyan coupler represented by the following general formula (CC-I), and each of the amounts of the magenta coupler and the cyan coupler is 30 mol % or more and 100 mol % or less with respect to a image-forming coupler contained in the green-sensitive emulsion layer and the red-sensitive emulsion layer, respectively:

(MC-I)

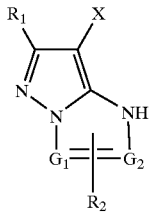

wherein in formula (MC-I), $R_1$ represents a hydrogen atom or substituent; one of $G_1$ and $G_2$ represents a carbon atom, and the other represents a nitrogen atom; $R_2$ represents a substituent that substitutes one of $G_1$ and $G_2$ which is a carbon atom, and $R_1$ and $R_2$ may further have a substituent; X represents a hydrogen atom or a group that is capable of splitting off by a coupling reaction with an aromatic primary amine color developing agent in an oxidized form;

(CC-I)

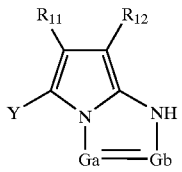

wherein in formula (CC-I), $G_a$ represents —C($R_{13}$)═ or —N═, provided that when $G_a$ represents —N═, $G_b$ represents —C($R_{13}$)═, and when $G_a$ represents —C($R_{13}$)═, $G_b$ represents —N═; each of $R_{11}$ and $R_{12}$ represents an electron-withdrawing group having a Hammett substituent constant σp value of 0.20 to 1.0; $R_{13}$ represents a substituent; Y represents a hydrogen atom or a group that is capable of splitting off by a coupling reaction with an aromatic primary amine color developing agent in an oxidized form.

* * * * *